US008998677B2

(12) United States Patent
Duescher

(10) Patent No.: US 8,998,677 B2
(45) Date of Patent: Apr. 7, 2015

(54) BELLOWS DRIVEN FLOATATION-TYPE ABRADING WORKHOLDER

(71) Applicant: Wayne O. Duescher, Roseville, MN (US)

(72) Inventor: Wayne O. Duescher, Roseville, MN (US)

( * ) Notice: Subject to any disclaimer, the term of this patent is extended or adjusted under 35 U.S.C. 154(b) by 128 days.

(21) Appl. No.: 13/869,198

(22) Filed: Apr. 24, 2013

(65) Prior Publication Data

US 2014/0120805 A1 May 1, 2014

Related U.S. Application Data

(63) Continuation-in-part of application No. 13/662,863, filed on Oct. 29, 2012, now Pat. No. 8,845,394.

(51) Int. Cl.

| | |
|---|---|
| ***B24B 37/00*** | (2012.01) |
| ***B24B 37/30*** | (2012.01) |
| ***B24B 37/32*** | (2012.01) |
| ***B24B 41/04*** | (2006.01) |

(52) U.S. Cl.

CPC ..... *B24B 37/30* (2013.01); *B24B 37/32* (2013.01); *B24B 41/04* (2013.01)

(58) Field of Classification Search

CPC ..... B24B 7/04; B24B 7/228; B24B 37/30; B24B 37/32; B24B 49/16; B24B 37/04; B24B 41/061

USPC ..... 451/41, 285–290, 397–398

See application file for complete search history.

(56) References Cited

U.S. PATENT DOCUMENTS

| | | | | |
|---|---|---|---|---|
| 1,799,332 | A * | 4/1931 | Stevens | 15/97.1 |
| 4,593,495 | A | 6/1986 | Kawakami et al. | |
| 4,918,870 | A | 4/1990 | Torbert et al. | |
| 5,205,082 | A | 4/1993 | Shendon et al. | |
| 5,364,655 | A | 11/1994 | Nakamura et al. | |
| 5,365,700 | A * | 11/1994 | Sawada et al. | 451/28 |
| 5,384,991 | A * | 1/1995 | Lee | 451/57 |
| 5,421,768 | A | 6/1995 | Fujiwara et al. | |
| 5,443,416 | A | 8/1995 | Volodarsky et al. | |
| 5,569,062 | A | 10/1996 | Karlsrud et al. | |
| 5,597,346 | A | 1/1997 | Hempel, Jr. | |
| 5,643,053 | A | 7/1997 | Shendon | |
| 5,643,067 | A | 7/1997 | Katsuoka et al. | |
| 5,647,789 | A * | 7/1997 | Kitta et al. | 451/41 |
| 5,681,215 | A * | 10/1997 | Sherwood et al. | 451/388 |
| 5,683,289 | A | 11/1997 | Hempel, Jr. | |
| 5,738,574 | A | 4/1998 | Tolles et al. | |
| 5,769,697 | A | 6/1998 | Nishio | |
| 5,795,215 | A * | 8/1998 | Guthrie et al. | 451/286 |

(Continued)

*Primary Examiner* — George Nguyen

(74) *Attorney, Agent, or Firm* — Mark A. Litman & Associates, P.A.

(57) ABSTRACT

Flat-surfaced workpieces such as semiconductor wafers are attached to a rotatable floating workpiece holder carrier rotor that is supported by and rotationally driven by a bellows. The rotating wafer carrier rotor is restrained by a set of idlers that are attached to a stationary housing to provide rigid support against abrading forces. The idlers allow low-friction operation of the abrading system to be provided at the very high abrading speeds used in high speed flat lapping with raised-island abrasive disks. The carrier rotor is also restrained by a rigid rotating housing to allow a limited lateral motion and also a limited angular motion. Air pressure within a sealed bellows chamber provides controlled abrading pressure for wafers or other workpieces. Vacuum can also be applied to the bellows chamber to quickly move the wafer away from the abrading surface. Wafers can be quickly attached to the workpiece carrier with vacuum.

20 Claims, 22 Drawing Sheets

(56) References Cited

U.S. PATENT DOCUMENTS 5,800,254 A 9/1998 Motley et al.
5,851,140 A * 12/1998 Barns et al. ..... 451/288
5,860,853 A * 1/1999 Hasegawa et al. ..... 451/285
5,874,318 A 2/1999 Baker et al.
5,910,041 A 6/1999 Duescher
5,913,714 A * 6/1999 Volodarsky et al. ..... 451/41
5,913,718 A * 6/1999 Shendon ..... 451/288
5,916,009 A 6/1999 Izumi et al.
5,944,583 A 8/1999 Cruz et al.
5,964,651 A 10/1999 Hose
5,967,882 A 10/1999 Duescher
5,975,997 A 11/1999 Minami
5,985,093 A 11/1999 Chen
5,989,104 A 11/1999 Kim et al.
5,993,298 A 11/1999 Duescher
5,993,302 A 11/1999 Chen et al.
6,019,670 A * 2/2000 Cheng et al. ..... 451/56
6,027,398 A 2/2000 Numoto et al.
6,048,254 A 4/2000 Duescher
6,050,882 A 4/2000 Chen
6,056,632 A 5/2000 Mitchel et al.
6,066,030 A * 5/2000 Uzoh ..... 451/41
6,074,277 A 6/2000 Arai
6,080,050 A 6/2000 Chen et al.
6,083,090 A * 7/2000 Bamba ..... 451/288
6,089,959 A 7/2000 Nagahashi
6,093,088 A * 7/2000 Mitsuhashi et al. ..... 451/285
6,102,777 A * 8/2000 Duescher et al. ..... 451/36
6,113,468 A * 9/2000 Natalicio ..... 451/41
6,116,993 A 9/2000 Tanaka
6,120,352 A 9/2000 Duescher
6,126,993 A 10/2000 Orcel et al.
6,132,298 A 10/2000 Zuniga et al.
6,146,259 A 11/2000 Zuniga et al.
6,149,506 A * 11/2000 Duescher ..... 451/59
6,165,056 A 12/2000 Hayashi et al.
6,168,506 B1 1/2001 McJunken
6,179,956 B1 1/2001 Nagahara et al.
6,183,354 B1 2/2001 Zuniga et al.
6,196,903 B1 * 3/2001 Kimura ..... 451/285
6,217,411 B1 * 4/2001 Hiyama et al. ..... 451/8
6,217,433 B1 4/2001 Herrman et al.
6,251,215 B1 6/2001 Zuniga et al.
6,270,392 B1 8/2001 Hayashi et al.
6,299,741 B1 10/2001 Sun et al.
6,354,907 B1 * 3/2002 Satoh et al. ..... 451/5
6,361,420 B1 3/2002 Zuniga et al.
6,371,838 B1 4/2002 Holzapfel
6,390,901 B1 5/2002 Hiyama et al.
6,390,905 B1 5/2002 Korovin et al.
6,394,882 B1 5/2002 Chen
6,398,906 B1 6/2002 Kobayashi et al.
6,409,585 B1 * 6/2002 Oowada ..... 451/364
6,425,809 B1 7/2002 Ichimura et al.
6,436,828 B1 8/2002 Chen et al.
6,439,965 B1 8/2002 Ichino
6,443,821 B1 9/2002 Kimura et al.
6,447,368 B1 9/2002 Fruitman et al.
6,491,570 B1 12/2002 Sommer et al.
6,506,105 B1 1/2003 Kajiwara et al.
6,558,232 B1 5/2003 Kajiwara et al.
6,585,567 B1 7/2003 Black et al.
6,592,434 B1 7/2003 Vanell et al.
6,607,157 B1 * 8/2003 Duescher ..... 242/417.3
6,659,850 B2 12/2003 Korovin et al.
6,672,949 B2 1/2004 Chopra et al.
6,716,094 B2 * 4/2004 Shendon et al. ..... 451/288
6,722,962 B1 * 4/2004 Sato et al. ..... 451/259
6,729,944 B2 5/2004 Birang et al.
6,752,700 B2 6/2004 Duescher
6,761,618 B1 * 7/2004 Leigh et al. ..... 451/11
6,769,969 B1 8/2004 Duescher
6,805,613 B1 * 10/2004 Weldon et al. ..... 451/6
6,837,779 B2 1/2005 Smith et al.
6,893,332 B2 5/2005 Castor
6,896,584 B2 5/2005 Perlov et al.
6,899,603 B2 5/2005 Homma et al.
6,899,607 B2 5/2005 Brown
6,899,609 B2 5/2005 Hong
6,935,013 B1 8/2005 Markevitch et al.
7,001,251 B2 2/2006 Doan et al.
7,001,257 B2 2/2006 Chen et al.
7,008,303 B2 3/2006 White et al.
7,014,535 B2 3/2006 Custer et al.
7,018,906 B2 3/2006 Chen et al.
7,029,380 B2 4/2006 Horiguchi et al.
7,033,251 B2 4/2006 Elledge
7,044,838 B2 5/2006 Maloney et al.
7,081,042 B2 7/2006 Chen et al.
7,101,273 B2 9/2006 Tseng et al.
7,125,313 B2 10/2006 Zelenski et al.
7,144,304 B2 12/2006 Moore
7,147,541 B2 12/2006 Nagayama et al.
7,166,016 B1 1/2007 Chen
7,250,368 B2 7/2007 Kida et al.
7,276,446 B2 10/2007 Robinson et al.
7,292,427 B1 11/2007 Murdoch et al.
7,294,041 B1 * 11/2007 Lee et al. ..... 451/8
7,357,699 B2 4/2008 Togawa et al.
7,367,867 B2 5/2008 Boller
7,393,790 B2 7/2008 Britt et al.
7,419,910 B2 9/2008 Minamihaba et al.
7,422,634 B2 9/2008 Powell et al.
7,445,847 B2 11/2008 Kulp
7,446,018 B2 11/2008 Brogan et al.
7,452,817 B2 11/2008 Yoon et al.
7,456,106 B2 11/2008 Koyata et al.
7,456,107 B2 11/2008 Keleher et al.
7,470,169 B2 12/2008 Taniguchi et al.
7,485,028 B2 2/2009 Wilkinson et al.
7,485,241 B2 2/2009 Schroeder et al.
7,488,235 B2 2/2009 Park et al.
7,488,236 B2 2/2009 Shimomura et al.
7,488,240 B2 2/2009 Saito
7,491,116 B2 2/2009 Sung
7,491,342 B2 2/2009 Kamiyama et al.
7,507,148 B2 3/2009 Kitahashi et al.
7,510,974 B2 3/2009 Li et al.
7,520,798 B2 4/2009 Muldowney et al.
7,520,800 B2 4/2009 Duescher
7,527,271 B2 5/2009 Oh et al.
7,527,722 B2 5/2009 Sharan
7,553,214 B2 6/2009 Menk et al.
7,568,970 B2 8/2009 Wang
7,572,172 B2 8/2009 Aoyama et al.
7,579,071 B2 8/2009 Huh et al.
7,582,221 B2 9/2009 Netsu et al.
7,601,050 B2 10/2009 Zuniga et al.
7,614,939 B2 11/2009 Tolles et al.
7,618,529 B2 11/2009 Ameen et al.
7,632,434 B2 12/2009 Duescher
7,648,410 B2 1/2010 Choi
7,699,684 B2 4/2010 Prasad
7,708,621 B2 5/2010 Saito
7,731,568 B2 6/2010 Shimomura et al.
7,741,656 B2 6/2010 Nakayama et al.
7,753,761 B2 7/2010 Fujita
7,754,611 B2 7/2010 Chen et al.
7,762,870 B2 7/2010 Ono et al.
7,807,252 B2 10/2010 Hendron et al.
7,822,500 B2 10/2010 Kobayashi et al.
7,833,907 B2 11/2010 Anderson et al.
7,837,800 B2 11/2010 Fukasawa et al.
7,838,482 B2 11/2010 Fukasawa et al.
7,840,305 B2 11/2010 Behr et al.
7,883,397 B2 2/2011 Zuniga et al.
7,884,020 B2 2/2011 Hirabayashi et al.
7,897,250 B2 3/2011 Iwase et al.
7,922,783 B2 4/2011 Sakurai et al.
7,947,190 B2 5/2011 Brown
7,950,985 B2 5/2011 Zuniga et al.
7,955,964 B2 6/2011 Wu et al.
7,972,396 B2 7/2011 Feng et al.
8,002,860 B2 8/2011 Koyama et al.

(56) References Cited

U.S. PATENT DOCUMENTS

| | | | | |
|---|---|---|---|---|
| 8,021,215 | B2 | 9/2011 | Zuniga et al. | |
| 8,025,813 | B2 | 9/2011 | Liu et al. | |
| 8,029,640 | B2 | 10/2011 | Zuniga et al. | |
| 8,043,140 | B2 | 10/2011 | Fujita | |
| 8,047,899 | B2 | 11/2011 | Chen et al. | |
| 8,062,096 | B2 | 11/2011 | Brusic et al. | |
| 8,071,479 | B2 | 12/2011 | Liu | |
| 8,088,299 | B2 | 1/2012 | Chen et al. | |
| 8,101,060 | B2 | 1/2012 | Lee | |
| 8,101,093 | B2 | 1/2012 | De Rege et al. | |
| 8,845,394 | B2 * | 9/2014 | Duescher | 451/41 |
| 2001/0009843 | A1 * | 7/2001 | Hirokawa et al. | 451/160 |
| 2001/0011003 | A1 * | 8/2001 | Numoto | 451/379 |
| 2001/0034199 | A1 * | 10/2001 | Park | 451/287 |
| 2001/0041522 | A1 * | 11/2001 | Shendon et al. | 451/288 |
| 2001/0044268 | A1 * | 11/2001 | Shendon | 451/285 |
| 2002/0009958 | A1 * | 1/2002 | Gotcher | 451/288 |
| 2002/0033230 | A1 * | 3/2002 | Hayashi et al. | 156/345 |
| 2002/0173256 | A1 * | 11/2002 | Suwabe | 451/287 |
| 2002/0182995 | A1 * | 12/2002 | Shendon et al. | 451/398 |
| 2003/0008600 | A1 * | 1/2003 | Ide | 451/41 |
| 2003/0008604 | A1 * | 1/2003 | Boo et al. | 451/388 |
| 2003/0129932 | A1 * | 7/2003 | Ficarro | 451/288 |
| 2005/0118939 | A1 | 6/2005 | Duescher | |
| 2007/0111641 | A1 * | 5/2007 | Lee et al. | 451/11 |
| 2008/0299875 | A1 | 12/2008 | Duescher | |
| 2010/0003904 | A1 | 1/2010 | Duescher | |
| 2011/0223835 | A1 | 9/2011 | Duescher | |
| 2011/0223836 | A1 | 9/2011 | Duescher | |
| 2011/0223838 | A1 | 9/2011 | Duescher | |

* cited by examiner

BELLOWS DRIVEN FLOATATION-TYPE ABRADING WORKHOLDER

CROSS REFERENCE TO RELATED APPLICATION

This invention is a continuation-in-part of U.S. patent application Ser. No. 13/662,863 filed Oct. 29, 2012 which is incorporated herein by reference in its entirety.

BACKGROUND OF THE INVENTION

Field of the Invention

The present invention relates to the field of abrasive treatment of surfaces such as grinding, polishing and lapping. In particular, the present invention relates to a high speed bellow-drive semiconductor wafer workholder system for use with single-sided abrading machines that have rotary abrasive coated flat-surfaced platens. The bellows-drive workholders allow the workpiece substrates to be rotated at the same high rotation speeds as the platens. Often these platen and workholder speeds exceed 3,000 rpm. Conventional workholders can only attain these required rotational speeds with the use of complex devices and operational procedures.

The flexible bellows driven workholders provide that uniform abrading pressures are applied across the full abraded surfaces of the workpieces such as semiconductor wafers. One or more of the workholders can be used simultaneously with a rotary abrading platen.

High speed flat lapping is typically performed using flexible disks that have an annular band of abrasive-coated raised islands. These raised-island disks are attached to flat-surfaced platens that rotate at high abrading speeds. The use of the raised island disks prevent hydroplaning of the lapped workpieces when they are lapped at high speeds with the presence of coolant water. Hydroplaning causes the workpieces to tilt which results in non-flat lapped workpiece surfaces. Excess water is routed from contact with the workpiece flat surfaces into the recessed passageways that surround the abrasive coated raised island structures.

Flat lapping of workpiece surfaces used to produce precision-flat and mirror smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance.

The chemical mechanical planarization (CMP) liquid-slurry abrading system has been the system-of-choice for polishing semiconductor wafers that are already exceedingly flat. During CMP polishing, a very small amount of material is removed from the surface of the wafer. Typically the amount of material removed by polishing is measured in angstroms where the overall global flatness of the wafer is not affected much. It is critical that the global flatness of the wafer surface is maintained in a precision-flat condition to allow new patterned layers of metals and insulating oxides to be deposited on the wafer surfaces with the use of photolithography techniques. Global flatness is a measure of the flatness across the full surface of the wafer. Site or localized flatness of a wafer refers to the flatness of a localized portion of the wafer surface.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pr3essure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

U.S. Pat. No. 8,328,600 (Duescher) describes the use of spherical-action mounts for air bearing and conventional flat-surfaced abrasive-covered spindles used for abrading where the spindle flat surface can be easily aligned to be perpendicular to another device. Here, in the present invention, this type of air bearing and conventional flat-surfaced abrasive-covered spindles can be used where the spindle flat abrasive surface can be easily aligned to be perpendicular with the rotational axis of a floating bellows-type workholder device. This patent is incorporated herein by reference in its entirety.

Various abrading machines and abrading processes are described in U.S. Pat. No. 5,364,655 (Nakamura et al). U.S. Pat. No. 5,569,062 (Karlsrud), U.S. Pat. No. 5,643,067 (Katsuoka et al), U.S. Pat. No. 5,769,697 (Nisho), U.S. Pat. No. 5,800,254 (Motley et al), U.S. Pat. No. 5,916,009 (Izumi et al), U.S. Pat. No. 5,964,651 (hose), U.S. Pat. No. 5,975,997 (Minami, U.S. Pat. No. 5,989,104 (Kim et al), U.S. Pat. No. 6,089,959 (Nagahashi, U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al), U.S. Pat. No. 7,166,016 (Chen), U.S. Pat. No. 7,250,368 (Kida et al), U.S. Pat. No. 7,367,867 (Boller), U.S. Pat. No. 7,393,790 (Britt et al), U.S. Pat. No. 7,422,634 (Powell et al), U.S. Pat. No. 7,446,018 (Brogan et al), U.S. Pat. No. 7,456,106 (Koyata et al), U.S. Pat. No. 7,470,169 (Taniguchi et al), U.S. Pat. No. 7,491,342 (Kamiyama et al), U.S. Pat. No. 7,507,148 (Kitahashi et al), U.S. Pat. No. 7,527,722 (Sharan) and U.S. Pat. No. 7,582,221 (Netsu et al).

Also, various CMP machines, resilient pads, materials and processes are described in U.S. Pat. No. 8,101,093 (de Rege Thesauro et al.), U.S. Pat. No. 8,101,060 (Lee), U.S. Pat. No. 8,071,479 (Liu), U.S. Pat. No. 8,062,096 (Brusic et al.), U.S. Pat. No. 8,047,899 (Chen et al.), U.S. Pat. No. 8,043,140 (Fujita), U.S. Pat. No. 8,025,813 (Liu et al.), U.S. Pat. No. 8,002,860 (Koyama et al.), U.S. Pat. No. 7,972,396 (Feng et al.), U.S. Pat. No. 7,955,964 (Wu et al.), U.S. Pat. No. 7,922,783 (Sakurai et al.), U.S. Pat. No. 7,897,250 (Iwase et al.), U.S. Pat. No. 7,884,020 (Hirabayashi et al.), U.S. Pat. No. 7,840,305 (Behr et al.), U.S. Pat. No. 7,838,482 (Fukasawa et al.), U.S. Pat. No. 7,837,800 (Fukasawa et al.), U.S. Pat. No. 7,833,907 (Anderson et al.), U.S. Pat. No. 7,822,500 (Kobayashi et al.), U.S. Pat. No. 7,807,252 (Hendron et al.), U.S. Pat. No. 7,762,870 (Ono et al.), U.S. Pat. No. 7,754,611 (Chen et al.), U.S. Pat. No. 7,753,761 (Fujita), U.S. Pat. No. 7,741,656 (Nakayama et al.), U.S. Pat. No. 7,731,568 (Shimomura et al.), U.S. Pat. No. 7,708,621 (Saito), U.S. Pat. No. 7,699,684 (Prasad), U.S. Pat. No. 7,648,410 (Choi), U.S. Pat. No. 7,618,529 (Ameen et al.), U.S. Pat. No. 7,579,071 (Huh et al.), U.S. Pat. No. 7,572,172 (Aoyama et al.), U.S. Pat. No. 7,568,970 (Wang), U.S. Pat. No. 7,553,214 (Menk et al.), U.S. Pat. No. 7,520,798 (Muldowney), U.S. Pat. No. 7,510,974 (Li et al.), U.S. Pat. No. 7,491,116 (Sung), U.S. Pat. No. 7,488,236 (Shimomura et al.), U.S. Pat. No. 7,488,240 (Saito), U.S. Pat. No. 7,488,235 (Park et al.), U.S. Pat. No. 7,485,241 (Schroeder et al.), U.S. Pat. No. 7,485,028 (Wilkinson et al), U.S. Pat. No. 7,456,107 (Keleher et al.), U.S. Pat. No. 7,452,817 (Yoon et al.), U.S. Pat. No. 7,445,847 (Kulp), U.S. Pat. No. 7,419,910 (Minamihaba et al.), U.S. Pat. No. 7,018,906 (Chen et al.), U.S. Pat. No. 6,899,609 (Hong), U.S. Pat. No. 6,729,944 (Birang et al.), U.S. Pat. No. 6,672,949 (Chopra et al.), U.S. Pat. No. 6,585,567 (Black et al.), U.S. Pat. No. 6,270,392 (Hayashi et al.), U.S. Pat. No. 6,165,056 (Hayashi et al.), U.S. Pat. No. 6,116,993 (Tanaka), U.S. Pat. No. 6,074,277 (Arai), U.S. Pat. No. 6,027,398 (Numoto et al.), U.S. Pat. No. 5,985,093 (Chen), U.S. Pat. No. 5,944,583 (Cruz et al.), U.S. Pat. No. 5,874,318 (Baker et al.), U.S. Pat. No. 5,683,289 (Hempel Jr.), U.S. Pat. No. 5,643,053 (Shendon),), U.S. Pat. No. 5,597,346 (Hempel Jr.).

Other wafer carrier heads are described in U.S. Pat. No. 5,421,768 (Fujiwara et al.), U.S. Pat. No. 5,443,416 (Volodarsky et al.), U.S. Pat. No. 5,738,574 (Tolles et al.), U.S. Pat. No. 5,993,302 (Chen et al.), U.S. Pat. No. 6,050,882 (Chen), U.S. Pat. No. 6,056,632 (Mitchel et al.), U.S. Pat. No. 6,080,050 (Chen et al.), U.S. Pat. No. 6,126,116 (Zuniga et al.), U.S. Pat. No. 6,132,298 (Zuniga et al.), U.S. Pat. No. 6,146,259 (Zuniga et al.), U.S. Pat. No. 6,179,956 (Nagahara et al.), U.S. Pat. No. 6,183,354 (Zuniga et al.), U.S. Pat. No. 6,251,215 (Zuniga et al.), U.S. Pat. No. 6,299,741 (Sun et al.), U.S. Pat. No. 6,361,420 (Zuniga et al.), U.S. Pat. No. 6,390,901 (Hiyama et al.), U.S. Pat. No. 6,390,905 (Korovin et al.), U.S. Pat. No. 6,394,882 (Chen), U.S. Pat. No. 6,436,828 (Chen et al.), U.S. Pat. No. 6,443,821 (Kimura et al.), U.S. Pat. No. 6,447,368 (Fruitman et al.), U.S. Pat. No. 6,491,570 (Sommer et al.), U.S. Pat. No. 6,506,105 (Kajiwara et al.), U.S. Pat. No. 6,558,232 (Kajiwara et al.), U.S. Pat. No. 6,592,434 (Vanell et al.), U.S. Pat. No. 6,659,850 (Korovin et al.), U.S. Pat. No. 6,837,779 (Smith et al.), U.S. Pat. No. 6,899,607 (Brown), U.S. Pat. No. 7,001,257 (Chen et al.), U.S. Pat. No. 7,081,042 (Chen et al.), U.S. Pat. No. 7,101,273 (Tseng et al.), U.S. Pat. No. 7,292,427 (Murdock et al.), U.S. Pat. No. 7,527,271 (Oh et al.), U.S. Pat. No. 7,601,050 (Zuniga et al.), U.S. Pat. No. 7,883,397 (Zuniga et al.), U.S. Pat. No. 7,947,190 (Brown), U.S. Pat. No. 7,950,985 (Zuniga et al.), U.S. Pat. No. 8,021,215 (Zuniga et al.), U.S. Pat. No. 8,029,640 (Zuniga et al.), U.S. Pat. No. 8,088,299 (Chen et al.), All references cited herein are incorporated herein in the entirety by reference.

SUMMARY OF THE INVENTION

The presently disclosed technology includes precision-thickness flexible abrasive disks having disk thickness variations of less than 0.0001 inches (3 microns) across the full annular bands of abrasive-coated raised islands to allow flat-surfaced contact with workpieces at very high abrading speeds. Use of a platen vacuum disk attachment system allows quick set-up changes where different sizes of abrasive particles and different types of abrasive material can be quickly attached to the flat platen surfaces.

Water coolant is used with these raised island abrasive disks, which allows them to be used at very high abrading speeds, often in excess of 10,000 SFPM (160 km per minute). The coolant water is typically applied directly to the top surfaces of the workpieces. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading and with continuous-coated abrasive disks.

Semiconductor wafers require extremely flat surfaces when using photolithography to deposit patterns of materials to form circuits across the full flat surface of a wafer. When theses wafers are abrasively polished between deposition steps, the surfaces of the wafers must remain precisely flat.

Resilient wafer pads can be used to minimize the effects of the abraded surfaces of the wafers not being precisely parallel to the platen abrading surface. When the platen is lowered into abrading contact with the workpieces, the resilient pads are compressed and the wafer assumes full flat-surfaced contact with the platen abrading surface. The wafers are then abraded uniformly across the full abraded surfaces of the wafers.

The same types of chemicals that are used in the conventional CMP polishing of wafers can be used with this abrasive lapping or polishing system. These liquid chemicals can be applied as a mixture with the coolant water that is used to cool both the wafers and the fixed abrasive coatings on the rotating abrading platen This mixture of coolant water and chemicals continually washes the abrading debris away from the abrading surfaces of the fixed-abrasive coated raised islands which prevents unwanted abrading contact of the abrasive debris with the abraded surfaces of the wafers.

The air bearing workholders can be used with a wide variety of abrasive media. The rotary platens can be covered with flexible abrasive-coated raised island disks or the platens can be coated with a slurry mixture of abrasive particles and a liquid. In addition, these workholders can be used to provide CMP polishing of semiconductor wafers at abrading speeds that are substantially increased over the abrading speeds of conventional CMP polishing machines.

Slurry lapping is often done at very slow abrading speeds of about 5 mph (8 kph). By comparison, the high speed flat lapping system often operates at or above 100 mph (160 kph). This is a speed difference ratio of 20 to 1. These abrading speeds can exceed 10,000 surface feet per minute (SFPM) or 3,048 surface meters per minute. Increasing abrading speeds increase the material removal rates. High abrading speeds result in high workpiece production rates and large cost savings.

Workpieces are often rotated at rotational speeds that are approximately equal to the rotational speeds of the platens to provide equally-localized abrading speeds across the full radial width of the platen annular abrasive when the workpiece spindles are rotated in the same rotation direction as the platens. Often these platen and workholder rotational speeds exceed 3,000 rpm. Typically, conventional spherical action types of workholders are used to provide flat-surfaced contact of workpieces with a flat-surfaced abrasive covered platen that rotates at very high speeds. In addition, the abrading friction forces that are applied to the workpieces by the moving abrasive tend to tilt the workpieces that are attached to the offset workholders. Tilting causes non-flat abraded workpiece surfaces.

Also, these conventional rotating offset spherical-action workholders are nominally unstable at very high rotation speeds, especially when the workpieces are not held firmly in direct flat-surfaced contact with the platen abrading surface. It is necessary to provide controlled operation of these unstable spherical-action workholders to prevent unwanted vibration or oscillation of the workholders (and workpieces) at very high rotational speeds of the workholders. Vibrations of the workholders can produce patterns of uneven surface wear of an expensive semiconductor wafer.

The present system provides friction-free and vibrationally stable rotation of the workpieces without the use of offset spherical-action universal joint rotation devices. Tilting of the workpieces dos not occur because the offset spherical-action universal joint rotation devices are not used. Uniform abrading pressures are applied across the full abraded surfaces of the workpieces such as semiconductor wafers by the air bearing workholders. Also, one or more of the workholders can be used simultaneously with a rotary abrading platen.

DETAILED DESCRIPTION OF THE INVENTION

Figure 13:
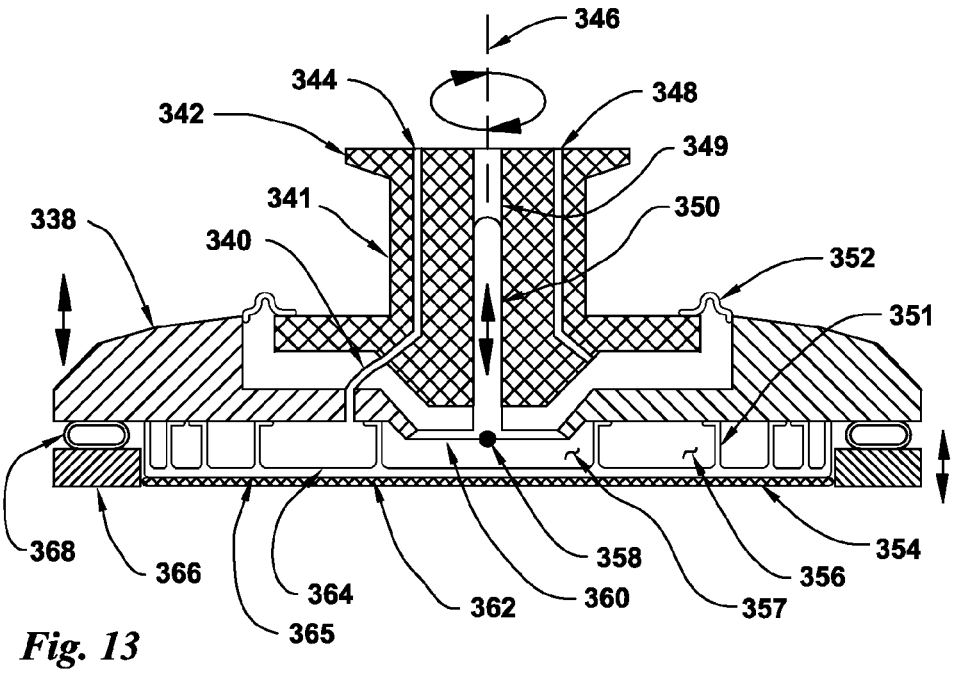
Fig. 13 Prior Art
FIG. 13 is a cross section view of a prior art pneumatic bladder type of wafer carrier.

FIG. 13 is a cross section view of a conventional prior art pneumatic bladder type of wafer carrier. A rotatable wafer carrier head 341 having a wafer carrier hub 342 is attached to the rotatable head (not shown) of a polishing machine tool (not shown) where the carrier hub 342 is loosely attached with flexible joint device 352 and a rigid slide-pin 350 to a rigid carrier plate 338. The cylindrical rigid slide-pin 350 can move along a cylindrical hole 349 in the carrier hub 342 which allows the rigid carrier plate 338 to move axially along the hole 349 where the movement of the carrier plate 338 is relative to the carrier hub 342. The rigid slide-pin 350 is attached to a flexible diaphragm 360 that is attached to carrier plate 338 which allows the carrier plate 338 to be spherically rotated about a rotation point 358 relative to the rotatable carrier hub 342 that is remains aligned with its rotational axis 346.

A sealed flexible elastomeric diaphragm device 364 has a number of individual annular sealed pressure chambers 356 having flexible elastomeric chamber walls 351 and a circular center chamber 357 where the air pressure can be independently adjusted for each of the individual chambers 356, 357 to provide different abrading pressures to a wafer workpiece 354 that is attached to the wafer mounting surface 365 of the elastomeric diaphragm 364. A wafer 354 carrier annular back-up ring 366 provides containment of the wafer 354 within the rotating but stationary-positioned wafer carrier head 341 as the wafer 354 abraded surface 362 is subjected to abrasion-friction forces by the moving abrasive coated platen (not shown). An air-pressure annular bladder 368 applies controlled contact pressure of the wafer 354 carrier annular back-up ring 366 with the platen abrasive coating surface. Controlled-pressure air is supplied from air inlet passageways 344 and 396 in the carrier hub 342 to each of the multiple flexible pressure chambers 356, 357 by flexible tubes 340.

When CMP polishing of wafers takes place, a resilient porous CMP pad is saturated with a liquid loose-abrasive slurry mixture and is held in moving contact with the flat-surfaced semiconductor wafers to remove a small amount of excess deposited material from the top surface of the wafers. The wafers are held by a wafer carrier head that rotates as the wafer is held in abrading contact with the CMP pad that is attached to a rotating rigid platen. Both the carrier head and the pad are rotated at the same slow speeds.

The pneumatic-chamber wafer carrier heads typically are constructed with a flexible elastomer membrane that supports a wafer where five individual annular chambers allow the abrading pressure to be varied across the radial surface of the wafer. The rotating carrier head has a rigid hub and a floating wafer carrier plate that has a "spherical" center of rotation where the wafer is held in flat-surfaced abrading contact with a moving resilient CMP pad. A rigid wafer retaining ring that contacts the edge of the wafer is used to resist the abrading forces applied to the wafer by the moving pad.

Figure 14:
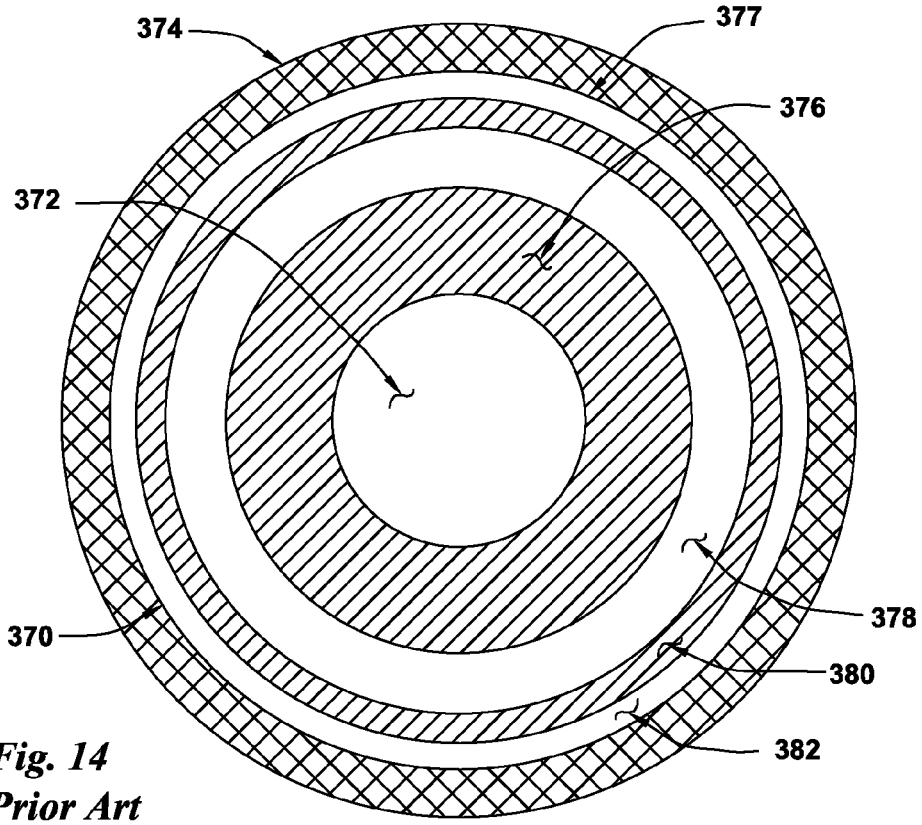
Fig. 14 Prior Art
FIG. 14 is a bottom view of a prior art pneumatic bladder type of wafer carrier.

FIG. 14 is a bottom view of a conventional prior art pneumatic bladder type of wafer carrier. A wafer carrier head 374 having an continuous nominally-flat surface elastomeric diaphragm 377 is shown having multiple annular pneumatic pressure chamber areas 376, 378, 380, 382 and one circular center pressure chamber area 372. The wafer carrier head 374 can have more or less than five individual pressure chambers. A wafer carrier head 374 annular back-up ring 370 provides containment of the wafer (not shown) within the wafer carrier head 374 as the wafer (not shown) that is attached to the continuous nominally-flat surface of the elastomeric diaphragm device 377 is subjected to abrasive friction forces. Here, the semiconductor wafer substrate is loosely attached to a flexible continuous-surface of a membrane that is attached to the rigid portion of the substrate carrier. Multiple pneumatic air-pressure chambers that exist between the substrate mounting surface of the membrane and the rigid portion of the substrate carrier are an integral part of the carrier membrane.

Each of the five annular pneumatic chambers shown here can be individually pressurized to provide different abrading pressures to different annular portions of the wafer substrate. These different localized abrading pressures are provided to compensate for the non-uniform abrading action that occurs with this wafer polishing system.

The flexible semiconductor wafer is extremely flat on both opposed surfaces. Attachment of the wafer to the carrier membrane is accomplished by pushing the very flexible membrane against the flat backside surface of a water-wetted wafer to drive out all of the air and excess water that exists between the wafer and the membrane. The absence of an air film in this wafer-surface contact are provides an effective suction-attachment of the wafer to the carrier membrane surface. Sometimes localized "vacuum pockets" are used to enhance the attachment of the wafer to the flexible flat-surfaced membrane.

Each of the five annular pressure chambers expand vertically when pressurized. The bottom surfaces of each of these chambers move independently from their adjacent annular chambers. By having different pressures in each annular ring-chamber, the individual chamber bottom surfaces are not in a common plane if the wafer is not held in flat-surfaced abrading contact with a rigid abrasive surface. If the abrasive surface is rigid, then the bottom surfaces of all of the five annular rings will be in a common plane. However, when the abrasive surface is supported by a resilient pad, each individual pressure chamber will distort the abraded wafer where the full wafer surface is not in a common plane. Resilient support pads are used both for CMP pad polishing and for fixed-abrasive web polishing.

Because of the basic design of the flexible membrane wafer carrier head that has five annular zones, each annular abrading pressure-controlled zone provides an "average" pressure for that annular segment. This constant or average pressure that exist across the radial width of that annular pressure chamber does not accurately compensate for the non-linear wear rate that actually occurs across the radial width of that annular band area of the wafer surface.

Overall, this flexible membrane wafer substrate carrier head is relatively effective for CMP pad polishing of wafers. Use of it with resilient CMP pads require that the whole system be operated at very low speeds, typically at 30 rpm. However, the use of this carrier head also causes many problems results in non-uniform material removal across the full surface of a wafer.

Figure 15:
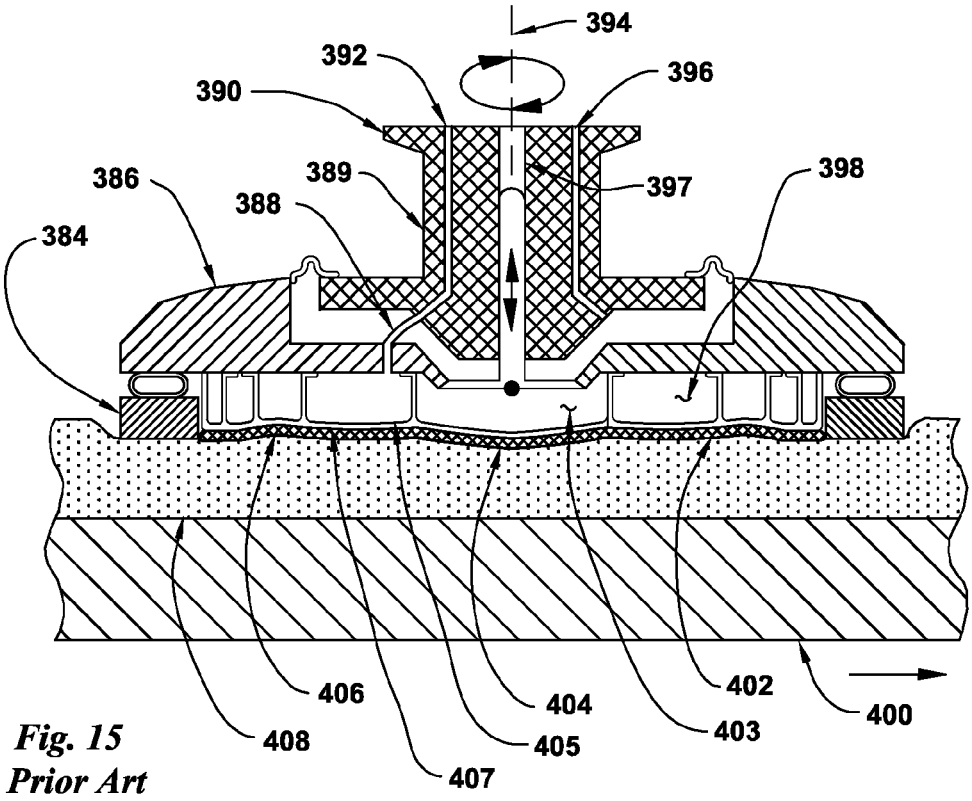
Fig. 15 Prior Art
FIG. 15 is a cross section view of a prior art bladder wafer carrier with a distorted bottom.

FIG. 15 is a cross section view of a prior art pneumatic bladder type of wafer carrier with a distorted bottom surface. A rotatable wafer carrier head 389 having a wafer carrier hub 390 is attached to the rotatable head (not shown) of a wafer polishing machine tool (not shown) where the carrier hub 390 is loosely attached with flexible joint devices and a rigid slide-pin to a rigid carrier plate 386. The cylindrical rigid slide-pin can move along a cylindrical hole 397 in the carrier hub 390 which allows the rigid carrier plate 386 to move axially along the hole 397 where the movement of the carrier plate 386 is relative to the carrier hub 390. The rigid slide-pin is attached to a flexible diaphragm that is attached to carrier plate 386 which allows the carrier plate 386 to be spherically rotated about a rotation point relative to the rotatable carrier hub 390 that is remains aligned with its rotational axis 394.

A sealed flexible elastomeric diaphragm device 405 having a nominally-flat but flexible wafer 402 mounting surface 407 has a number of individual annular sealed pressure chambers 398 and a circular center chamber 403 where the air pressure can be independently adjusted for each of the individual chambers 398, 403 to provide different abrading pressures to a wafer workpiece 402 that is attached to the wafer mounting surface 407 of the elastomeric diaphragm 405. A wafer 402 carrier annular back-up ring 384 provides containment of the wafer 402 within the rotating but stationary-positioned wafer carrier head 389 as the wafer 402 abraded surface 406 is subjected to abrasion-friction forces by the moving abrasive coated platen (not shown). An air-pressure annular bladder applies controlled contact pressure of the wafer 402 carrier annular back-up ring 384 with the platen abrasive coating surface. Controlled-pressure air is supplied from air inlet passageways 392 and 396 in the carrier hub 390 to each of the multiple flexible pressure chambers 398, 403 by flexible tubes 388.

When air, or other fluids such as water, pressures are applied to the individual sealed pressure chambers 398, 403, the flexible bottom wafer mounting surface 407 of the elastomeric diaphragm 405 is deflected different amounts in the individual annular or circular bottom areas of the sealed pressure chambers 398, 403 where the nominally-flat but flexible wafer 402 is distorted into a non-flat condition as shown by 404 as the wafer 402 is pushed downward into the flexible and resilient CMP pad 408 which is supported by a rigid rotatable platen 400.

When the multi-zone wafer carrier is used to polish wafer surfaces with a resilient CMP abrasive slurry saturated polishing pad, the individual annular rings push different annular portions of the wafer into the resilient pad. Each of the wafer carrier air-pressure chambers exerts a different pressure on the wafer to provide uniform material removal across the full surface of the wafer. Typically the circular center of the wafer carrier flexible diaphragm has the highest pressure. This high-pressure center-area distorts the whole thickness of the wafer as it is forced deeper into the resilient CMP wafer pad. Adjacent annular pressure zones independently distort other portions of the wafer.

Here, the wafer body is substantially distorted out-of-plane by the independent annual pressure chambers. However, the elastomer membrane that is used to attach the wafer to the rotating wafer carrier is flexible enough to allow the individual pressure chambers to flex the wafer while still maintaining the attachment of the wafer to the membrane. As the wafer body is distorted, the distorted and moving resilient CMP pad is thick enough to allow this out-of-plane distortion to take place while providing polishing action on the wafer surface.

When a wafer carrier pressure chamber is expanded downward, the chamber flexible wall pushes a portion of the wafer down into the depths of the resilient CMP pad. The resilient CMP pad is compressible and acts as an equivalent series of compression springs. The more that a spring is compressed, the higher the resultant force is. The compression of a spring is defined as $F=KX$ where F is the spring force, K is the spring constant and X is the distance that the end of the spring is deflected.

The CMP resilient pads have a stiffness that resists wafers being forced into the depths of the pads. Each pad has a spring constant that is typically linear. In order to develop a higher abrading pressure at a localized region of the flat surface of a wafer, it is necessary to move that portion of the wafer down into the depth of the compressible CMP pad. The more that the wafer is moved downward to compresses the pad, the higher the resultant abrading force in that localized area of the wafer. If the spring-like pad is not compressed, the required wafer abrading forces are not developed.

Due to non-uniform localized abrading speeds on the wafer surface, and other causes such as distorted resilient pads, it is necessary to compress the CMP pad different amounts at different radial areas of the wafer. However, the multi-zone pressure chamber wafer carrier head has abrupt chamber-bottom membrane deflection discontinuities at the annular joints that exist between adjacent chambers having different chamber pressures. Undesirable wafer abrading pressure discontinuities exist at these membrane deflection discontinuity annular ring-like areas.

Often, wafers that are polished using the pneumatic wafer carrier heads are bowed. These bowed wafers can be attached to the flexible elastomeric membranes of the carrier heads. However, in a free-state, these bowed wafers will be first attached to the center-portion of the carrier head. Here, the outer periphery of the bowed wafer contacts the CMP pad surface before the wafer center does. Pressing the wafer into forced contact with the CMP pad allows more of the wafer surface to be in abrading contact with the pad. Using higher fluid pressures in the circular center of the carrier head chamber forces this center portion of the bowed wafer into the pad to allow uniform abrading and material removal across this center portion of the surface of the wafer. There is no defined planar reference surface for abrading the surface of the wafer.

Figure 16:
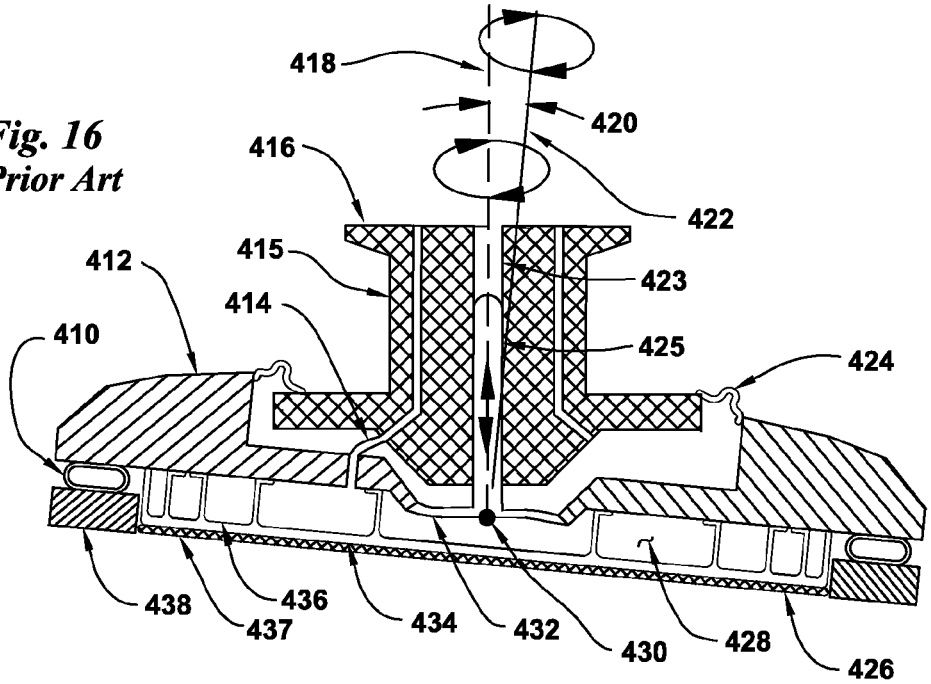
Fig. 16 Prior Art
FIG. 16 is a cross section view of a prior art bladder type of wafer carrier with a tilted wafer.

FIG. 16 is a cross section view of a prior art pneumatic bladder type of wafer carrier head with a tilted wafer carrier. The pneumatic-chamber carrier head is made up of two internal parts to allow "spherical-action" motion of the floating annular plate type of substrate carrier that is supported by a rotating carrier hub. The floating substrate carrier plate is attached to the rotating drive hub by a flexible elastomeric or a flexible metal diaphragm at the top portion of the hub. This upper elastomeric diaphragm allows approximate-spherical motion of the substrate carrier to provide flat-surfaced contact of the wafer substrate with the "flat" but indented resilient CMP pad. The CM pad is saturated with a liquid abrasive slurry mixture.

To keep the substrate nominally centered with the rotating carrier drive hub, a stiff (or flexible) post is attached to a flexible annular portion of the rigid substrate carrier structure. This circular centering-post fits in a cylindrical sliding-bearing receptacle-tube that is attached to the rotatable hub along the hub rotation axis. When misalignment of the polishing tool (machine) components occurs or large lateral friction abrading forces tilt the carrier head, the flexible centering post tends to slide vertically along the length of the carrier head rotation axis. This post-sliding action and out-of-plane distortion of the annular diaphragm that is attached to the base of the centering posts together provide the required "spherical-action" motion of the rigid carrier plate. In this way, the surface of the wafer substrate is held in flat-surfaced contact with the nominal-flatness of the CMP pad as the carrier head rotates.

Here, the "spherical action" motion of the substrate carrier depends upon the localized distortion of the structural member of the carrier head. This includes diaphragm-bending of the flexible annular base portion of the rigid substrate carrier which the center-post shaft is attached to. All of these carrier head components are continuously flexed upon each rotation of the carrier head which often requires that the wafer substrate carrier head is typically operated at very slow operating speeds of only 30 rpm.

A rotatable wafer carrier head 415 having a wafer carrier hub 416 is attached to the rotatable head (not shown) of a polishing machine tool (not shown) where the carrier hub 416 is loosely attached with flexible joint device 424 and a rigid slide-pin 425 to a rigid carrier plate 412. The cylindrical rigid slide-pin 425 can move along a cylindrical hole 423 in the carrier hub 416 which allows the rigid carrier plate 412 to move axially along the hole 423 where the movement of the carrier plate 412 is relative to the carrier hub 416. The rigid slide-pin 425 is attached to a flexible diaphragm 432 that is attached to the carrier plate 412 which allows the carrier plate 412 to be spherically rotated about a rotation point 430 relative to the rotatable carrier hub 416 that is remains aligned with its rotational axis 346.

The carrier plate 412 is shown spherically rotated about a rotation point 430 relative to the rotatable carrier hub 416 where the slide-pin axis 418 is at a tilt-angle 420 with an axis 422 that is perpendicular with the wafer 426 abraded surface 434 and where the carrier plate 412 and the wafer 426 are shown here to rotate about the axis 422. The flexible diaphragm 432 that is attached to the carrier plate 412 is distorted when the carrier plate 412 is spherically rotated about a rotation point 430 relative to the rotatable carrier hub 416.

A sealed flexible elastomeric diaphragm device 436 has a number of individual annular sealed pressure chambers 428 and a circular center chamber where the air pressure can be independently adjusted for each of the individual chambers 428 to provide different abrading pressures to a wafer workpiece 426 that is attached to the wafer mounting surface 437 of the elastomeric diaphragm 436. A wafer 426 carrier annular back-up ring 438 provides containment of the wafer 426 within the rotating but stationary-positioned wafer carrier head 415 as the wafer 426 abraded surface 434 is subjected to abrasion-friction forces by the moving abrasive coated platen (not shown). An air-pressure annular bladder 410 applies controlled contact pressure of the wafer 426 carrier annular back-up ring 438 with the platen abrasive coating surface. Controlled-pressure air is supplied from air inlet passageways in the carrier hub 416 to each of the multiple flexible pressure chambers 428 by flexible tubes 414.

The pneumatic abrading pressures that are applied during CMP polishing procedures range from 1 to 8 psi. The downward pressures that are applied by the wafer retaining ring to push-down the resilient CMP pad prior to it contacting the leading edge of the wafer are often much higher than the nominal abrading forces applied to the wafer. For a 300 mm (12 inch) diameter semiconductor wafer substrate, that has a surface area of 113 sq. inches, an abrading force of 4 psi is often applied for polishing with a resilient CMP pad. The resultant downward abrading force on the wafer substrate is 4×113=452 lbs. An abrading force of 2 psi results in a downward force of 226 lbs.

The coefficient of friction between a resilient pad and a wafer substrate can vary between 0.5 and 2.0. Here, the wafer is plunged into the depths of the resilient CMP pad. A lateral force is applied to the wafer substrate along the wafer flat surface that is a multiple of the coefficient of friction and the applied downward abrading force. If the downward force is 452 lbs and the coefficient of friction is 0.5, then the lateral force is 226 lbs. If the downward force is 452 lbs and the coefficient of friction is 2.0, then the lateral force is 904 lbs. If a 2 psi downward force is 226 lbs and the coefficient of friction is 2.0, then the lateral force is 452 lbs.

When this lateral force of 226 to 904 lbs is applied to the wafer, it tends to drive the wafer against the rigid outer wafer retaining ring of the wafer carrier head. Great care is taken not to damage or chip the fragile, very thin and expensive semiconductor wafer due to this wafer-edge contact. This wafer edge-contact position changes continually along the periphery of the wafer during every revolution of the carrier head. Also, the overall structure of the carrier head is subjected to this same lateral force that can range from 226 to 904 lbs.

All the head internal components tend to tilt and distort when the head is subjected to the very large friction forces caused by forced-contact with the moving abrasive surface. The plastic components that the pneumatic head is constructed from have a stiffness that is a very small fraction of the stiffness of same-sized metal components. This is especially the case for the very flexible elastomeric diaphragm materials that are used to attach the wafers to the carrier head. These plastic and elastomeric components tend to bend and distort substantial amounts when they are subjected to these large lateral abrading friction forces.

The equivalent-vacuum attachment of a water-wetted wafer, plus the coefficient-of-friction surface characteristics of the elastomer membrane, are sufficient to successfully maintain the attachment of the wafer to the membrane even when the wafer is subjected to the large lateral friction-caused abrading forces. However, to maintain the attachment of the wafer to the membrane, it is necessary that the flexible elastomer membrane is distorted laterally by the friction forces to where the outer periphery edge of the wafer is shifted laterally to contact the wall of the rigid wafer substrate retainer ring. Because the thin wafer is constructed form a very rigid silicon material, it is very stiff in a direction along the flat surface of the wafer.

The rigid wafer outer periphery edge is continually pushed against the substrate retainer ring to resist the very large lateral abrading forces. This allows the wafer to remain attached to the flexible elastomer diaphragm flat surface because the very weak diaphragm flat surface is also pushed laterally by the abrading friction forces. Most of the lateral abrading friction forces are resisted by the body of the wafer and a small amount is resisted by the elastomer bladder-type diaphragm. Contact of the wafer edge with the retainer ring continually moves along the wafer periphery upon each revolution of the wafer carrier head.

Figure 17:
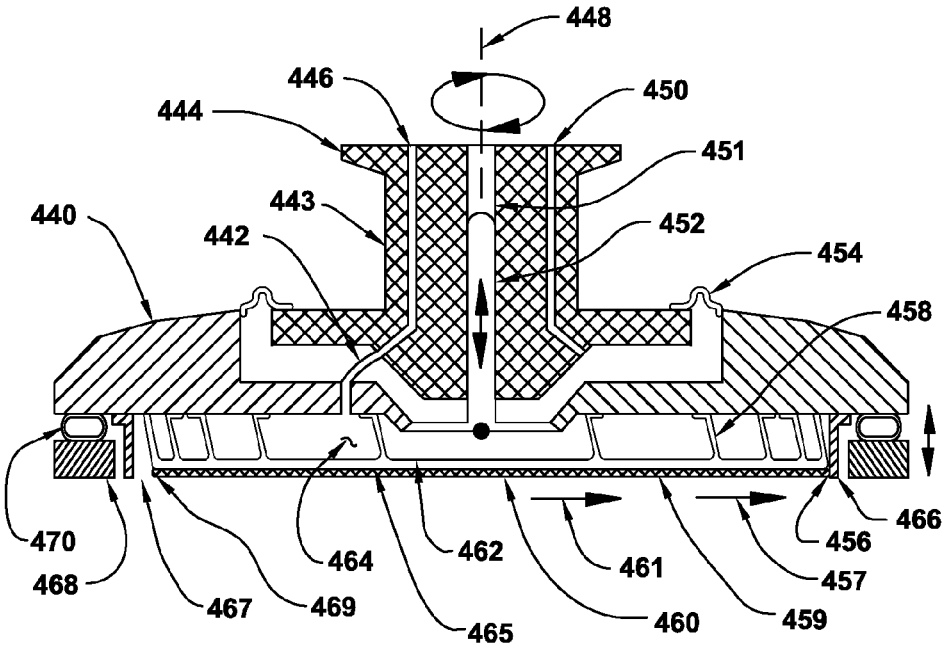
Fig. 17 Prior Art
FIG. 17 is a cross section view of a prior art bladder wafer carrier with a distorted bladder.

FIG. 17 is a cross section view of a conventional prior art pneumatic bladder type of wafer carrier where the bladder is distorted laterally by abrading friction forces. A rotatable wafer carrier head 443 having a wafer carrier hub 444 is attached to the rotatable head (not shown) of a polishing machine tool (not shown) where the carrier hub 444 is loosely attached with flexible joint device 454 and a rigid slide-pin 452 to a rigid carrier plate 440. The cylindrical rigid slide-pin 452 can move along a cylindrical hole in the carrier hub 444 which allows the rigid carrier plate 440 to move axially along the hole axis 448 which is also the rotational axis 448 of the carrier head 443 where the movement of the carrier plate 440 is relative to the carrier hub 444. The rigid slide-pin 452 is attached to a flexible diaphragm that is attached to carrier plate 440 which allows the carrier plate 440 to be spherically rotated about a rotation point relative to the rotatable carrier hub 444 that is remains aligned with its rotational axis 448.

A sealed flexible elastomeric diaphragm device 462 has a number of individual annular sealed pressure chambers 464 and a circular center chamber where the air pressure can be independently adjusted for each of the individual chambers 464 to provide different abrading pressures to a wafer workpiece 460 that is attached to the wafer mounting surface 465 of the elastomeric diaphragm 462. A wafer 460 carrier annular back-up ring 468 provides containment of the wafer 460 within the rotating but stationary-positioned wafer carrier head 443 as the wafer 460 abraded surface 459 is subjected to abrasion-friction forces 461 by the moving abrasive coated platen (not shown). An air-pressure annular bladder 470 applies controlled contact pressure of the wafer 460 carrier annular back-up ring 468 with the platen abrasive coating surface. Controlled-pressure air is supplied from air inlet passageways 446 and 450 in the carrier hub 444 to each of the multiple flexible pressure chambers 464 by flexible tubes 442.

The abrading friction forces 461 act on the wafer 460 abraded surface 459 in a direction 457 that the platen abrasive coating moves where the forces 461 act on the sealed flexible elastomeric diaphragm device 462 which translates the wafer mounting surface 465 of the elastomeric diaphragm 462 and the wafer 460 where the peripheral edge 469 of the wafer 460 is forced at a location 456 against the rigid wafer retaining ring 466 that is attached to the carrier plate 440. The flexible elastomeric chamber walls 458 of the sealed flexible elastomeric diaphragm device 462 are distorted from their non-force stressed original shapes that exist when the abrading forces 461 are not present. When the wafer 460 is moved into contact with the rigid wafer retaining ring 466 at a location 456, a corresponding gap 467 exists between the peripheral edge 456 of the wafer 460 and the rigid wafer retaining ring 466 in a location that is diagonally across the abraded surface 459 from the location 456 where the wafer 460 is in forced contact with the rigid wafer retaining ring 466. The forced contact of the wafer 460 moves along the peripheral edge 456 of the wafer 460 as the wafer 460 and the wafer carrier head 443 is rotated while the wafer 460 is in abrading contact with the rotating platen abrasive coating.

Semiconductor wafers that are fabricated are intentionally made quite thick during the deposition process to allow handling during CMP polishing procedures and for the sequential surface deposition steps. Often, 40 or 50 deposition layers are made to a wafer during the wafer fabrication process. Each deposition layer thickness can be a few angstroms thick but after 4 or 5 deposition steps it is necessary to polish the surface of the wafer to remove excess deposition materials and to re-establish the global flatness of the wafer surface. Use of the resilient CMP pads to perform this wafer polishing procedure is the most common method of polishing used. After all of the deposition and polishing steps have been completed, the wafer is backside-ground to reduce the overall thickness of the wafer and the individual semiconductor devices.

When a flat-surfaced vacuum-chuck workholder having an attached wafer is pressed down into the surface-depths of a resilient CMP pad, the pad surface is distorted in the area that is directly adjacent to the outer periphery of the wafer. Here, the moving resilient pad is compressed as it is held in abrading contact with the flat surfaced wafer. The compressed CMP pad assumes a flat profile where it contacts the central portion of the circular wafer. However, the localized portion of the moving resilient CMP pad that comes into contact with the outer periphery of the rotating wafer becomes distorted. This CMP pad distortion tends to produce undesirable above-average material removal at the wafer periphery. This uneven abrading action results in non-flat wafers.

Large diameter 300 mm (12 inch) wafers being polished typically have a thickness of 0.030 inches to provide enough strength and stiffness for handling in the semiconductor fabrication process. These wafers are repetitively subjected to polishing to remove excess metal and insulating materials that are deposited on the surfaces to form the semiconductor circuits. Because the silicon wafers are brittle, and the force-contact area continually moves around the circumference of the wafer as the wafer carrier head is rotated, the wafer edge tends to be chipped or cracked by the contact of the rigid wafer with the rigid or semi-rigid wafer retainer ring.

When the multi-chamber flexible substrate-mounting elastomer material membrane is subjected to the very large 200 to 400 lb lateral abrading forces, the whole flexible membrane tends to move laterally along the direction of the applied abrading forces. These abrading forces originate from the rotating CMP pad so they are always in the same direction relative to the rotating wafer and carrier head. These abrading forces tend to drive the whole flexible membrane to the "far" downstream side of the carrier head, away from the leading edge of the carrier head that faces upstream relative to the moving CMP pad.

However, as the pneumatic carrier head rotates, these applied lateral abrading forces contact a "new" portion of the wafer flexible membrane. Here, the membrane experiences a continuing radial excursion that occurs during each revolution of the carrier head. Localized distortions of portions of the substrate membrane occur particularly at the areas of the circular wafer substrate that is nominally restrained by the carrier rigid wafer retaining ring that is attached to the carrier head and surrounds the wafer substrate membrane.

Because the carrier head presses the wafer down into the surface-depths of the rotating resilient CMP pad, the moving pad tends to distort and crumple at the leading edge of the wafer. This pad distortion tends to cause extra-wear of the wafer at the outer periphery of the wafer flat surface. To compensate for this ripple-effect of the crumpled and moving pad, an independent rigid annular carrier ring is attached at the carrier head to locally press down the indented CMP pad just before it contacts the wafer periphery. Here, the localized pad-compression caused by the outer carrier ring is typically 1 psi greater than the abrading pressure that is applied to the wafer substrate. Typically the abrading pressure that is applied across the surface of the wafer is about 2 psi and sometimes ranges up to 8 psi. The applied pressure of the pad compression ring is 1, or even much more, psi greater than that of the typical nominal wafer surface abrading pressure.

Figure 18:
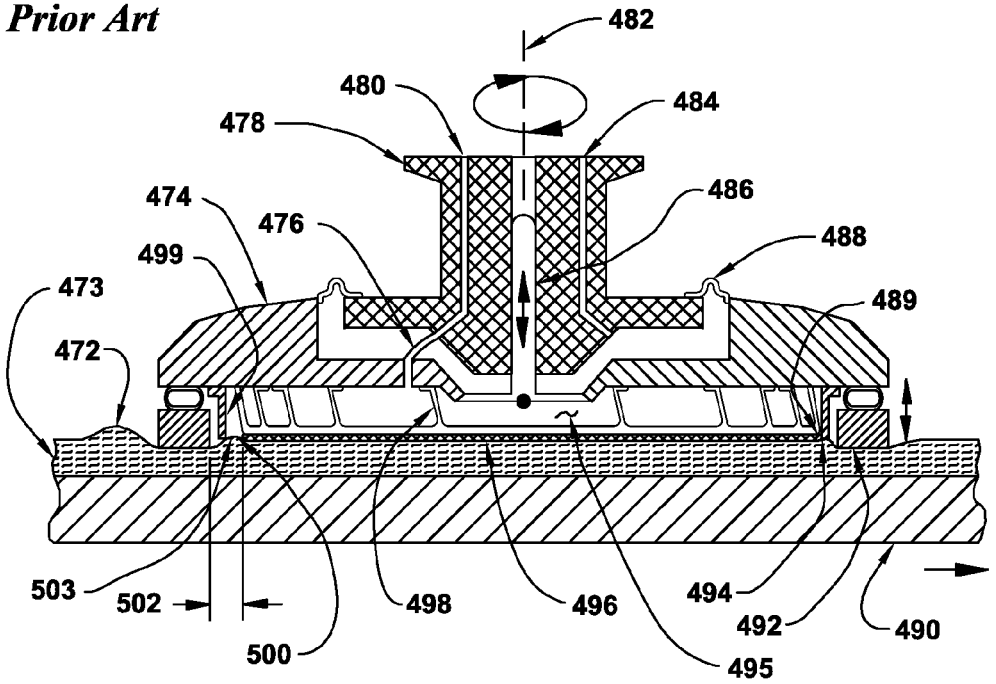
Fig. 18 Prior Art
FIG. 18 is a cross section view of a prior art carrier distorted by abrading friction forces.

FIG. 18 is a cross section view of a conventional prior art pneumatic bladder type of wafer carrier where the bladder is distorted laterally by abrading friction forces that are imposed by a moving CMP abrasive pad. A rotatable wafer carrier head 443 having a wafer carrier hub 478 is attached to the rotatable head (not shown) of a polishing machine tool (not shown) where the carrier hub 478 is loosely attached with flexible joint device 488 and a rigid slide-pin 486 to a rigid carrier plate 474. The cylindrical rigid slide-pin 486 can move along a cylindrical hole in the carrier hub 478 which allows the rigid carrier plate 474 to move axially along the hole axis 482 which is also the rotational axis 482 of the carrier head 443 where the movement of the carrier plate 474 is relative to the carrier hub 478. The rigid slide-pin 486 is attached to a flexible diaphragm that is attached to carrier plate 474 which allows the carrier plate 474 to be spherically rotated about a rotation point relative to the rotatable carrier hub 478 that is remains aligned with its rotational axis 482.

A sealed flexible elastomeric diaphragm device has a number of individual annular sealed pressure chambers 495 and a circular center chamber where the air pressure can be independently adjusted for each of the individual chambers 495 to provide different abrading pressures to a wafer workpiece 496 that is attached to the wafer mounting surface of the elastomeric diaphragm. A wafer 496 carrier annular back-up ring 492 provides containment of the wafer 496 within the rotating but stationary-positioned wafer carrier head as the wafer 496 abraded surface 459 is subjected to abrasion-friction forces by the moving abrasive coated platen 490. An air-pressure annular bladder applies controlled contact pressure of the wafer 496 carrier annular back-up ring 492 with the platen 490 abrasive CMP pad 473 surface where the CMP pad 473 is attached to the platen 490 surface. Controlled-pressure air is supplied from air inlet passageways 480 and 484 in the carrier hub 478 to each of the multiple flexible pressure chambers 495 by flexible tubes 476.

The abrading friction forces act on the wafer 496 abraded surface in a direction that the platen 490 abrasive CMP pad 473 moves where the forces act on the sealed flexible elastomeric diaphragm device which translates the wafer mounting surface of the elastomeric diaphragm and the wafer 496 where the peripheral edge 489 of the wafer 496 is forced at a location 494 against the rigid wafer retaining ring 499 that is attached to the carrier plate 474. The flexible elastomeric chamber walls 498 of the sealed flexible elastomeric diaphragm device are distorted from their non-force stressed original shapes that exist when the abrading forces are not present.

When the wafer 496 is moved into contact with the rigid wafer retaining ring 499 at a location 494, a corresponding gap 467 exists between the peripheral edge 494 of the wafer 496 and the rigid wafer retaining ring 499 in a location that is diagonally across the abraded surface from the location 494 where the wafer 496 is in forced contact with the rigid wafer retaining ring 499. The forced contact of the wafer 496 moves along the peripheral edge 494 of the wafer 496 as the wafer 496 and the wafer carrier head 443 is rotated while the wafer 496 is in abrading contact with the rotating platen abrasive CMP pad 473. There is a gap distance 502 between the wafer 496 peripheral edge 489 and the wafer 496 carrier annular back-up ring 492 at the location that is diagonally across the abraded surface from the location 494 where the wafer 496 is in forced contact with the rigid wafer retaining ring 499 where the CMP pad 473 has a top surface distortion 503 in the gap distance 502 due to the wafer 496 being forced into the surface depths of the CMP pad 473. Another CMP pad surface distortion 472 exists upstream of the wafer 496 carrier annular back-up ring 492 as the moving CMP pad 473 is forced against the wafer 496 carrier annular back-up ring 492.

The effect of the pneumatic carrier head CMP pad compression ring is helpful but over-wear still occurs at the outer periphery of the wafer. To compensate for this, two separate, but closely adjacent, annular pressure chambers are made a part of the flexible substrate membrane. The localized pressure in each of these chamber zones is controlled independently to correct for the uneven abrading wear there caused by the distorted resilient CMP pad.

The resilient CMP pad has significant surface distortions at the leading edge of the wafer where the moving pad contacts the wafer. Lateral abrading friction surface forces push the wafer and the carrier head flexible wafer-attachment membrane away form the wafer retaining ring at this wafer leading edge location. The movement of the wafer away from the wafer retaining ring at this location produces a gap between the wafer leading edge and the retaining ring. The surface of the compressed resilient CMP pad tends to distort in this gap which creates extra-high abrading pressures at the leading edge of the wafer. These high abrading pressures at the outer periphery of the wafer tends to produce over-wear of the wafer in this annular peripheral region. Almost all wafers that are polished with the resilient CMP abrasive slurry pads have non-flat outer periphery bands that are highly undesirable, due to this pad distortion effect.

The wafer carrier heads have rigid wafer carrier plate that has a spherical center of rotation that is offset a distance from the abraded surface of the wafer. When the wafer is polished, the large abrading lateral friction force acts along the abraded surface of the wafer. This friction force can range from 200 to 900 lbs. Because the friction force is applied at an offset pivot distance from the spherical center of rotation, this friction force tends to tilt the wafer as it is being polished. Tilting the wafer as it is being abraded can cause the wafer to have an undesirable non-flat surface.

This same "spherical-action" motion of the rigid carrier head plate occurs when this wafer carrier head is used to CMP polish wafers that contact the flat abrasive surface of a fixed-abrasive raised-island web that is supported by a flat-surfaced rotation platen. Because the centering post is used to transmit the large lateral friction force to the carrier drive hub (the flexible elastomer top diaphragms are very weak), the centering post must be large enough and stiff enough to transmit these large lateral abrading friction forces. Also, it is necessary for the centering post to slide along the axis of the carrier drive hub to allow the substrate carrier to move vertically to provide translation for making and separating abrading contact of the substrate with the CMP pad.

Air or water pressure can be applied to different parts of a pneumatic wafer carrier head. The overall "global" total abrading force on a wafer can be controlled by applying fluid pressure to the rigid carrier plate. This carrier plate supports the flexible wafer attachment membrane. Then regional annular chambers of the flexible wafer membrane can be independently pressurized to apply different abrading pressures to different radial portions of the wafer. These independent pneumatic chambers expand and contract in reaction to the air pressure applied to each one. Each of the annular abrading pressure-controlled zones provides an "average" pressure for that annular segment to compensate for the non-linear wear rate that occurs in the annular band area of the wafer surface.

The very inner circular portion of the wafer typically experiences a very low abrading wear rate. This occurs often because of the localized very slow abrading speed that exists at the center portion of a rotating wafer. To compensate for the slow abrading rate at the center of the wafer, a circular pressurized chamber in the wafer substrate membrane is used to apply an extra-high abrading force at the center of the wafer. This higher pressure compensates for the low abrading speed with the result that uniform material removal is provided at the center of the wafer.

Separation of a wafer from the flexible membrane after the wafer polishing has been completed can be difficult because of the adhesion of the water-wetted wafer to the flexible membrane. To help wafer separation, special low friction coatings can be applied to the membrane flat surface to diminish the wafer-adhesion effect of the smooth-surfaced membrane elastomer material. Expansion of individual annular pressure chambers is often used to distort localized portions of the bottom flat surface of the wafer membrane enough that the rigid flat-surfaced wafer is separated from the membrane.

When higher localized abrading pressures are applied at the center of the wafer to equalize wafer-surface material removal, this increased pressure tends to cause overheating of the center portion of a wafer. Higher abrading pressures cause more abrading-friction heating of that portion of the wafer. This over-heating of the wafer center also raises the temperature of the annular portion of the rotating CMP pad that contacts the high-temperature center portion of the wafer. Thermal scans of the rotating CMP pad that is being subjected to abrading with this type of wafer carrier head shows a distinct annular band of the pad having high temperature which correspond to the location of the rotating wafer as it is held in abrading contact with the rotating pad.

Heat transfer across the full surface of the pad is quite ineffective in reducing the temperature differential across the radial width of the rotating pad. Due to the characteristics of the pad system, the porous foam resilient pad is relatively thick and acts as an insulator. This prevents heat generated on the pad exposed surface from being transferred to the rotary rigid metal platen that the pad is mounted on.

Also, very small quantities of fresh, new, and cool, liquid abrasive slurry mixture are applied to the rotating pad surface. This added slurry liquid does little to cool the pad hot-spot annular areas because the cool slurry is applied uniformly across the radial width of the pad as it rotates. Here, the hot annular band on the pad remains at a higher temperature than adjacent annular areas of the pad that are subjected to lower abrading pressures by the annular-segmented wafer carrier head. These low-pressure annular areas of the pad experience less abrading friction where less friction heat is generated and these annular areas of the pad run cooler than the high abrading pressure areas of the pad.

To reach equilibrium material removal conditions for wafer polishing due to annular temperature gradients across the radial width of the pad, it is often necessary to process up to 100 wafers to reach this equilibrium. The pressure settings for the individual annular zones are different at the start-up of a wafer polishing tool (machine) operation after the polishing tool has been at rest for some time. After many wafers are continually processed in sequence, thermal equilibrium of the pad (and wafer) is reached and the zoned pressure settings are stabilized.

These pneumatic wafer carrier heads are also used with a fixed-abrasive web that is stretched across the flat surface of a rotating platen. Both the carrier head and the abrasive web are typically rotated at the same speeds.

Because of the extreme difficulty of providing and maintaining precision alignment substrate carrier wafer mounting surface and a flat-surfaced abrading surface, resilient support pads are used for both fixed-abrasive web systems and the CMP pad loose-abrasive polishing systems. In the case of the CMP pad, the resilient pad provides global support across the full surface of the wafer. The resilient CMP pad also provides localized support of the abrasive media to compensate for out-of-plane defects on the wafer surface and for out-of-plane defects of the CMP pad itself.

In the case of the fixed-abrasive island-type web, a resilient pad is positioned between a non-precision flat (more than 0.0001 inches) semi-rigid but yet flexible plastic (polycarbonate) web support plate and the flat surface of a rigid rotatable platen. This semi-rigid 0.030 inch thick polycarbonate web-support plate does not provide localized support of the abrasive web to compensate for out-of-plane defects on the wafer surface and for out-of-plane surface defects of the polycarbonate support plate itself. However, the resilient CMP pad does provide global support across the full surface of the wafer.

The pneumatic wafer carrier heads also cause significant localized distortion of the fixed-abrasive webs as the rotating carrier head traverses across the surface of the web. The resilient pad that supports the polycarbonate web-support plate is very flexible and subject to localized distortion by the very large abrading forces applied by the carrier head.

Also, the polycarbonate support plate does not have the capability to be maintained in a precision-flat condition over a long period of time. As a plastic material, the thin polycarbonate plate will tend to assume localized distortions caused by deflections from high-force (100 to 300 lb) contact with rotating carrier head as the platen that supports the abrasive-web device rotates. As the carrier head "travels" across the surface of the polycarbonate plate, that localized portion of the plate is distorted as it is pressed down into the depths of the resilient CMP during each revolution of the abrasive-web support platen.

Further, the use of different annular zones of the carrier head can result in different localized distortions of the polycarbonate web-support plate. All plastic materials such as polycarbonate and a resilient foam CMP pad have a hysteresis damping-effect where it takes some time for a plastic material to recover it original shape after it has been distorted. This means that some recovery time is required for a plastic web-support plate to assume its original localized flatness after the carrier head has passed that location. The abrading speed of this abrasive-web system is highly limited, in part, by this dimensional hysteresis-recovery consideration.

The conventional pneumatic-chamber wafer carrier heads that are in widespread use have a number of disadvantages. These pneumatic-chamber wafer carrier head devices depend on the body of the silicon wafers to resist essentially all of the abrading friction forces that are applied to the flat abraded surface of the wafer by forcing the circular wafer peripheral edge into running contact with a circular rigid wafer retainer ring that surrounds the wafer.

By comparison, the wafer carrier heads described here prevent running contact of the wafer edge with a rigid body as the wafer is rotated. Instead, a circular wafer workpiece is attached and temporarily bonded to the flat surface of a circular rigid wafer carrier rotor disk. The outer periphery of the circular carrier rotor contacts a set of multiple stationary roller idlers as the carrier rotor and the attached wafer rotate during an abrading procedure. The abrading forces that are applied to the rotating wafer abraded surface are transmitted by the adhesive-type bond of the wafer to the wafer carrier rotor which transmits these abrading forces to the stationary roller idlers. The temporary bond of the wafer to the wafer carrier can be accomplished with the use of vacuum or a low-tack adhesive. There is no motion of the wafer substrate workpiece relative to the flat surface of the wafer carrier rotor during the abrading procedures as the wafer is structurally bonded to the wafer carrier rotor during the time of the abrading procedure. After the wafer surface abrading procedure is completed, the wafer is separated form the wafer carrier surface.

The flexible elastomer diaphragm wafer holder is designed to be weak or compliant with little stiffness in a lateral direction that is parallel to the wafer abraded surface. When the typical large abrading forces are applied to the wafer that is attached to the elastomer diaphragm, these friction forces distort the diaphragm by moving the lower portion of the diaphragm laterally. Here, the silicon semiconductor wafer that is very rigid in the direction parallel to the abraded surface of the wafer is used as the supporting member that minimizes the distortion of the elastomer wafer carrier diaphragm. However, most all of the lateral friction forces that are applied to the wafer are resisted when the circular rigid wafer peripheral edge contacts the rigid circular wafer retaining ring at a single point on the wafer peripheral edge.

The abrading friction forces are consistently aligned in the same direction relative to the abrading machine as they originate on the abraded surface of the rotary platen as it rotates. However, the wafer also rotates independently as this constant-direction friction force is imposed on it. Because the "stationary" fixed-position wafer rotates, the friction force is continually applied in a different direction relative to a specific location on the wafer. Rotation of the wafer results in the wafer peripheral edge being contacted at a single-point position that "moves" around the periphery of the wafer. This single-point contact moves around the full circumference of the wafer for each revolution of the wafer.

The wafer outside diameters are smaller than the inside diameters of the rigid wafer retaining rings to allow the wafers to be inserted into the retaining ring at the start of a wafer lapping or polishing procedure. Because the wafers are smaller than the retaining rings, there is a gap between the wafer outside periphery edge and the retaining ring at a position that is diagonally across the wafer abraded surface from the point where the wafer is driven against the retainer ring by the abrading friction force.

Rotation of the abraded wafer results in the wafer actively moving laterally where the rigid but fragile silicon wafer edge is driven to impact the rigid wafer retaining ring. This wafer impact action often results in chipping of the wafer edge. Also, this wafer impact action tends to produce uneven wear of the inside diameter of the rigid retainer ring. In order to sustain this wafer-edge impact action without wafer damage, the wafer thickness must be made sufficiently thick to provide sufficient strength and stiffness to resist the very large and changing abrading friction forces. Typically the wafers have a thickness of 0.030 inches (0.76 mm) to provide the required thickness of the wafer and to minimize chipping of the fragile wafer edge. After a wafer is fully processed to provide the semiconductor circuits, the wafers are typically back-side ground down to a wafer thickness of less than 0.005 inches (0.127 mm).

The lateral abrading friction forces for a 12 inch (300 mm) diameter wafer can easily exceed 500 lbs during a wafer polishing procedure. Most of this large friction force is resisted by the wafer edge that impacts the rigid wafer retainer ring.

The pneumatic elastomer diaphragm carrier head is typically operated very slowly at speeds of approximately 30 rpm. In order to provide sufficient abrading action wafer material removal rates, large abrading pressures are used. However, when high-speed lapping or polishing is done using raised-island abrasive disks on the wafer abrading system described here, the abrading speeds are high but the abrading pressures are very low. The low abrading pressure results in low abrading friction forces that are applied to the wafer abraded surfaces during a wafer lapping or polishing procedure. Lower abrading friction forces results in lesser wafer bonding forces that are required to maintain attachment of the wafers to the wafer carrier heads.

With the elastomeric diaphragm wafer carrier head, wafers do not have to attached with substantial bonding strength to the surface of the bottom flat surface of the elastomeric diaphragm because essentially all of the abrading friction forces are resisted by the rigid wafer peripheral edge being forced against the rigid wafer retainer ring. There is little requirement for these abrading forces to be transferred to the very flexible and compliant wafer carrier diaphragm. In the present wafer lapping or polishing system, the wafer must be attached or adhesively bonded to the rigid circular rotatable wafer attachment plate or wafer carrier rotor with substantial wafer bonding strength where the rotor is held in a fixed wafer-rotational position by running rolling contact of the rotating wafer with stationary roller idlers mounted on the stationary wafer carrier rotor housing.

Vacuum can be used very effectively to temporarily bond the wafers to the flat surfaces of the wafer rotor carriers with substantial wafer bonding strength. For example, a vacuum induced wafer hold-down attachment force typically exceeds 1,000 lbs when using only 10 psig of vacuum on a 12 inch (300 mm) wafer that has over 100 square inches of surface area. With the system here, the wafer must be structurally bonded to the wafer carrier rotor to prevent movement of the wafer relative to the surface of the wafer rotor when large abrading forces are imposed on the wafer abraded surface.

By comparison, wafers can be "casually attached" to an elastomer diaphragm type wafer carrier having a elastomeric flat wafer mounting surface simply by using water as a wafer bonding agent. All the abrading friction forces that are applied to the wafer are resisted by the rigid wafer itself as the wafer peripheral edge contacts the rigid wafer retaining ring. The elastomeric diaphragm is very flexible in the direction of the plane of the wafer abraded surface so little bonding force is required to keep the wafer successfully bonded to the surface of the flexible elastomeric diaphragm. Here, the elastomeric device distorts to allow the diaphragm bottom flat wafer-mounting surface to simply move along with the attached wafer toward the wafer retainer ring as the wafer rotates. The wafer water-adhesion of the wafer to the diaphragm bottom flat wafer-mounting surface only has to be strong enough to distort the flexible and weak elastomeric diaphragm device as the abrading friction continually moves the wafer into point contact with the wafer retaining ring.

When a rigid wafer rotor is used, the wafer attachment surface of the rotor is preferred to be flat within 0.0001 inches (2.5 microns) to assure that the uniform abrading of a wafer surface takes place when it is abraded by a rigid abrading surface.

Single or multiple individual workpieces such as small-sized wafers or other workpieces including lapped or polished optical devices or mechanical sealing devices can be adhesively attached to a flexible polymer or metal backing sheet. This flexible sheet backing can then be attached with substantial bonding force to the rotatable workpiece rotor with vacuum. These flexible adhesive backing sheets can be easily separated from the rotor after the lapping or polishing is completed by peeling-away the flexible attachment sheet from the individual workpieces.

There are a number of different embodiments of spherical-action rotary workholder devices that offer great simplicity and flexibility for lapping or polishing operations. They can also be used effectively to provide very substantial increases of production speeds as compared to conventional systems used for lapping, polishing and abrading operations. Substantial cost savings are experienced by using these air bearing carriers that allow these abrading processes to be successfully speeded-up.

Figure 1:
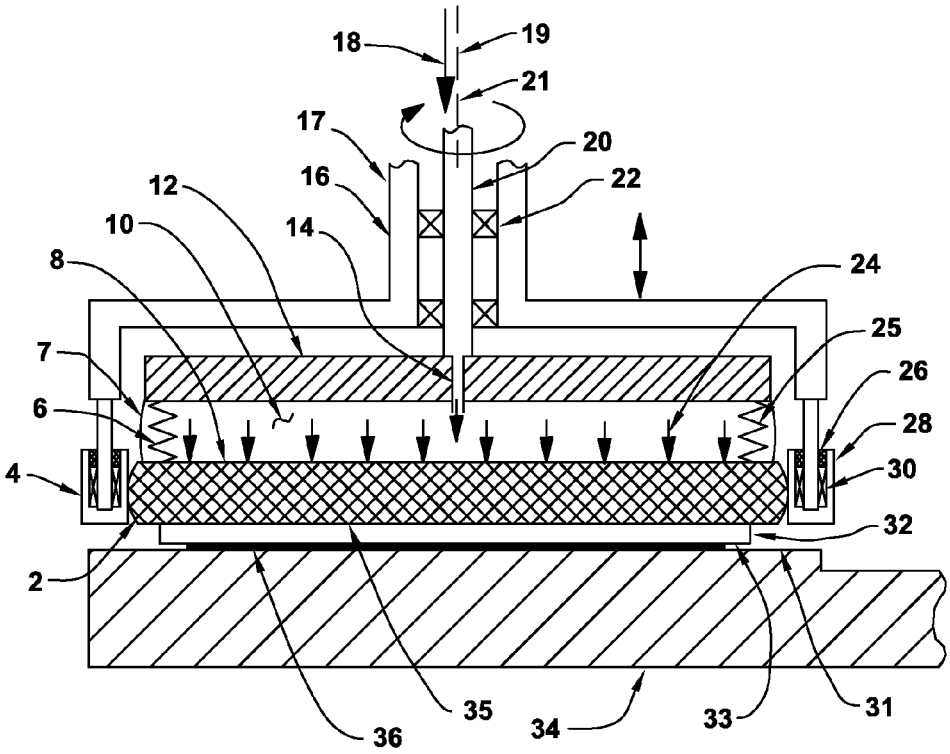
FIG. 1 is a cross section view of a bellows driven wafer polishing workpiece carrier.

FIG. 1 is a cross section view of a bellows driven floating workpiece carrier used for lapping or polishing semiconductor wafers or other workpiece substrates. A stationary workpiece carrier head 17 has a flat-surfaced workpiece 32 that is attached to a floating workpiece carrier rotor 35 that is rotationally driven by a flexible bellows device 6 that is attached to a drive plate 12. The nominally-horizontal drive plate 12 is attached to a hollow drive shaft 20 having a rotation axis 19 that is supported by bearings 22 that are supported by a stationary carrier housing 16 where the carrier housing 16 can be raised and lowered in a vertical direction. The flexible bellows device 6 that is attached to the drive plate 12 is also attached to the workpiece carrier rotor 35 that is rotationally driven by the flexible bellows device 6. The workpiece carrier rotor 35 has an outer periphery 2 that has a spherical shape which allows the workpiece carrier rotor 35 outer periphery 2 to remain in contact with stationary roller idlers 28 when the rotating carrier rotor 35 is tilted.

The workpiece carrier rotor 35 has a rotation axis 21 that is coincident with the hollow drive shaft 20 rotation axis 19 to avoid interference action of the workpiece carrier rotor 35 with the hollow drive shaft 20 when the hollow drive shaft 20 is rotated. The workpiece 32 carrier rotor 35 rotation axis 21 is positioned to be coincident with the hollow drive shaft 20 rotation axis 19 by the controlled location of the stationary roller idlers 28 that are mounted to the stationary workpiece carrier head 17. Rolling contact of the workpiece carrier rotor 35 outer periphery 2 with the set of stationary roller idlers 28 that are precisely located at prescribed positions assures that the workpiece carrier rotor 35 rotation axis 21 is coincident with the hollow drive shaft 20 rotation axis 19. The stationary roller idlers 28 are mounted at positions on the carrier housing 16 where the diameters of the stationary roller idlers 28 and the diameters of the respective workpiece carrier rotors 35 are considered in the design and fabrication of the workpiece carrier head 17 to provide that the workpiece carrier rotor 35 rotation axis 21 is precisely coincident with the hollow drive shaft 20 rotation axis 19.

If the workpiece carrier rotor 35 rotation axis 21 is positioned to be offset a distance from the hollow drive shaft 20 rotation axis 19 then the flexible bellows device 6 that is attached to both the workpiece carrier rotor 35 and to the drive plate 12 that is attached to the hollow drive shaft 20 will experience an undesirable lateral distortion in a horizontal direction.

Lateral horizontal distortion of the flexible bellows device 6 can produce interference action of the workpiece carrier rotor 35 with the hollow drive shaft 20 when the hollow drive shaft 20 is rotated. Interference action of the workpiece carrier rotor 35 with the hollow drive shaft 20 during rotation of the hollow drive shaft 20 can cause undesirable variations in the speed of rotation of the workpiece 32 that is in abrading contact with the abrasive 36 coating on the rotary platen 34. The variations in the speed of rotation of the workpiece 32 would be periodic with every revolution of the workpiece 32 and would tend to create uneven abrasion patterns on the abraded surface of an expensive workpiece such as a semiconductor wafer, especially when the workpiece 32 is rotated at the high rotational speeds used for high speed lapping or polishing of workpieces 32.

The roller idlers 28 can have a cylindrical peripheral surface 4 or other surface shapes including a "spherical" hourglass type shape and can have low-friction roller bearings 30 or air bearings 30 and roller idler 28 seals 26 shape and can have low-friction roller bearings 30 or air bearings 30 and roller idler 28 seals 26. The roller idler 28 seals 26 prevent contamination of the low-friction roller bearings 30 or air bearings 30 by abrading debris or coolant water or other fluids or materials that are used in the abrading procedures. The air bearings 30 can provide zero friction and can rotate at very high speeds when the workpiece carrier rotor 35 is rotated at speeds of 3,000 rpm or more that are typically used in high speed flat lapping. Because the diameters of the roller idlers 28 are typically much smaller than the diameters of the workpiece carrier rotors 35 the roller idlers 28 typically have rotational speeds that are much greater than the rotational speeds of the workpiece carrier rotors 35.

Pressurized air or another fluid such as water 18 is supplied through the hollow drive shaft 20 that has a fluid passage 14 that allows pressurized air or another fluid such as water 18 to fill the sealed chamber 10 that is formed by the sealed flexible bellows device 6 that has flexible annular-disk pleats 25. This controlled fluid 18 pressure is present in the sealed chamber 10 to provide uniform abrading pressure 24 across the full flat top surface 8 of the carrier rotor 35 where uniform abrading pressure 24 pressure is directly transferred to the workpiece 32 abraded surface 33 that is in abrading contact with the abrasive 36 coating on the rotary platen 34.

The bellows device 6 annular-disk pleats 25 that are joined together at their inside-diameter and outside-diameter peripheral edges allow the bellows device 6 to act as a spring device which can flex vertically with little friction and to have small deflection stiffness in a vertical direction but provides substantial stiffness in a horizontal direction. However, the horizontal-direction stiffness of the bellows device 6 annular-disk pleats 25 does allow a small amount of misalignment to occur between the rotation axis of the drive shaft 20 and the center of rotation of the workpiece carrier rotor 35. The bellows device 6 pleats 25 are very stiff torsionally due to their near-flat mutually edge-joined annular-disk pleat-section members that are nominally horizontal which allows the bellows device 6 to have substantial tensional stiffness for driving the rotation of the workpiece carrier rotor 35. These types of lightweight bellows devices 6 are often used as zero-backlash but flexible shaft drives for machine tool devices.

The workpiece carrier rotor 35 and the flat-surfaced workpiece 32 such as a semiconductor wafer is allowed to be tilted from a horizontal position when they are stationary or rotated by the flexing action provided by the bellows devices 6 that can be operated at very high rotational speeds. The bellows device 6 pleats 25 can be constructed from corrosion-resistant metals such as stainless steel or from polymers such as polyester.

When the flat-surfaced workpiece 32 and the workpiece carrier rotor 35 are subjected to abrading friction forces that are parallel to the abraded surface 33 of the workpieces 32, these abrading friction forces are resisted by the workpiece carrier rotor 35 as it contacts the multiple idlers 28 that are located around the outer periphery of the workpiece carrier rotor 35. The circular drive plate 12 has an outer periphery 2 spherical shape which allows the workpiece carrier rotor 35 outer periphery 2 to remain in contact with the cylindrical-surfaced roller idlers 28 when the rotating carrier rotor 35 is tilted where the stationary-position surfaced roller idlers 28 that are spaced around the outer periphery of the workpiece carrier rotor 35 act together as a centering device that controls the center of rotation of the workpiece carrier rotor 35 as it rotates.

The circular drive plate 12 outer periphery 2 spherical shape provides that the center of rotation of the workpiece carrier rotor 35 remains aligned with the rotational axis of drive shaft 20 when the workpiece carrier rotor 35 is tilted as it rotates. The workpiece carrier rotor 35 can be tilted due to numerous causes including: flat-surfaced workpiece 32 that have non-parallel opposed surfaces; misalignment of components of the stationary workpiece carrier head 17; misalignment of other components of the abrading machine (not shown); a platen 34 that has an abrading surface 31 that is not flat.

A flexible annular band 7 that is impervious to water, abrading fluids and abrading debris that is preferably constructed from a flexible elastomer or polymer material is attached to the circular drive plate 12 and to the workpiece rotor 35 and which surrounds the outer diameter of the bellows device 6 pleats 25 during to prevent contamination of the bellows device 6 pleats 25 during the abrading procedures.

Figure 2:
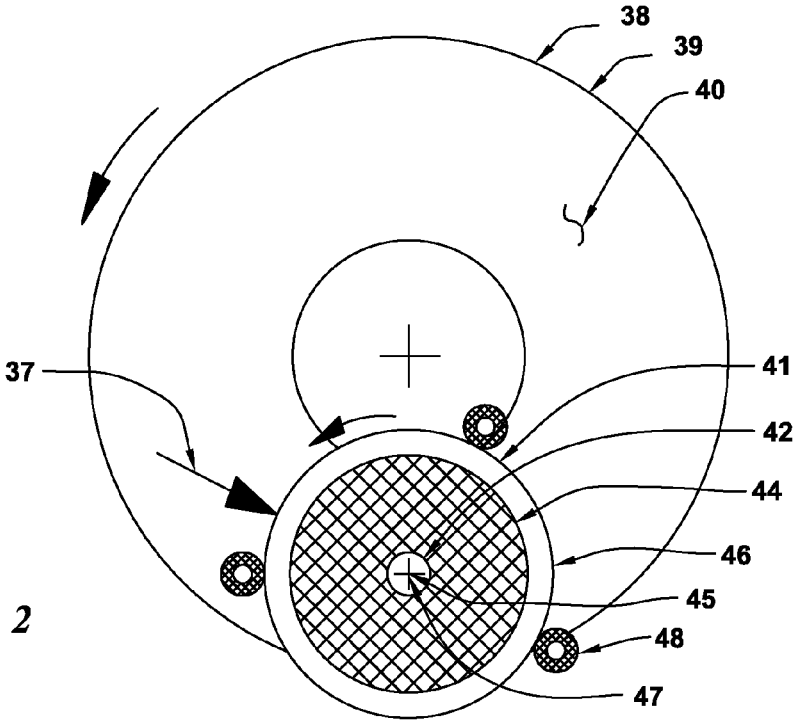
FIG. 2 is a top view of a bellows driven wafer polishing or lapping workpiece carrier.

FIG. 2 is a top view of a bellows driven floating workpiece carrier used for lapping or polishing semiconductor wafers or other workpiece substrates. A stationary workpiece carrier head (not shown) has a flat-surfaced workpiece 44 that is attached to a floating workpiece carrier rotor 46 that is rotationally driven by a flexible bellows device (not shown) that is driven by a rotary drive shaft 42 that is attached to the stationary workpiece carrier head. The floating workpiece cylindrical-shaped carrier rotor 46 having a carrier rotor outer diameter 41 is in rolling-contact with three stationary-position rotatable roller idlers 48 that create and maintain the center of rotation 47 of the carrier rotor 46 as it rotates and is subjected to abrading forces 37. The center of rotation 47 of the carrier rotor 46 must be coincident with the axis of rotation 45 of the carrier rotor 46 hollow drive shaft (not shown). An abrasive disk 38 that has an annular band of abrasive 40 is attached to a rotating platen 39.

Figure 3:
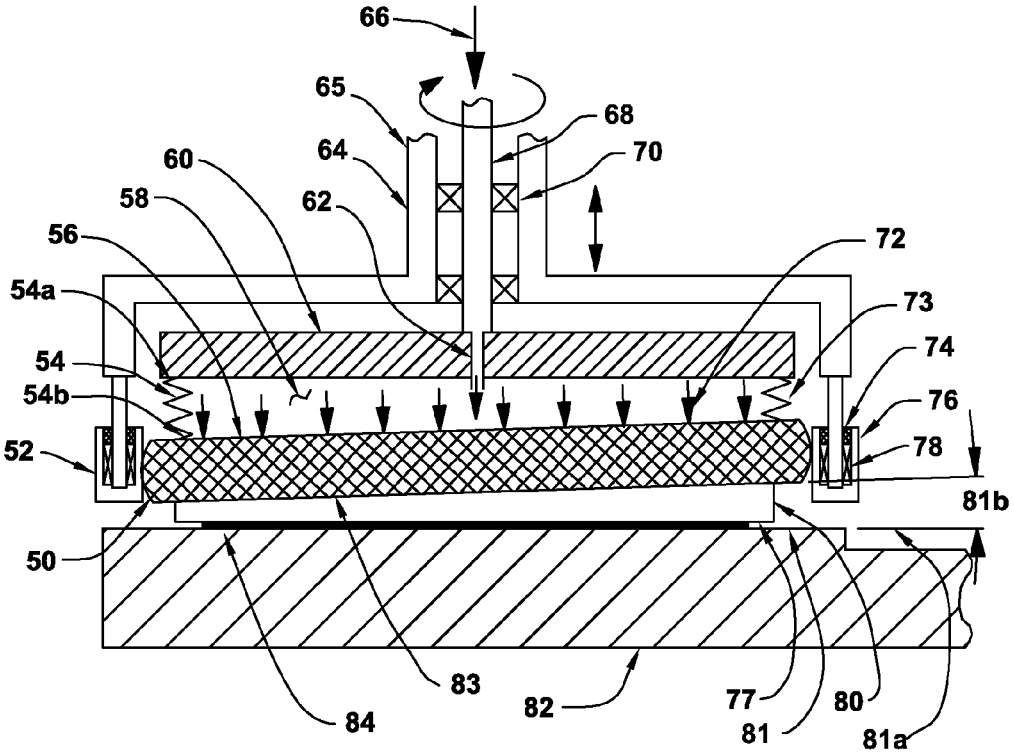
FIG. 3 is a cross section view of a tilted bellows driven workpiece carrier.

FIG. 3 is a cross section view of a bellows driven floating workpiece carrier that has a tilted workpiece. A stationary workpiece carrier head 65 has a flat-surfaced workpiece 80 that is attached to a floating workpiece carrier rotor 83 that is rotationally driven by a flexible bellows device 54 that is attached to a drive plate 60. The nominally-horizontal drive plate 60 is attached to a hollow drive shaft 68 that is supported by bearings 70 that are supported by a stationary carrier housing 64 where the carrier housing 64 can be raised and lowered in a vertical direction. The flexible bellows device 54 that is attached to the drive plate 60 is also attached to the workpiece carrier rotor 83 that is rotationally driven by the flexible bellows device 54. The workpiece carrier rotor 83 has an outer periphery 50 that has a spherical shape which allows the workpiece carrier rotor 83 outer periphery 50 to remain in contact with stationary roller idlers 76 when the rotating carrier rotor 83 is tilted.

The roller idlers 76 can have a cylindrical peripheral surface 52 or other surface shapes including a "spherical" hourglass type shape and can have low-friction roller bearings 78 or air bearings 78 and roller idler 76 seals 74. The roller idler 76 seals 74 prevent contamination of the low-friction roller bearings 78 or air bearings 78 by abrading debris or coolant water or other fluids or materials that are used in the abrading procedures. The air bearings 78 can provide zero friction and can rotate at very high speeds when the workpiece carrier rotor 83 is rotated at speeds of 3,000 rpm or more that are typically used in high speed flat lapping. Because the diameters of the roller idlers 76 are typically much smaller than the diameters of the workpiece carrier rotors 83 the roller idlers 76 typically have rotational speeds that are much greater than the rotational speeds of the workpiece carrier rotors 83.

Pressurized air or another fluid such as water 66 is supplied through the hollow drive shaft 68 that has a fluid passage 62 that allows pressurized air or another fluid such as water 66 to fill the sealed chamber 58 that is formed by the sealed flexible bellows device 54 that has flexible annular-disk pleats 73. This controlled fluid 66 pressure is present in the sealed chamber 58 to provide uniform abrading pressure 72 across the full flat top surface 56 of the carrier rotor 83 where the uniform abrading pressure 72 is directly transferred to the full workpiece 80 abraded surface 77 that is in adding contact with the abrasive 84 coating on the rotary platen 82.

The bellows device 54 annular-disk pleats 73 that are joined together at their inside-diameter and outside-diameter peripheral edges allow the bellows device 54 to act as a spring device which can flex vertically with little friction and to have small deflection stiffness in a vertical direction but provides substantial stiffness in a horizontal direction. However, the horizontal-direction stiffness of the bellows device 54 annular-disk pleats 73 does allow a small amount of misalignment to occur between the rotation axis of the drive shaft 68 and the center of rotation of the workpiece carrier rotor 83. The bellows device 54 pleats 73 are very stiff torsionally due to their near-flat mutually edge-joined annular-disk pleat-section members that are nominally horizontal which allows the bellows device 54 to have substantial tensional stiffness for driving the rotation of the workpiece carrier rotor 83. These types of lightweight bellows devices 54 are often used as zero-backlash but flexible shaft drives for machine tool devices.

The workpiece carrier rotor 83 is allowed to be tilted from a horizontal position when it and the flat-surfaced workpiece 80 such as a semiconductor wafer when they are stationary or rotated by the flexing action provided by the bellows devices 54 that can be operated at very high rotational speeds. Here, a flat-surfaced workpiece 80 that has opposed flat surfaces that are not parallel causes the workpiece carrier rotor 83 having the attached flat-surfaced workpiece 80 to be tilted and the bellows device 54 annular-disk pleats 73 are compressed on one side of the bellows device 54 to compensate for the tilted workpiece carrier rotor 83. As the workpiece 80 and the workpiece carrier rotor 83 rotate, the compressed portion of the bellows device 54 annular-disk pleats 73 travels around the periphery of the stationary carrier housing 64.

Even as the workpiece 80 having non-parallel sides is rotated, the applied abrading pressure 72 remains uniform across the full flat top surface 56 of the carrier rotor 83 where the controlled fluid 66 pressure that causes the uniform applied abrading pressure 72 is directly transferred uniformly to the workpiece 80 abraded surface 77 that is in abrading contact with the abrasive 84 coating on the rotary platen 82. The bellows device 54 pleats 73 can be constructed from corrosion-resistant metals such as stainless steel or from polymers such as polyester.

When the flat-surfaced workpiece 80 and the workpiece carrier rotor 83 are subjected to abrading friction forces that are parallel to the abraded surface 77 of the workpieces 80, these abrading friction forces are resisted by the workpiece carrier rotor 83 as it contacts the multiple idlers 76 that are located around the outer periphery of the workpiece carrier rotor 83.

The workpiece carrier rotor 83 has an outer periphery 50 spherical shape which allows the workpiece carrier rotor 83 outer periphery 50 to remain in contact with the cylindrical-surfaced roller idlers 76 when the rotating carrier rotor 83 is tilted where the stationary-position surfaced roller idlers 76 that are spaced around the outer periphery of the workpiece carrier rotor 83 act together as a centering device that maintains the stationary-position of the original center of rotation of the workpiece carrier rotor 83 as the workpiece carrier rotor 83 rotates.

The workpiece carrier rotor 83 outer periphery 50 spherical shape provides that the center of rotation of the workpiece carrier rotor 83 remains aligned with the rotational axis of drive shaft 68 when the workpiece carrier rotor 83 is tilted as it rotates. The workpiece carrier rotor 83 can be tilted due to numerous causes including: flat-surfaced workpiece 80 that have non-parallel opposed surfaces; misalignment of components of the stationary workpiece carrier head 65; misalignment of other components of the abrading machine (not shown); and a platen 82 that has an abrading surface 81 that is not flat.

Figure 4:
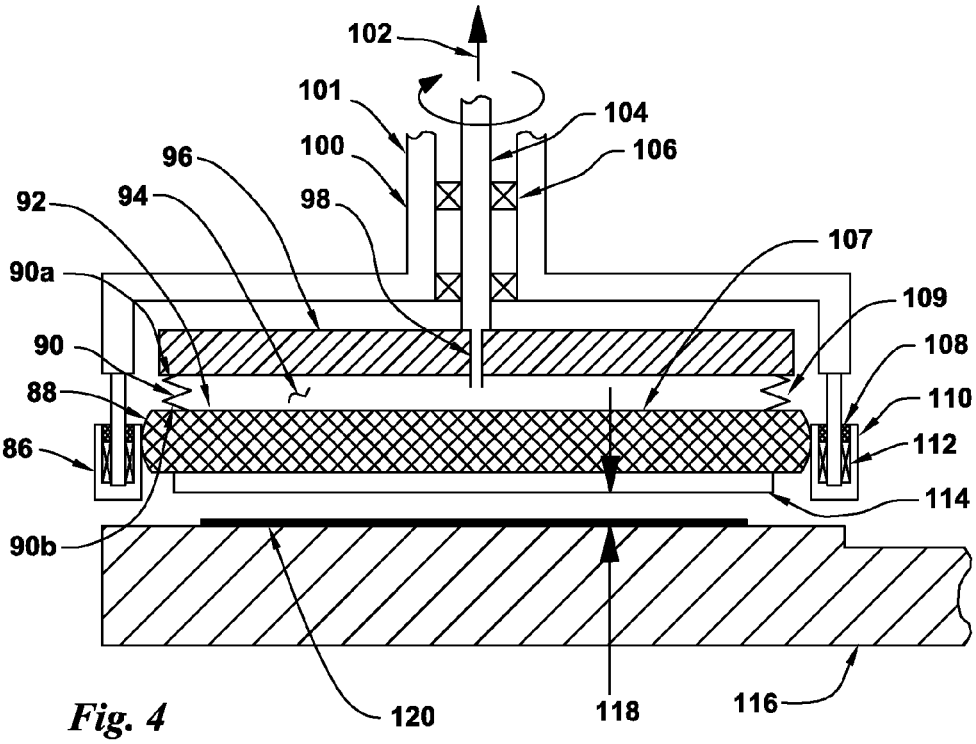
FIG. 4 is a cross section view of a vacuum-raised bellows driven floating workpiece carrier.

FIG. 4 is a cross section view of a bellows driven floating workpiece carrier that is raised using vacuum. A stationary workpiece carrier head 101 has a flat-surfaced workpiece 114 that is attached to a floating workpiece carrier rotor 107 that is rotationally driven by a flexible bellows device 90 that is attached to a drive plate 96. The nominally-horizontal drive plate 96 is attached to a hollow drive shaft 104 that is supported by bearings 106 that are supported by a stationary carrier housing 100 where the carrier housing 100 can be raised and lowered in a vertical direction. The flexible bellows device 90 that is attached to the drive plate 96 is also attached to the workpiece carrier rotor 107 that is rotationally driven by the flexible bellows device 90. The workpiece carrier rotor 107 has an outer periphery 88 that has a spherical shape which allows the workpiece carrier rotor 107 outer periphery 88 to remain in contact with stationary roller idlers 110 when the rotating carrier rotor 107 and the attached workpiece 114 is raised. The workpiece carrier rotor 107 can also be raised to attach workpieces 114 to the carrier rotor 107 or to separate workpieces 114 from the carrier rotor 107.

The roller idlers 110 can have a cylindrical peripheral surface 86 and can have low-friction roller bearings 112 and roller idler 110 seals 108. Vacuum 102 is supplied through the hollow drive shaft 104 that has a fluid passage 98 that allows the sealed chamber 94 that is formed by the sealed flexible bellows device 90 that has flexible annular-disk pleats 109. This vacuum negative 102 pressure is present in the sealed chamber 94 to provide uniform vacuum negative pressure across the full flat top surface 92 of the carrier rotor 107 where the vacuum raises the workpiece carrier rotor 107 and the workpiece 114 a distance 118 from abrading contact with the abrasive 120 coating on a rotary platen 116.

The bellows device 90 annular-disk pleats 109 that are joined together at their inside-diameter and outside-diameter peripheral edges allow the bellows device 90 to act as a spring device which can flex vertically with little friction and to have small deflection stiffness in a vertical direction but provides substantial stiffness in a horizontal direction.

The bellows 54 has a bellows top annular ring 54*a* and a bellows bottom annular ring 54*b* that is attached to the workpiece carrier rotor 83 that is tilted an angle 81*b* with a horizontal plane 81*a* where the bellows bottom annular ring 54*b* is also tilted an angle 81*b* with a horizontal plane 81*a*.

Figure 5:
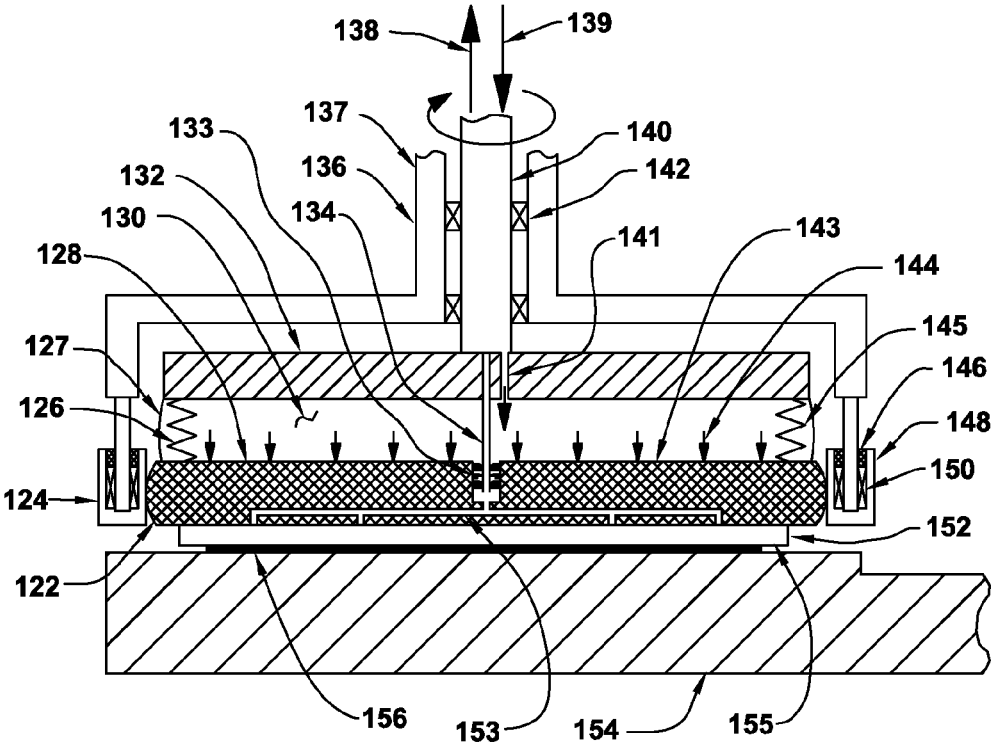
FIG. 5 is a cross section view of a bellows driven carrier with vacuum attached workpieces.

FIG. 5 is a cross section view of a bellows driven floating workpiece carrier having vacuum attached workpieces. A stationary workpiece carrier head 137 has a flat-surfaced workpiece 152 that is attached to a floating workpiece carrier rotor 143 that is rotationally driven by a flexible bellows device 126 that is attached to a drive plate 132. The nominally-horizontal drive plate 132 is attached to a hollow drive shaft 140 having a rotation axis that is supported by bearings 142 that are supported by a stationary carrier housing 136 where the carrier housing 136 can be raised and lowered in a vertical direction. The flexible bellows device 126 that is attached to the drive plate 132 is also attached to the workpiece carrier rotor 143 that is rotationally driven by the flexible bellows device 126. The workpiece carrier rotor 143 has an outer periphery 1142 that has a spherical shape which allows the workpiece carrier rotor 143 outer periphery 122 to remain in contact with stationary roller idlers 148 when the rotating carrier rotor 143 is tilted.

The workpiece carrier rotor 143 has a rotation axis that is coincident with the hollow drive shaft 140 rotation axis 19 to avoid interference action of the workpiece carrier rotor 143 with the hollow drive shaft 140 when the hollow drive shaft 140 is rotated. The workpiece 152 carrier rotor 143 rotation axis is positioned to be coincident with the hollow drive shaft 140 rotation axis by the controlled location of the stationary roller idlers 148 that are mounted to the Rolling contact of the workpiece carrier rotor 143 outer periphery 122 with the set of stationary roller idlers 148 that are precisely located at prescribed positions assures that the workpiece carrier rotor 143 rotation axis is coincident with the hollow drive shaft 140 rotation axis 19. The stationary roller idlers 148 are mounted at positions on the carrier housing 136 where the diameters of the stationary roller idlers 148 and the diameters of the respective workpiece carrier rotors 143 are considered in the design and fabrication of the workpiece carrier head 137 to provide that the workpiece carrier rotor 143 rotation axis is precisely coincident with the hollow drive shaft 140 rotation axis.

The bellows 90 has a bellows top annular ring 90*a* and a bellows bottom annular ring 90*b* that is attached to the workpiece carrier rotor 107 that is raised a distance 118 where the bellows top annular ring 90*a* is raised a distance 118 from the bellows bottom annular ring 90*b*.

If the workpiece carrier rotor 143 rotation axis is positioned to be offset a distance from the hollow drive shaft 140 rotation axis then the flexible bellows device 126 that is attached to both the workpiece carrier rotor 143 and to the drive plate 132 that is attached to the hollow drive shaft 140 will experience an undesirable lateral distortion in a horizontal direction.

Lateral horizontal distortion of the flexible bellows device 126 can produce interference action of the workpiece carrier rotor 143 with the hollow drive shaft 140 when the hollow drive shaft 140 is rotated. Interference action of the workpiece carrier rotor 143 with the hollow drive shaft 140 during rotation of the hollow drive shaft 140 can cause undesirable variations in the speed of rotation of the workpiece 152 that is in abrading contact with the abrasive 156 coating on the rotary platen 154. The variations in the speed of rotation of the workpiece 152 would be periodic with every revolution of the workpiece 152 and would tend to create uneven abrasion patterns on the abraded surface of an expensive workpiece such as a semiconductor wafer, especially when the workpiece 152 is rotated at the high rotational speeds used for high speed lapping or polishing of workpieces 152.

The roller idlers 148 can have a cylindrical peripheral surface 124 or other surface shapes including a "spherical" hour-glass type shape and can have low-friction roller bearings 150 or air bearings 150 and roller idler 148 seals 146 shape and can have low-friction roller bearings 150 or air bearings 150 and roller idler 148 seals 146. The roller idler 148 seals 146 prevent contamination of the low-friction roller bearings 150 or air bearings 150 by abrading debris or coolant water or other fluids or materials that are used in the abrading procedures. The air bearings 150 can provide zero friction and can rotate at very high speeds when the workpiece carrier rotor 143 is rotated at speeds of 3,000 rpm or more that are typically used in high speed flat lapping. Because the diameters of the roller idlers 148 are typically much smaller than the diameters of the workpiece carrier rotors 143 the roller idlers 148 typically have rotational speeds that are much greater than the rotational speeds of the workpiece carrier rotors 143.

Pressurized air or another fluid such as water 139 is supplied through the hollow drive shaft 140 that has a fluid passage 141 that allows pressurized air or another fluid such as water 139 to fill the sealed chamber 130 that is formed by the sealed flexible bellows device 126 that has flexible annular-disk pleats 145. This controlled fluid 139 pressure is present in the sealed chamber 130 to provide uniform abrading pressure 144 across the full top surface 128 of the carrier rotor 143 where uniform abrading pressure 144 pressure is directly transferred to the workpiece 152 abraded surface 155 that is in abrading contact with the abrasive 156 coating on the rotary platen 154.

The bellows device 126 annular-disk pleats 145 that are joined together at their inside-diameter and outside-diameter peripheral edges allow the bellows device 126 to act as a spring device which can flex vertically with little friction and to have small deflection stiffness in a vertical direction but provides substantial stiffness in a horizontal direction. However, the horizontal-direction stiffness of the bellows device 126 annular-disk pleats 145 does allow a small amount of misalignment to occur between the rotation axis of the drive shaft 140 and the center of rotation of the workpiece carrier rotor 143. The bellows device 126 pleats 145 are very stiff torsionally due to their near-flat mutually edge-joined annular-disk pleat-section members that are nominally horizontal which allows the bellows device 126 to have substantial tensional stiffness for driving the rotation of the workpiece carrier rotor 143. These types of lightweight bellows devices 126 are often used as zero-backlash but flexible shaft drives for machine tool devices.

The workpiece carrier rotor 143 and the flat-surfaced workpiece 152 such as a semiconductor wafer is allowed to be tilted from a horizontal position when they are stationary or rotated by the flexing action provided by the bellows devices 126 that can be operated at very high rotational speeds. The bellows device 126 pleats 145 can be constructed from corrosion-resistant metals such as stainless steel or from polymers such as polyester.

When the flat-surfaced workpiece 152 and the workpiece carrier rotor 143 are subjected to abrading friction forces that are parallel to the abraded surface 155 of the workpieces 152, these abrading friction forces are resisted by the workpiece carrier rotor 143 as it contacts the multiple idlers 148 that are located around the outer periphery of the workpiece carrier rotor 143. The circular drive plate 132 has an outer periphery 122 spherical shape which allows the workpiece carrier rotor 143 outer periphery 122 to remain in contact with the cylindrical-surfaced roller idlers 148 when the rotating carrier rotor 143 is tilted where the stationary-position surfaced roller idlers 148 that are spaced around the outer periphery of the workpiece carrier rotor 143 act together as a centering device that controls the center of rotation of the workpiece carrier rotor 143 as it rotates.

The circular drive plate 132 outer periphery 122 spherical shape provides that the center of rotation of the workpiece carrier rotor 143 remains aligned with the rotational axis of drive shaft 140 when the workpiece carrier rotor 143 is tilted as it rotates. The workpiece carrier rotor 143 can be tilted due to numerous causes including: flat-surfaced workpiece 152 that have non-parallel opposed surfaces; misalignment of components of the stationary workpiece carrier head 137; misalignment of other components of the abrading machine (not shown); a platen 154 that has an abrading surface 31 that is not flat.

A flexible annular band 127 that is impervious to water, abrading fluids and abrading debris that is preferably constructed from a flexible elastomer or polymer material is attached to the circular drive plate 132 and to the workpiece rotor 143 and which surrounds the outer diameter of the bellows device 126 pleats 145 during to prevent contamination of the bellows device 126 pleats 145 during the abrading procedures.

Vacuum 138 is routed through the hollow drive shaft 140 and through the flexible tube 134 that slides into the flexible tube slideable seal 133 that is attached to the workpiece rotor 143 and provides vacuum 138 to the vacuum passageways 153 that provide attachment of the wafers or workpieces 152 to the workpiece rotor 143.

Figure 6:
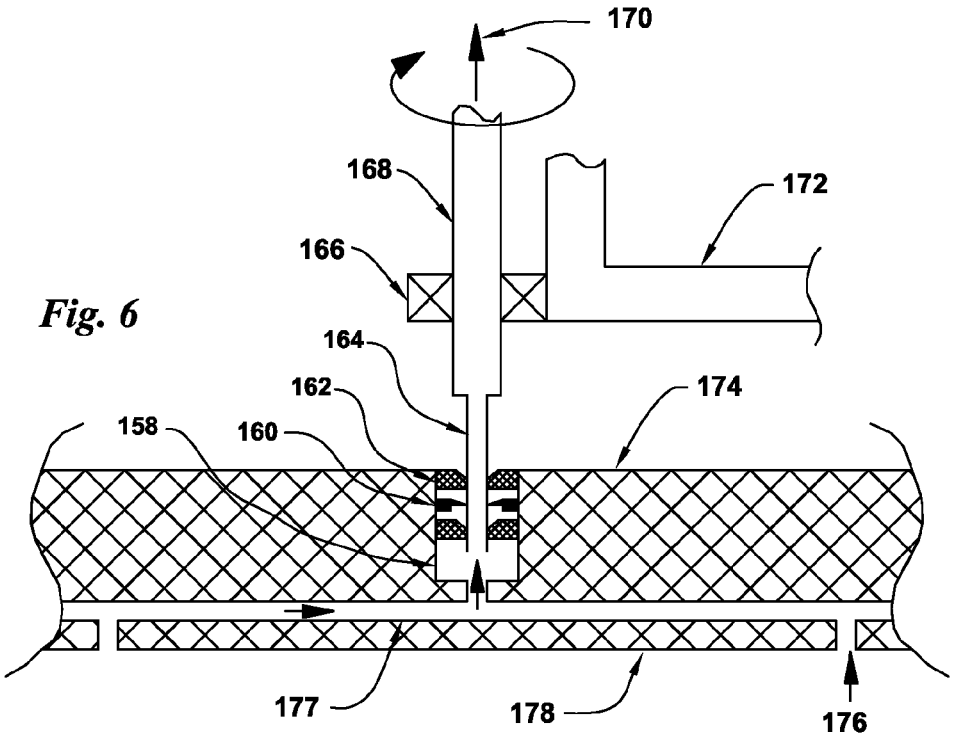
FIG. 6 is a cross section view of a wafer vacuum attachment device with a flexible tube.

FIG. 6 is a cross section view of a wafer vacuum attachment device that uses a flexible vacuum tube. Vacuum 170 is routed through the hollow drive shaft 168 and through the flexible tube 164 that slides into the flexible tube slideable seal 160 that is attached to the nominally-horizontal workpiece rotor 174 where the flexible tube 164 is guided and positioned by tube guides 162 that are attached to the workpiece rotor 174. The flexible tube 164 provides vacuum 170 to a vacuum chamber 158 that supplies vacuum 170 to the vacuum passageways 177 that provides vacuum 170 to the vacuum port holes 176 that are used to provide attachment of the wafers or workpieces (not shown) to the workpiece rotor 174 wafer mounting surface 178. The hollow drive shaft 168 is supported by bearings 166 that are supported by a stationary carrier housing 172 where the carrier housing 172 can be raised and lowered in a vertical direction.

Figure 7:
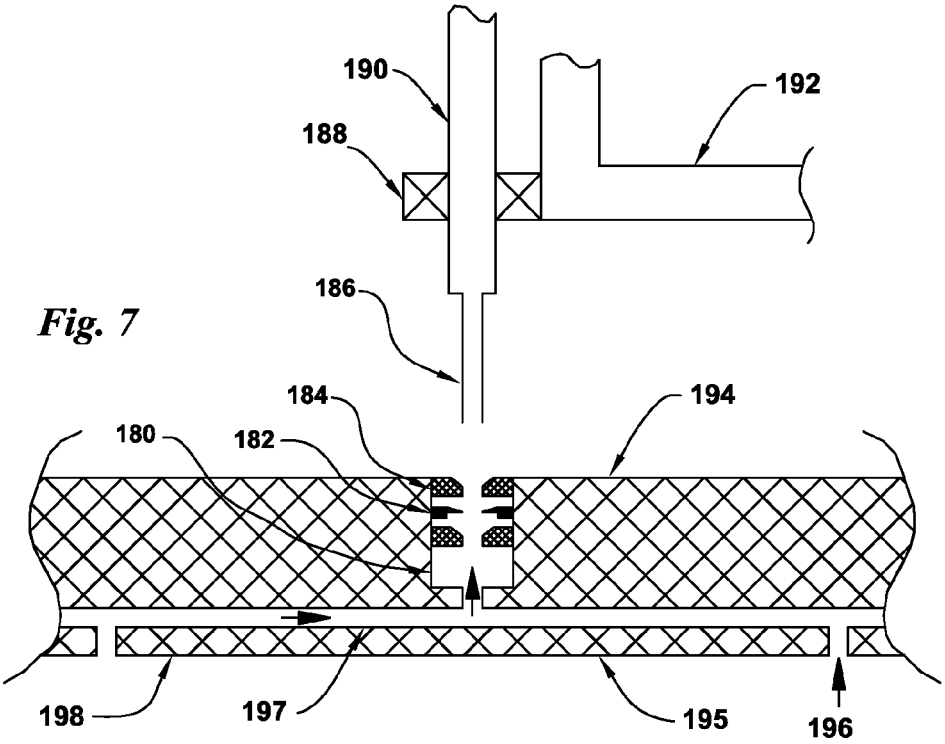
FIG. 7 is a cross section view of a wafer attachment device with a separated vacuum tube.

FIG. 7 is a cross section view of a wafer vacuum attachment device that uses a flexible vacuum tube where the rotatable wafer rotor is separated from the stationary carrier housing. Vacuum is routed through the hollow drive shaft 190 and through the flexible tube 186 that slides into the flexible tube slideable seal 182 that is attached to the nominally-horizontal workpiece rotor 194 where the flexible tube 186 is guided and positioned by tube guides 184 that are attached to the workpiece rotor 194. The flexible tube 186 provides vacuum to a vacuum chamber 180 that supplies vacuum to the vacuum passageways 197 that provides vacuum to the vacuum port holes 196 that are used to provide attachment of the wafers or workpieces (not shown) to the workpiece rotor 194 wafer mounting surface 195. The hollow drive shaft 190 is supported by bearings 188 that are supported by a stationary carrier housing 192 where the carrier housing 192 can be raised and lowered in a vertical direction. The carrier housing 192 is shown in a raised position where there is a space gap between the free end of the flexible tube 186 and the flexible tube 186 guides 184 that are attached to the workpiece rotor 194.

Figure 8:
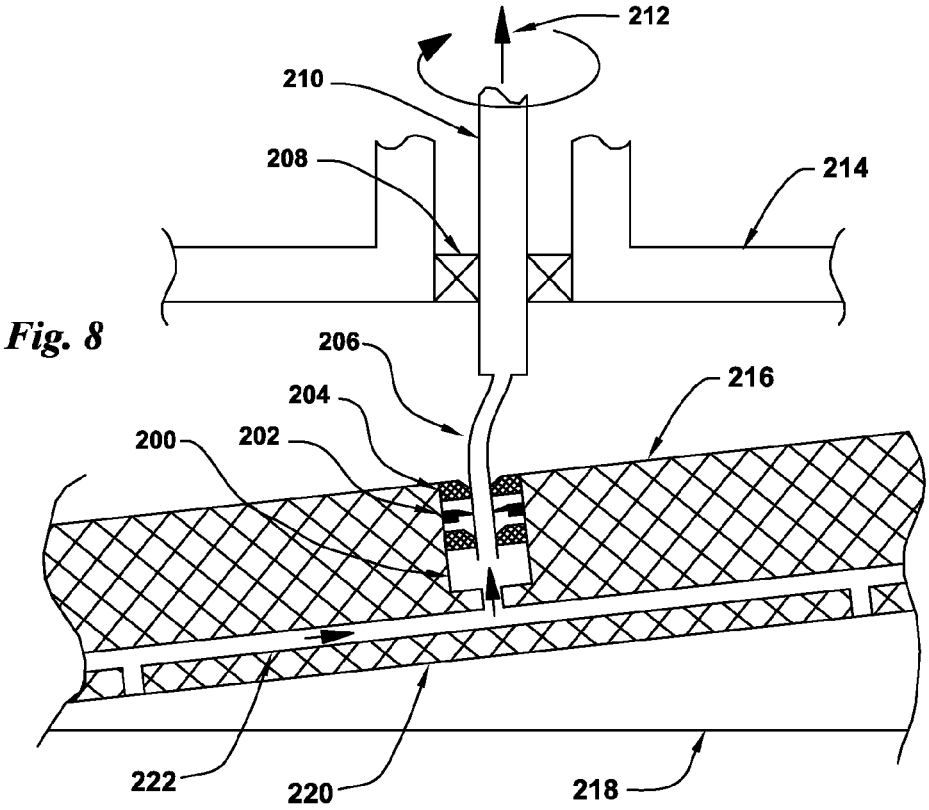
FIG. 8 is a cross section view of a wafer attachment device with a distorted vacuum tube.

FIG. 8 is a cross section view of a wafer vacuum attachment device that uses a flexible vacuum tube that is distorted. Vacuum 212 is routed through the hollow drive shaft 210 and through the flexible tube 206 that slides into the flexible tube slideable seal 202 that is attached to the nominally-horizontal workpiece rotor 216 where the distorted flexible tube 206 is guided and positioned by tube guides 204 that are attached to the workpiece rotor 216. The flexible tube 206 provides vacuum 212 to a vacuum chamber 200 that supplies vacuum 212 to the vacuum passageways 222 that provides vacuum 212 to the vacuum port holes that are used to provide attachment of the wafers or workpieces 218 having non-parallel flat surfaces to the workpiece rotor 216 wafer mounting surface 220.

The wafers or workpieces 218 having non-parallel flat surfaces tilts the workpiece rotor 216 which distorts the flexible tube 206 having a smooth exterior surface that is guided and positioned by tube guides 204 that allow the flexible tube slideable seal 202 to seal the flexible tube 206 against vacuum leaks even though the flexible tube 206 is distorted. The flexible tube 206 smooth exterior surface prevents excessive wear of the tube guides 204 and the flexible tube slideable seals 202 when the workpiece rotor 216 is rotated. The hollow drive shaft 210 is supported by bearings 208 that are supported by a stationary carrier housing 214 where the carrier housing 214 can be raised and lowered in a vertical direction.

Figure 9:
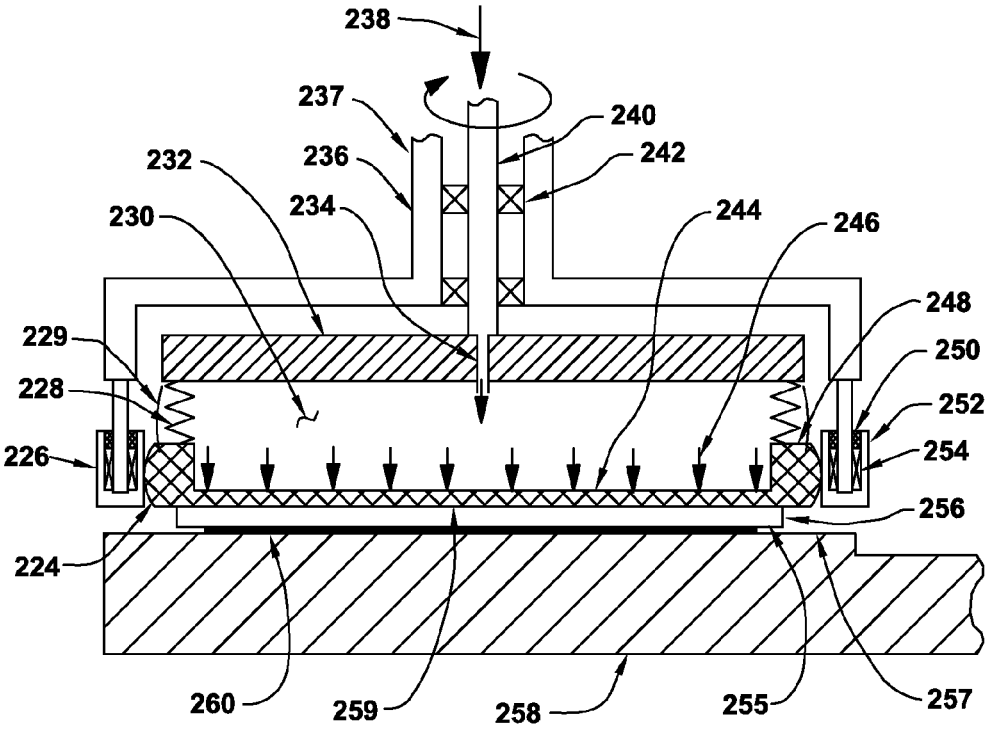
FIG. 9 is a cross section view of a bellows driven carrier with a flexible wafer carrier rotor.

FIG. 9 is a cross section view of a bellows driven floating workpiece carrier with a flexible wafer carrier rotor. A stationary workpiece carrier head 237 has a flat-surfaced workpiece 256 that is attached to a floating workpiece carrier rotor 248 that is rotationally driven by a flexible bellows device 228 that is attached to a drive plate 232. The nominally-horizontal drive plate 232 is attached to a hollow drive shaft 240 having a rotation axis that is supported by bearings 242 that are supported by a stationary carrier housing 236 where the carrier housing 236 can be raised and lowered in a vertical direction. The flexible bellows device 228 that is attached to the drive plate 232 is also attached to the workpiece carrier rotor 248 that is rotationally driven by the flexible bellows device 228. The workpiece carrier rotor 248 has a central flexible bottom portion 259 and has an outer periphery 224 that has a spherical shape which allows the workpiece carrier rotor 248 outer periphery 224 to remain in contact with stationary roller idlers 252 when the rotating carrier rotor 248 is tilted.

The workpiece carrier rotor 248 has a rotation axis that is coincident with the hollow drive shaft 240 rotation axis to avoid interference action of the workpiece carrier rotor 248 with the hollow drive shaft 240 when the hollow drive shaft 240 is rotated. The workpiece 256 carrier rotor 248 rotation axis is positioned to be coincident with the hollow drive shaft 240 rotation axis by the controlled location of the stationary roller idlers 252 that are mounted to the Rolling contact of the workpiece carrier rotor 248 outer periphery 224 with the set of stationary roller idlers 252 that are precisely located at prescribed positions assures that the workpiece carrier rotor 248 rotation axis is coincident with the hollow drive shaft 240 rotation axis. The stationary roller idlers 252 are mounted at positions on the carrier housing 236 where the diameters of the stationary roller idlers 252 and the diameters of the respective workpiece carrier rotors 248 are considered in the design and fabrication of the workpiece carrier head 237 to provide that the workpiece carrier rotor 248 rotation axis is precisely coincident with the hollow drive shaft 240 rotation axis.

If the workpiece carrier rotor 248 rotation axis is positioned to be offset a distance from the hollow drive shaft 240 rotation axis then the flexible bellows device 228 that is attached to both the workpiece carrier rotor 248 and to the drive plate 232 that is attached to the hollow drive shaft 240 will experience an undesirable lateral distortion in a horizontal direction.

Lateral horizontal distortion of the flexible bellows device 228 can produce interference action of the workpiece carrier rotor 248 with the hollow drive shaft 240 when the hollow drive shaft 240 is rotated. Interference action of the workpiece carrier rotor 248 with the hollow drive shaft 240 during rotation of the hollow drive shaft 240 can cause undesirable variations in the speed of rotation of the workpiece 256 that is in abrading contact with the abrasive 260 coating on the rotary platen 258. The variations in the speed of rotation of the workpiece 256 would be periodic with every revolution of the workpiece 256 and would tend to create uneven abrasion patterns on the abraded surface of an expensive workpiece such as a semiconductor wafer, especially when the workpiece 256 is rotated at the high rotational speeds used for high speed lapping or polishing of workpieces 256.

The roller idlers 252 can have a cylindrical peripheral surface 226 or other surface shapes including a "spherical" hour-glass type shape and can have low-friction roller bearings 254 or air bearings 254 and roller idler 252 seals 250 shape and can have low-friction roller bearings 254 or air bearings 254 and roller idler 252 seals 250. The roller idler 252 seals 250 prevent contamination of the low-friction roller bearings 254 or air bearings 254 by abrading debris or coolant water or other fluids or materials that are used in the abrading procedures. The air bearings 254 can provide zero friction and can rotate at very high speeds when the workpiece carrier rotor 248 is rotated at speeds of 3,000 rpm or more that are typically used in high speed flat lapping. Because the diameters of the roller idlers 252 are typically much smaller than the diameters of the workpiece carrier rotors 248 the roller idlers 252 typically have rotational speeds that are much greater than the rotational speeds of the workpiece carrier rotors 248.

Pressurized air or another fluid such as water 238 is supplied through the hollow drive shaft 240 that has a fluid passage 234 that allows pressurized air or another fluid such as water 238 to fill the sealed chamber 230 that is formed by the sealed flexible bellows device 228 that has flexible annular-disk pleats. This controlled fluid 238 pressure is present in the sealed chamber 230 to provide uniform abrading pressure 246 across the flexible full flat top surface 244 portion of the flexible carrier rotor 248 where uniform abrading pressure 246 pressure is directly transferred to the workpiece 256 abraded surface 255 that is in abrading contact with the abrasive 260 coating on the rotary platen 258.

The bellows device 228 annular-disk pleats that are joined together at their inside-diameter and outside-diameter peripheral edges allow the bellows device 228 to act as a spring device which can flex vertically with little friction and to have small deflection stiffness in a vertical direction but provides substantial stiffness in a horizontal direction. However, the horizontal-direction stiffness of the bellows device 228 annular-disk pleats does allow a small amount of misalignment to occur between the rotation axis of the drive shaft 240 and the center of rotation of the workpiece carrier rotor 248. The bellows device 228 pleats are very stiff torsionally due to their near-flat mutually edge-joined annular-disk pleat-section members that are nominally horizontal which allows the bellows device 228 to have substantial tensional stiffness for driving the rotation of the workpiece carrier rotor 248. These types of lightweight bellows devices 228 are often used as zero-backlash but flexible shaft drives for machine tool devices.

The workpiece carrier rotor 248 and the flat-surfaced workpiece 256 such as a semiconductor wafer is allowed to be tilted from a horizontal position when they are stationary or rotated by the flexing action provided by the bellows devices 228 that can be operated at very high rotational speeds. The bellows device 228 pleats can be constructed from corrosion-resistant metals such as stainless steel or from polymers such as polyester.

When the flat-surfaced workpiece 256 and the workpiece carrier rotor 248 are subjected to abrading friction forces that are parallel to the abraded surface 255 of the workpieces 256, these abrading friction forces are resisted by the workpiece carrier rotor 248 as it contacts the multiple idlers 252 that are located around the outer periphery of the workpiece carrier rotor 248. The circular drive plate 232 has an outer periphery 224 spherical shape which allows the workpiece carrier rotor 248 outer periphery 224 to remain in contact with the cylindrical-surfaced roller idlers 252 when the rotating carrier rotor 248 is tilted where the stationary-position surfaced roller idlers 252 that are spaced around the outer periphery of the workpiece carrier rotor 248 act together as a centering device that controls the center of rotation of the workpiece carrier rotor 248 as it rotates.

The circular drive plate 232 outer periphery 224 spherical shape provides that the center of rotation of the workpiece carrier rotor 248 remains aligned with the rotational axis of drive shaft 240 when the workpiece carrier rotor 248 is tilted as it rotates. The workpiece carrier rotor 248 can be tilted due to numerous causes including: flat-surfaced workpiece 256 that have non-parallel opposed surfaces; misalignment of components of the stationary workpiece carrier head 237; misalignment of other components of the abrading machine (not shown); a platen 258 that has an abrading surface 257 that is not flat.

A flexible annular band 229 that is impervious to water, abrading fluids and abrading debris that is preferably constructed from a flexible elastomer or polymer material is attached to the circular drive plate 232 and to the workpiece rotor 248 and which surrounds the outer diameter of the bellows device 228 pleats during to prevent contamination of the bellows device 228 pleats during the abrading procedures.

Figure 10:
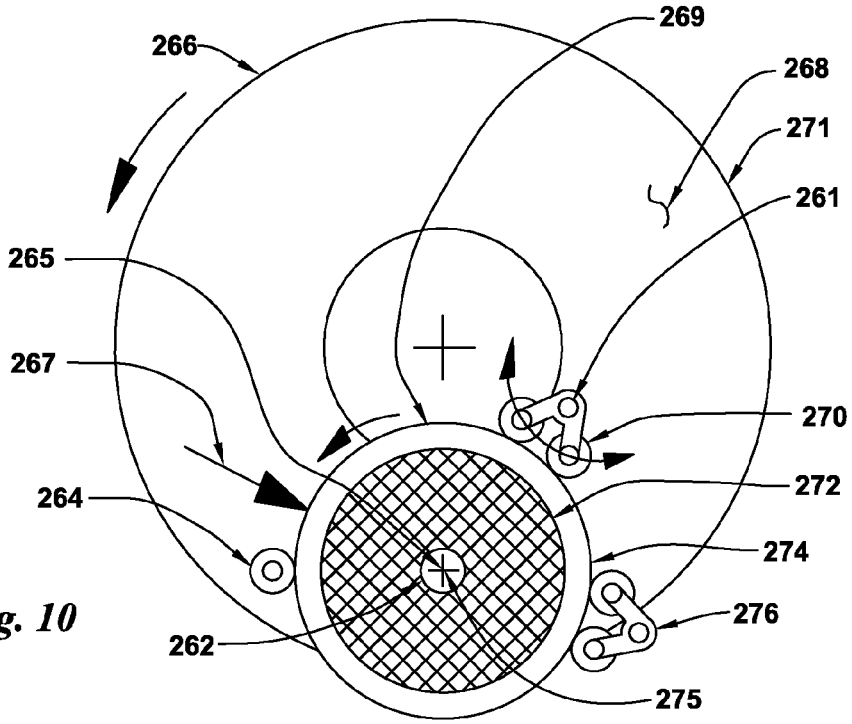
FIG. 10 is a top view of a bellows driven floating carrier that is supported by idlers.

FIG. 10 is a top view of a bellows driven floating workpiece carrier that is supported by idlers. A stationary workpiece carrier head (not shown) has a flat-surfaced workpiece 272 that is attached to a floating workpiece carrier rotor 274 that is rotationally driven by a flexible bellows device (not shown) that is driven by a rotary drive shaft 262 that is attached to the stationary workpiece carrier head. The floating workpiece cylindrical-shaped carrier rotor 274 having a carrier rotor outer diameter 269 is in rolling-contact with three stationary-position rotatable roller idlers 264, 270 that create and maintain the center of rotation 265 of the carrier rotor 274 as it rotates and is subjected to abrading forces 267. The center of rotation 265 of the carrier rotor 274 must be coincident with the axis of rotation 275 of the carrier rotor 274 hollow drive shaft (not shown). An abrasive disk 271 that has an annular band of abrasive 268 is attached to a rotating platen 266. A dual set of idlers 270 is mounted on a pivot arm 276 having a pivot arm 276 rotation center that allows both idlers 270 to contact the outer periphery of the carrier rotor 274 where both idlers 270 share the restraining force load on the carrier rotor that is imposed by the abrading force 267 on the workpiece 272 that is transmitted to the carrier rotor 274 because the workpiece 272 is attached to the carrier rotor 274.

Figure 11:
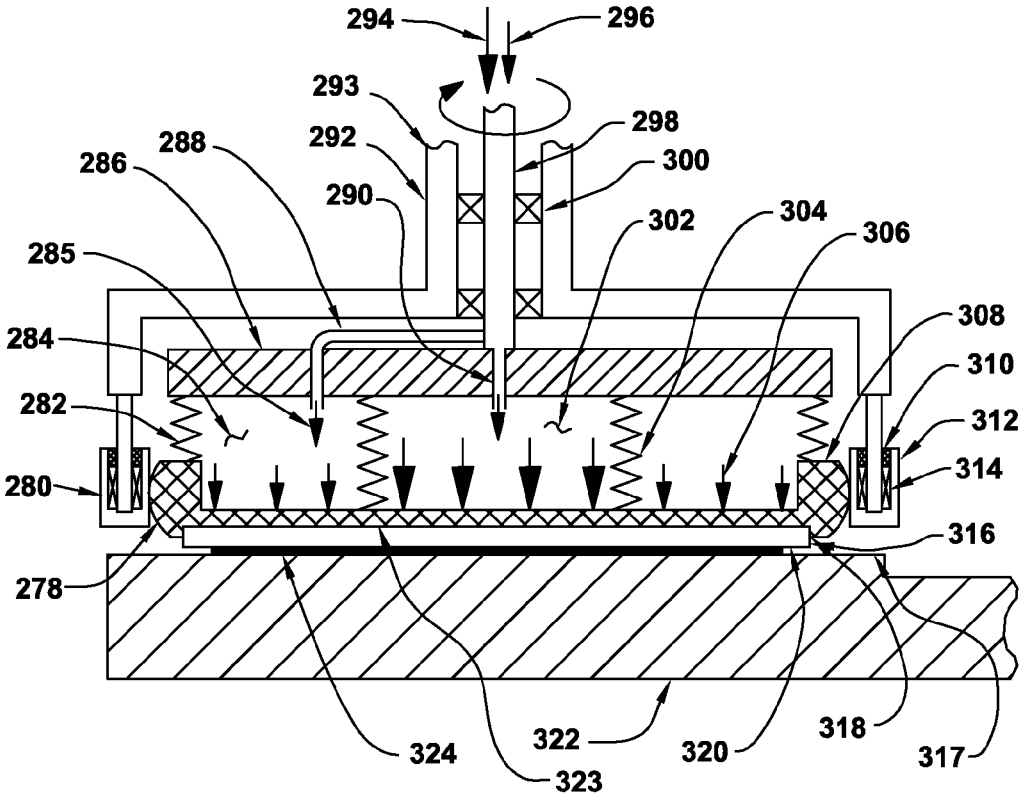
FIG. 11 is a cross section view of a bellows driven floating carrier with multiple bellows.

FIG. 11 is a cross section view of a bellows driven floating workpiece carrier with multiple bellows. A stationary workpiece carrier head 293 has a flat-surfaced workpiece 316 that is attached to a floating workpiece carrier rotor 308 that is rotationally driven by a flexible bellows device 282 that is attached to a drive plate 286. The nominally-horizontal drive plate 286 is attached to a hollow drive shaft 298 having a rotation axis that is supported by bearings 300 that are supported by a stationary carrier housing 292 where the carrier housing 292 can be raised and lowered in a vertical direction. The flexible bellows device 282 that is attached to the drive plate 286 is also attached to the workpiece carrier rotor 308 that is rotationally driven by the flexible bellows device 282. The workpiece carrier rotor 308 has a central flexible bottom portion 323 and has an outer periphery 278 that has a spherical shape which allows the workpiece carrier rotor 308 outer periphery 278 to remain in contact with stationary roller idlers 312 when the rotating carrier rotor 308 is tilted.

The workpiece carrier rotor 308 has a rotation axis that is coincident with the hollow drive shaft 298 rotation axis to avoid interference action of the workpiece carrier rotor 308 with the hollow drive shaft 298 when the hollow drive shaft 298 is rotated. The workpiece 316 carrier rotor 308 rotation axis is positioned to be coincident with the hollow drive shaft 298 rotation axis by the controlled location of the stationary roller idlers 312 that are mounted to the Rolling contact of the workpiece carrier rotor 308 outer periphery 278 with the set of stationary roller idlers 312 that are precisely located at prescribed positions assures that the workpiece carrier rotor 308 rotation axis is coincident with the hollow drive shaft 298 rotation axis. The stationary roller idlers 312 are mounted at positions on the carrier housing 292 where the diameters of the stationary roller idlers 312 and the diameters of the respective workpiece carrier rotors 308 are considered in the design and fabrication of the workpiece carrier head 293 to provide that the workpiece carrier rotor 308 rotation axis is precisely coincident with the hollow drive shaft 298 rotation axis.

If the workpiece carrier rotor 308 rotation axis is positioned to be offset a distance from the hollow drive shaft 298 rotation axis then the flexible bellows device 282 that is attached to both the workpiece carrier rotor 308 and to the drive plate 286 that is attached to the hollow drive shaft 298 will experience an undesirable lateral distortion in a horizontal direction.

Lateral horizontal distortion of the flexible bellows device 282 can produce interference action of the workpiece carrier rotor 308 with the hollow drive shaft 298 when the hollow drive shaft 298 is rotated. Interference action of the workpiece carrier rotor 308 with the hollow drive shaft 298 during rotation of the hollow drive shaft 298 can cause undesirable variations in the speed of rotation of the workpiece 316 that is in abrading contact with the abrasive 324 coating on the rotary platen 322. The variations in the speed of rotation of the workpiece 316 would be periodic with every revolution of the workpiece 316 and would tend to create uneven abrasion patterns on the abraded surface of an expensive workpiece such as a semiconductor wafer, especially when the workpiece 316 is rotated at the high rotational speeds used for high speed lapping or polishing of workpieces 316.

The roller idlers 312 can have a cylindrical peripheral surface 280 or other surface shapes including a "spherical" hour-glass type shape and can have low-friction roller bearings 314 or air bearings 314 and roller idler 312 seals 310 shape and can have low-friction roller bearings 314 or air bearings 314 and roller idler 312 seals 310. The roller idler 312 seals 310 prevent contamination of the low-friction roller bearings 314 or air bearings 314 by abrading debris or coolant water or other fluids or materials that are used in the abrading procedures. The air bearings 314 can provide zero friction and can rotate at very high speeds when the workpiece carrier rotor 308 is rotated at speeds of 3,000 rpm or more that are typically used in high speed flat lapping. Because the diameters of the roller idlers 312 are typically much smaller than the diameters of the workpiece carrier rotors 308 the roller idlers 312 typically have rotational speeds that are much greater than the rotational speeds of the workpiece carrier rotors 308.

Pressurized air or another fluid such as water 296 is supplied through the hollow drive shaft 298 that has a fluid passage 290 that allows pressurized air or another fluid such as water 296 to fill the sealed chamber 284 that is formed by the sealed flexible bellows device 282 that has flexible annular-disk pleats. This controlled fluid 296 pressure is present in the sealed chamber 284 to provide uniform abrading pressure 306 across the flexible full flat top surface 244 portion of the flexible carrier rotor 308 where uniform abrading pressure 306 pressure is directly transferred to the workpiece 316 abraded surface 320 that is in abrading contact with the abrasive 324 coating on the rotary platen 322.

The bellows device 282 annular-disk pleats that are joined together at their inside-diameter and outside-diameter peripheral edges allow the bellows device 282 to act as a spring device which can flex vertically with little friction and to have small deflection stiffness in a vertical direction but provides substantial stiffness in a horizontal direction. However, the horizontal-direction stiffness of the bellows device 282 annular-disk pleats does allow a small amount of misalignment to occur between the rotation axis of the drive shaft 298 and the center of rotation of the workpiece carrier rotor 308. The bellows device 282 pleats are very stiff torsionally due to their near-flat mutually edge-joined annular-disk pleat-section members that are nominally horizontal which allows the bellows device 282 to have substantial tensional stiffness for driving the rotation of the workpiece carrier rotor 308. These types of lightweight bellows devices 282 are often used as zero-backlash but flexible shaft drives for machine tool devices.

The workpiece carrier rotor 308 and the flat-surfaced workpiece 316 such as a semiconductor wafer is allowed to be tilted from a horizontal position when they are stationary or rotated by the flexing action provided by the bellows devices 282 that can be operated at very high rotational speeds. The bellows device 282 pleats can be constructed from corrosion-resistant metals such as stainless steel or from polymers such as polyester.

When the flat-surfaced workpiece 316 and the workpiece carrier rotor 308 are subjected to abrading friction forces that are parallel to the abraded surface 320 of the workpieces 316, these abrading friction forces are resisted by the workpiece carrier rotor 308 as it contacts the multiple idlers 312 that are located around the outer periphery of the workpiece carrier rotor 308. The circular drive plate 286 has an outer periphery 278 spherical shape which allows the workpiece carrier rotor 308 outer periphery 278 to remain in contact with the cylindrical-surfaced roller idlers 312 when the rotating carrier rotor 308 is tilted where the stationary-position surfaced roller idlers 312 that are spaced around the outer periphery of the workpiece carrier rotor 308 act together as a centering device that controls the center of rotation of the workpiece carrier rotor 308 as it rotates.

The circular drive plate 286 outer periphery 278 spherical shape provides that the center of rotation of the workpiece carrier rotor 308 remains aligned with the rotational axis of drive shaft 298 when the workpiece carrier rotor 308 is tilted as it rotates. The workpiece carrier rotor 308 can be tilted due to numerous causes including: flat-surfaced workpiece 316 that have non-parallel opposed surfaces; misalignment of components of the stationary workpiece carrier head 293; misalignment of other components of the abrading machine (not shown); a platen 322 that has an abrading surface 317 that is not flat.

A flexible annular band 229 that is impervious to water, abrading fluids and abrading debris that is preferably constructed from a flexible elastomer or polymer material is attached to the circular drive plate 286 and to the workpiece rotor 308 and which surrounds the outer diameter of the bellows device 282 pleats during to prevent contamination of the bellows device 282 pleats during the abrading procedures.

Multiple the flexible bellows devices 304 can be used in addition to the flexible bellows device 282 where independent sealed pressure chambers 302 can formed that have annular or circular shapes. Independent fluid pressure 285 sources can supply fluid pressure 285 from the hollow drive shaft 298 to flexible or rigid fluid tubes 288 or passageways (not shown) within the circular drive plate 286 to apply these independent pressures 285 to the independent portions of the workpiece carrier rotor 308 central flexible bottom portion 323. These independent fluid pressure 285 zones that are located in the independent fluid chambers 284, 302 provide localized out-of-plane distortion of the workpiece carrier rotor 308 central flexible bottom portion 323 to provide independently-controlled abrading pressure to localized portions of the abraded surface 320 of the workpieces 316.

Figure 12:
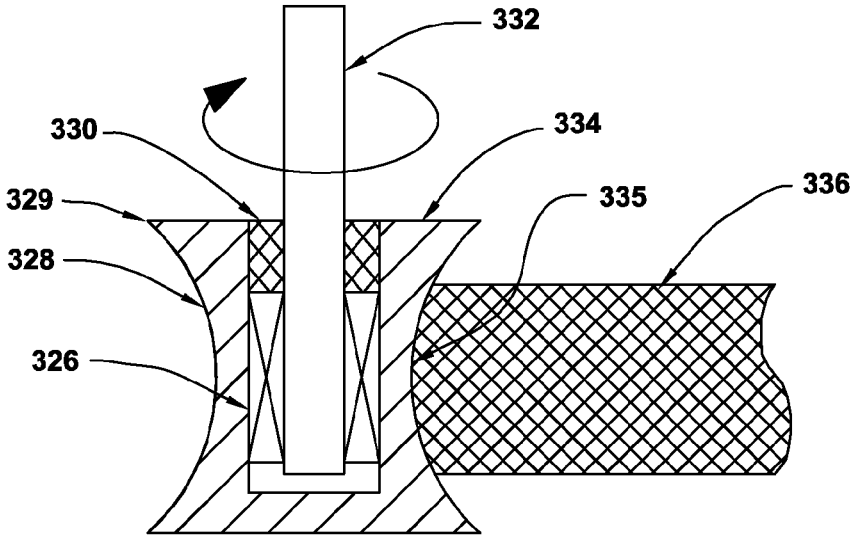
FIG. 12 is a cross section view of a floating workpiece carrier supported laterally by idlers.

FIG. 12 is a cross section view of a floating workpiece carrier having a spherical surface that is supported laterally by idlers having a matching spherical surface. A floating workpiece carrier rotor 336 that has an outer periphery 335 that has a spherical shape which allows the rotating workpiece carrier rotor 336 outer periphery 335 to remain in contact with stationary roller idlers 334 that have a matching spherical shape 328 when the rotating carrier rotor 336 is tilted. The rotatable stationary roller idlers 334 have a vertical stationary support shaft 332 that supports idler roller bearings 326 or air bearings 326 that support the idler 334 idler shell 329 where the stationary spherical-shaped idlers 334 support the carrier rotor 336 in a horizontal direction but allow the rotating carrier rotor 336 to be tilted.

Figure 19:
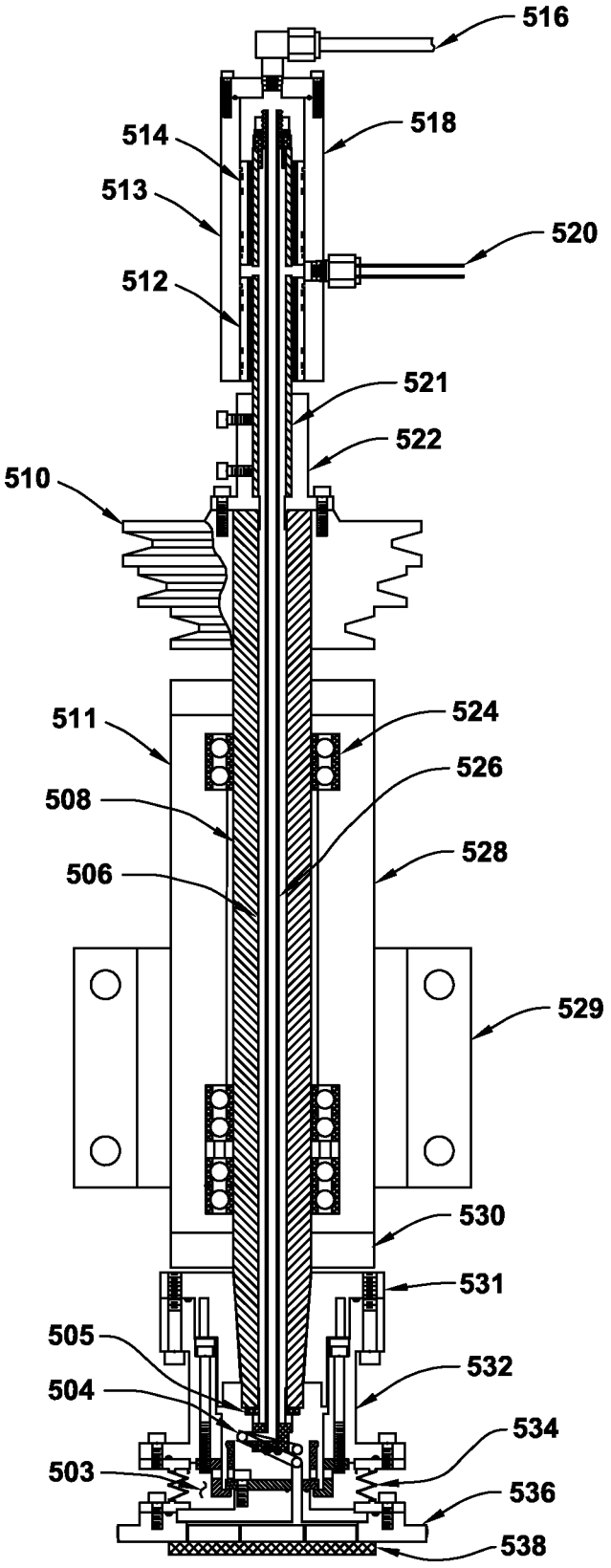
FIG. 19 is a cross section view of a bellows workpiece carrier supported by a driven spindle.

FIG. 19 is a cross section view of a bellows-type floating workpiece carrier that is supported by a driven spindle. The workpiece rotor 536 has an outer diameter having a spherical-shaped surface that is supported laterally (horizontally) by idlers (not shown). The workpiece rotor 536 has a vacuum-attached workpiece 538 and the rotor 536 is attached to a rotary workpiece carrier housing 532 by a drive-bellows device 534 that flexes in a vertical direction along the axis of the rotary spindle 511 rotary spindle shaft 508. The cylindrical cartridge-type spindle 511 that is supported by a clamp-type device 529 has a V-belt pulley 510 attached to the spindle shaft 508 where the spindle shaft 508 rotates the rotary carrier housing 532 and the flexible bellows 534 that is attached to the spindle drive shaft 508. The spindle 511 v-belt pulley 510 is driven by a drive motor (not shown) and rotary drive torque is transmitted to the floating workpiece carrier rotor 536 by the flexible bellows device 534.

Vacuum is supplied to the spindle 511 at the stationary hollow tube 516 that is supported by the air bearing housing 518 where the vacuum applied at the vacuum tube 516 is routed through a hollow tube 526 to a pneumatic adapter device 505 which supplies vacuum through a flexible tube 504 to the floating workpiece carrier rotor 536 to attach the workpiece 538 to the carrier rotor 536. Air bearings 512, 514 are supported by an air bearing housing 513 which surround a precision-diameter hollow shaft 521 that is supported by a shaft mounting device 522 that is attached to the drive pulley 510. A gap space is present between the two axially mounted air bearings 512 and 514 to allow pressurized air supplied by the tubing 520 to enter radial port holes in the hollow air bearing shaft 521 to transmit the controlled-pressure air through the annular passage between the vacuum tube 526 and the spindle shaft 508 internal through-hole 506. The hollow shaft 521, the air bearings 512 and 514 and the air bearing housing 513 act together as a friction-free non-contacting high speed multi-port rotary union 518.

The pressurized air supplied by the tubing 520 is routed through the annular passageway to the pneumatic adapter device 505 where this pressurized air enters the sealed bellows chamber 503 to provide abrading pressure which forces the workpiece 538 against an abrasive surface (not shown) on a rotary platen (not shown). When air pressure is applied to the bellows chamber 503, the flexible bellows device 534 is flexed downward to move the workpiece 538 downward in a vertical direction along the rotation axis of the rotary spindle 511 rotary spindle shaft 508 that is supported be bearings 524 attached to the spindle housing 528. Vacuum can also be applied at the tubing 520 to develop a negative pressure in the sealed bellows chamber 503 to collapse the bellows device 534 in a vertical direction to raise the workpiece 538 away from abrading contact with the platen abrasive surface.

The spindle 511 is shown as a cartridge-type spindle which is a standard commercially available unit that can be provided by a number of vendors including GMN USA of Farmington, Conn. A rectangular block-type spindle 511 having the same spindle moving components can also be provided by a number of vendors including Gilman USA of Grafton, Wis. The spindles 511 can be belt driven units or they can have integral drive motors. Spindles 511 can have flat-surfaced moving spindle end plate 530 or the spindle 511 can have drive shafts 508 with internal or external tapered shaft ends that can be used to attach the floating bellows workpiece carrier head 531.

An important fail-safe feature of this floating bellows workpiece carrier head 531 is that it can be operated at high rotational speeds exceeding 3,000 rpm without danger even in the event of failure of supporting components such as the bellows device 534 or the workpiece rotor 536 outer diameter lateral (horizontal) by supporting idlers. In the event of failure of these devices, all of the moving internal components of the carrier head 531 are contained within the structurally robust rotary carrier housing 532. Because the internal structural components of the workpiece carrier head 531 are constructed with intentional small gap spaces between adjacent components, these components would shift radially these small gap distances before they become restrained from further radial motion as the workpiece carrier head 531 is rotated at low or high speeds. This slight off-set radial shifting of the components such as the workpiece carrier rotor 536 and the workpiece 538 will cause an unbalance of the rotating workpiece carrier head 531. This unbalance will result in a vibration of the rotating workpiece carrier head 531 which imposes dynamic forces on the spindle 511. However, the spindle 511 has a very robust structural design, as shown by the use of multiple spindle shaft 508 rotary bearings 524, and the spindle 511 is easily suitable to sustain these rotating workpiece carrier head 531 vibrations that will diminish rapidly as the spindle speed is diminished by emergency-stop dynamic braking of the spindle 511 drive motor.

The small gaps between the internal components of the workpiece carrier head 531 are jus large enough to allow the free-floatation of the bellows device 534 workpiece carrier rotor 536 and the workpiece 538 but are small enough that large vibrations will not be caused in the remote-occurrence event of failure of the components of the floating workpiece carrier head 531.

Figure 20:
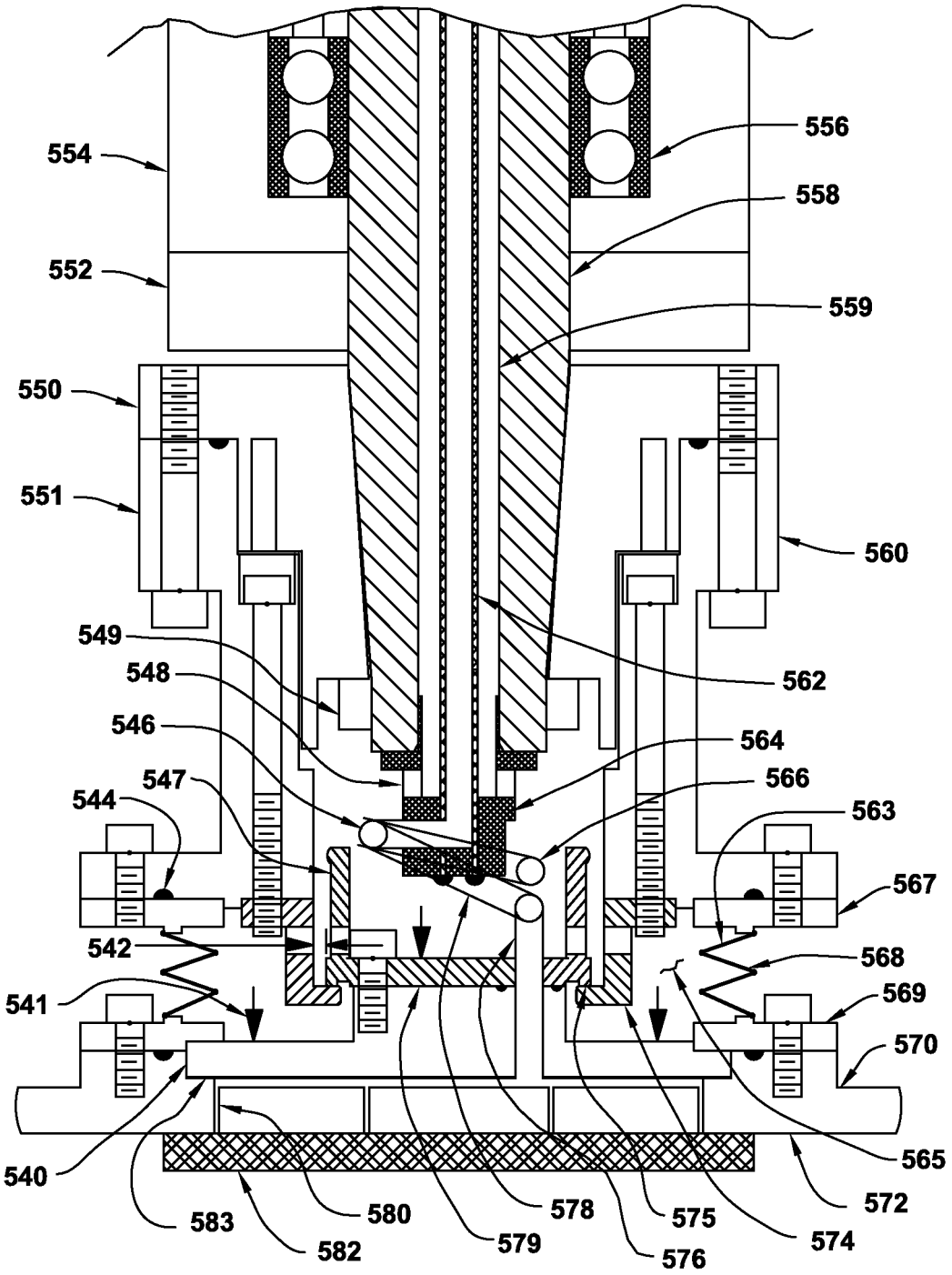
FIG. 20 is a cross section view of a bellows floating workpiece carrier restrained vertically.

FIG. 20 is a cross section view of a bellows-type floating workpiece carrier that is restrained vertically.

The workpiece rotor 570 has an outer diameter having a spherical-shaped surface that is supported laterally (horizontally) by idlers (not shown). The workpiece rotor 570 having a precision-flat workpiece mounting surface 572 has a vacuum-attached workpiece 582 and the rotor 570 is attached to a rotary workpiece carrier housing 560 by a drive-bellows device 568 that flexes in a vertical direction along the axis of the rotary spindle 554 rotary spindle shaft 558. The precision-flat workpiece mounting surface 572 is typically flat to within 0.0001 inches but the flatness of the surface 572 can range from 0.005 inches to 0.00001 inches across the full area of the surface 572.

Controlled-pressurized air is routed through the annular passageway between the metal or polymer vacuum tube 562 and the spindle shaft 558 internal through-hole 559 to the pneumatic adapter device 564 where this pressurized air enters the sealed bellows chamber 565 to provide abrading pressure which forces the workpiece 582 against an abrasive surface (not shown) on a rotary platen (not shown). When air pressure is applied to the bellows chamber 565, the flexible bellows device 568 is flexed downward to move the workpiece 582 downward in a vertical direction along the rotation axis of the rotary spindle 554 rotary spindle shaft 558 that is supported by the bearings 556 attached to the spindle 554.

Vacuum can also be applied within the annular passageway between the metal or polymer vacuum tube 562 and the spindle shaft 558 internal through-hole 559 to develop a negative pressure in the sealed bellows chamber 565 to collapse the bellows device 568 in a vertical direction to raise the workpiece 582 away from abrading contact with the platen abrasive surface. The spindle 554 has a moving spindle end plate 552.

The cylindrical spindle 554 spindle shaft 558 shown here has an attached housing 550 which is attached to the end of the spindle shaft 558 with a threaded nut 549. Other rotary spindles 554 can have different spindle 554 shapes and configurations such as a block-type spindle (not shown) and different configuration spindle shaft 558 attached housings 550 such as flange-type housings 550 that are an integral part of the spindle shaft 558.

The flexible bellows device 568 has an upper attached annular flange 567 and an lower attached flange 569 where the bellows device 568 has individual flexible annular bellows leaves 563 that are joined or formed together at the bellows annular leaves 563 inner and outer diameters to form the flexible bellows device 568. Here, the uppermost and lowermost individual bellows leaves 563 are attached respectfully to the upper attached annular flange 567 and the lower attached flange 569. The bellows leaves 563 can be constructed from polymer materials or can be constructed from metal materials comprising corrosion resistant materials such as brass or stainless steel or metal materials that are coated or plated. A preferred method to annular-edge join the metal bellows leaves 563 is to weld them together but bellows leaves 563 can also be joined together with high-strength adhesives. Welded bellows devices 568 can be supplied by the BellowsTech company of Ormond Beach, Fla. The bellows 568 upper annular flange 567 is attached to the annular housing 560 that is attached to the tapered-shaft flange-type housings 550 having an o-ring seal 544 where o-ring seals 544 are used throughout the floating workpiece carrier head 551 as required to create the sealed bellows chamber 565. The bellows 568 lower annular flange 569 is attached to the workpiece rotor 570.

The thickness of the nominally-flat annular bellows device 568 individual leaves 563 can range from 0.001 inches to 0.050 inches and the radial width of the -flat annular bellows 568 leaves 563 can range from 0.10 inches to 1.5 inches or more and the overall diameter of the bellows device 568 can range from 0.5 inches to 20 inches or more and the number of individual annular bellows leaves 563 can range from 1 to 20 or more. The bellows leaves 563 are designed to transmit the spindle 554 drive torque with internal material stress that allow infinite rotational life of the bellows device 568 and the number of bellows leaves 563 are selected to provide low-flex spring constants in an vertical direction along the rotational axis of the spindle shaft 558. The bellows device 568 low-flex spring constants in a vertical direction along the rotational axis of the spindle shaft 558 can range from 1 lb per lineal inch of vertical displacement travel to 100 lbs per lineal inch of vertical displacement travel or more, depending on the nominal diameter of the floating workpiece carrier head 551. The bellows device 568 can also be formed as a continuous member such as a hydro-formed bellows device 568 or a metal-plated bellows device 568. Each workpiece flexible carrier head 551 typically is designed to be used for a limited range of workpiece 582 diameter sizes where the workpieces such as semiconductor wafers may range in size from 1 inch to 12 inches (300 mm) or even 18 inch (450 mm) diameters.

The workpiece 582 is attached with vacuum or by water-wetted adhesion or by low-tack adhesives to the workpiece rotor 570 flat mounting surface 572. Vacuum is supplied through vacuum passageways 580 that are present in the workpiece rotor 570 which is attached to a rotor top-plate 540 that can be attached with adhesive 583 to the rotor 570 to provide maximum structural stiffness to the workpiece rotor 570. The rotor top-plate 540 has a vacuum pipe fitting 576 which supports a flexile coil-segment polymer, nylon, or polyurethane tube 578 which is also attached to the pneumatic adapter device 564 vacuum pipe fitting 546 which is connected to the spindle shaft 558 vacuum tube 562. The travelling end of the flexile polymer tube 578 is shown in a "down" position and is also shown in an "up" position 566 where the tube 578 flexes along the axis of the spindle shaft 558 as the bellows device 568 is flexed along the axis of the spindle shaft 558.

The flexile polymer tube 578 also flexes in a radial direction perpendicular to the axis of the spindle shaft 558 as the workpiece flexible carrier head 551 typically is rotated at high speeds. All of the structural stresses in the flexile polymer tube 578 caused by the limited-motion axial and radial flexing of the flexile polymer tube 578 are very low which provides long fatigue lives to the tubing during the abrading operation of the workpiece carrier head 551. The coiled segments of the flexile polymer tube 578 can be provided by cutting out segments from standard coiled-polymer tubing that is in common use or the coiled segments of the flexile polymer tube 578 can be provided by the FreelinWade company of McMinnville, Oreg.

Use of the coiled polymer tubing 578 eliminates the use of nominally straight segments of flexible hollow tubing and the associated use of the required sealed tube-end holder apparatus (shown in FIGS. 5 through 8, items 160 and 162) where the tubing has to slide in the sealed tube-end holder apparatus each time that the bellows device 568 is flexed along the axis of the spindle shaft 558. Maintenance of the vacuum seal in the vacuum tubing seal device is eliminated.

Pressurized air enters the sealed bellows chamber 565 through the pneumatic adapter device 564 that has open passageways 548 to provide abrading pressure forces 541 that act against the workpiece rotor 570 and the attached workpiece 582. to force it in a downward direction against a stop device. A displacement control device 579 has an annular wall 547 that acts in conjunction with the annular excursion control device 574 and the rotary workpiece carrier housing 560 to limit the lateral or horizontal excursion distance 542 of the workpiece rotor 570 relative to the rotary workpiece carrier housing 560 during the rotational abrading operation of the workpiece carrier head 551. The displacement control device 579 annular wall 547 limits the tilting of the workpiece rotor 570 relative to the rotary workpiece carrier housing 560 during the rotational abrading operation of the workpiece carrier head 551 when a workpiece 582 having non-parallel surfaces is abraded. When the workpiece rotor 570 moves more than the lateral or horizontal excursion distance 542 of the workpiece rotor 570 relative to the rotary workpiece carrier housing 560, the annular excursion control device 574 is contacted and the motion of the workpiece rotor 570 is fully restrained. The resultant rotary unbalance of the workpiece carrier head 551 caused by this off-set radial motion of the workpiece rotor 570 and the attached workpiece 582 is minimized by this small offset excursion distance 542. The small offset excursion distance 542 that is measured perpendicular to the axis of the spindle shaft 558 ranges from 0.005 inches to 0.250 inches where the preferred distance 542 is less than 0.030 inches.

When the pressurized air enters the sealed bellows chamber 565 to provide abrading pressure forces 541 that act against the workpiece rotor 570 and the attached workpiece 582, this pressure force 541 is distributed uniformly over the whole bottom area located on the upward face of the workpiece carrier rotor 570 that is contained within the bellows chamber 565. The pressure force 541 urges the workpiece carrier rotor 570 in a downward direction against a vertical stop device 574. This vertical stop device 574 also acts as an annular excursion control device 574. The workpiece carrier rotor 570 is shown stopped in a downward vertical direction where the displacement control device 579 contacts the vertical stop device 574 which limits the excursion of the workpiece carrier rotor 570 in a vertical direction.

Figure 21:
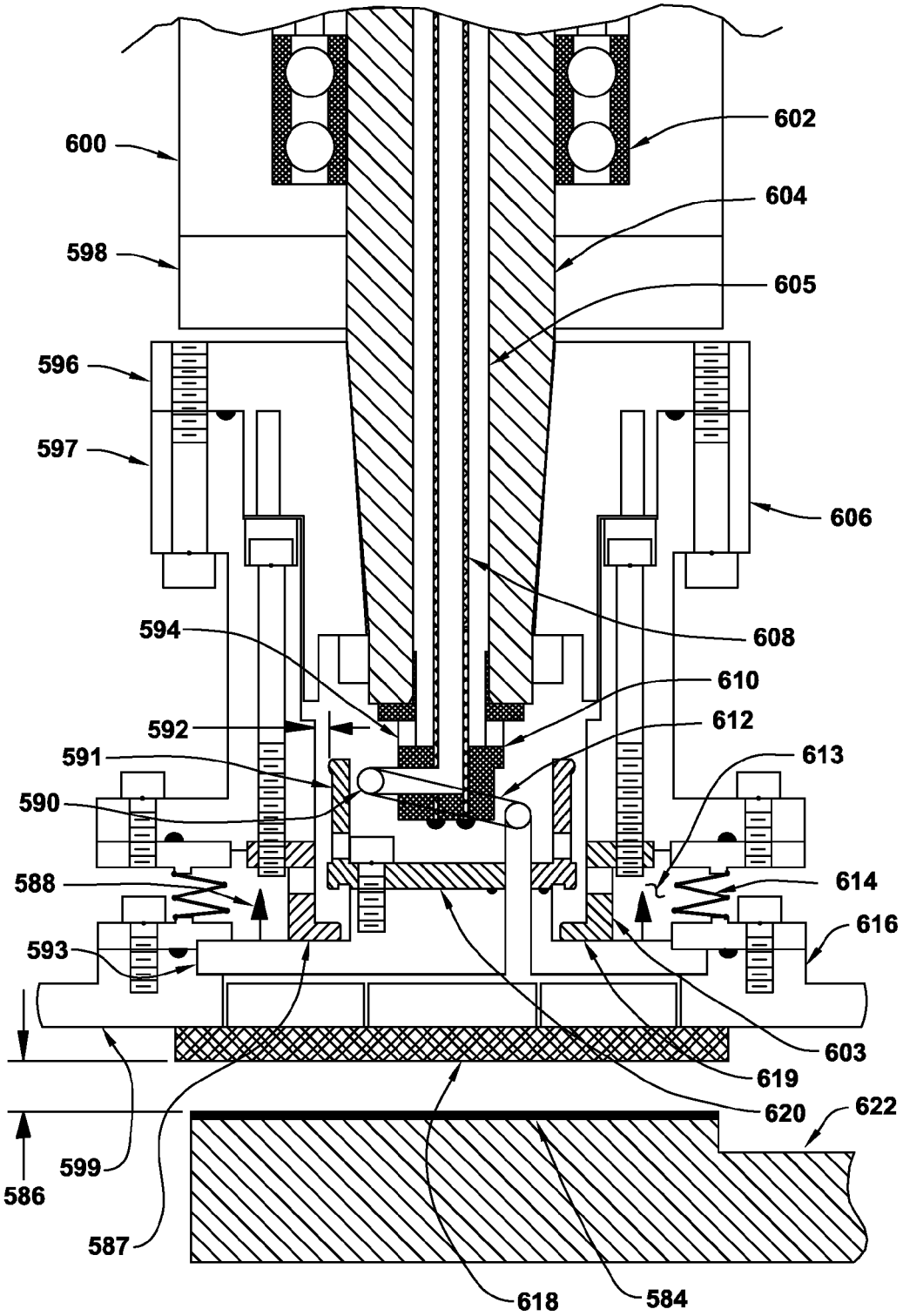
FIG. 21 is a cross section view of a bellows floating workpiece carrier raised from abrasive.

FIG. 21 is a cross section view of a bellows-type floating workpiece carrier that is raised away from an abrasive surface.

The cylindrical spindle 600 spindle shaft 604 is supported by bearings 602 where the spindle 600 has a rotatable end plate 598 and a spindle flange hub 596 is attached to the spindle 600. A rigid vacuum tube 608 is attached to a pneumatic adapter device 610 to provide vacuum to a flexible polymer tube 612 that is attached to a tube fitting 590 that is attached to the pneumatic adapter device 610. The flexible vacuum tube 612 is also attached to the workpiece rotor 616 to attach the workpiece 618 to the workpiece rotor 616. The pneumatic adapter device 610 has a port hole opening 594 to provide pressure or vacuum to the sealed bellows chamber 613.

Controlled-pressurized air, or vacuum, is routed through the annular passageway between the rigid metal or polymer vacuum tube 608 and the spindle shaft 604 internal through-hole 605 to the pneumatic adapter device 610 where this pressurized air enters the sealed bellows chamber 613 to provide abrading pressure which forces the workpiece 618 against an abrasive surface 584 on a rotary platen 622. When air pressure is applied to the bellows chamber 613, the flexible bellows device 614 is flexed downward to move the workpiece 618 downward in a vertical direction along the rotation axis of the rotary spindle 600 rotary spindle shaft 604 until and as the workpiece 618 contacts the abrasive 584.

Vacuum can also be applied within the annular passageway between the metal or polymer vacuum tube 608 and the spindle shaft 604 internal through-hole 605 to develop a negative pressure in the sealed bellows chamber 613 to collapse the bellows device 614 in a vertical direction to raise the workpiece 618 away from abrading contact with the platen 622 abrasive surface 584. The workpiece 618 is drawn up a distance 586 from the abrasive 584 surface. The separation distance 586 can range from 0.010 inches to 0.500 inches or more. The workpiece 618 can be drawn up rapidly because vacuum can be applied rapidly in the bellows 614 chamber 613 with the use of a vacuum surge tank (not shown) that supplies vacuum with the use of an electrically-activated solenoid valve (not shown).

Because the vacuum provides a negative pressure that typically exceeds 10 lbs per square inch and the workpiece rotor 616 has a surface area that typically exceeds 10 square inches, the vacuum force 588 that raises the workpiece rotor 616 and workpiece 618 can easily exceed 100 lbs for even a small-sized workpiece rotor 616 that has a diameter of only 4 inches. At any time that it is desired to quickly raise the workpiece 618 away from abrading contact with the abrasive 584, the vacuum can be quickly applied to the bellows 614 chamber 613 by a control system that activates solenoid valves that regulate the pressure and vacuum in the bellows 614 chamber 613.

A tilting control device 620 annular wall 591 shown here acts in conjunction with the rotary workpiece carrier housing 606 to limit the tilting of the workpiece rotor 616 relative to the rotary workpiece carrier housing 606 during the rotational abrading operation of the floating workpiece carrier head 597 to a specified amount when a workpiece 618 having non-parallel surfaces is abraded. When the workpiece rotor 616 tilts and reduces the distance 592 more than the original lateral or horizontal excursion distance 592 of the workpiece rotor 616 relative to the rotary workpiece carrier housing 606, the annular tilting control device 620 wall 591 contacts the rotary workpiece carrier housing 606. Here, further tilting of the workpiece rotor 616 is fully prevented and the specified and allowable tilt angle of the workpiece rotor 616 is not exceeded. The gap distance 582 of the tilting control device 620 annular wall 591 can be used to limit the sideways lateral or horizontal excursion motion of the workpiece rotor 616 in addition to limiting the tilting of the nominally-horizontal workpiece rotor 616 through a tilt angle that is measured from the precision-flat workpiece mounting surface 599 of the workpiece rotor 616 relative to a horizontal plane.

The rotatable workpiece carrier plate 616 that is supported by the flexible rotatable bellows spring device 614 can be tilted over a selected tilt-excursion angle that ranges from 0.1 degrees to a maximum of 30 degrees until selected structural components such as the tilting control device 620 annular wall 591 that are attached to the rotatable workpiece rotor carrier plate 616 contacts the rotary workpiece carrier housing 606 to limit the tilting of the workpiece rotor 616. The preferred range of the tilt-excursion angle ranges from 5 degrees to a maximum of 15 degrees. The cylindrical spindle 600 spindle shaft 604 is supported by bearings 602 where the spindle 600 has a rotatable end plate 598 and a spindle flange hub 596 is attached to the spindle 600.

The floating workpiece carrier head 597 can also be converted to a rigid non-floating workpiece carrier head 597 by simply applying vacuum to the sealed bellows chamber 613 to develop a negative pressure in the sealed bellows chamber 613 to collapse the bellows device 614 in a upward vertical direction. Here the workpiece rotor 616 and the adhesively attached rotor top-plate 593 is forced by the vacuum upward against the annular excursion control device 603 at the annular contact area 587, 619 which forced-contact action converts the floating workpiece carrier head 597 to a rigid non-floating workpiece carrier head 597. A configuration option here is for the contact area 587, 619 to be configured to provide three-point flat-surfaced or three-point spherical debris self-cleaning surfaces of contact rather than the annular continuous flat-surfaced contact area 587, 619, as shown. The components of the floating workpiece carrier head 597 can be designed and manufactured where the precision-flat workpiece mounting surface 599 of the workpiece rotor 616 is precisely perpendicular to the rotation axis of the rotary spindle 600 rotary spindle shaft 604. This rigid non-floating workpiece carrier head 597 can be used to abrade opposed flat surfaces on workpieces 618 that are precisely parallel to each other.

Figure 22:
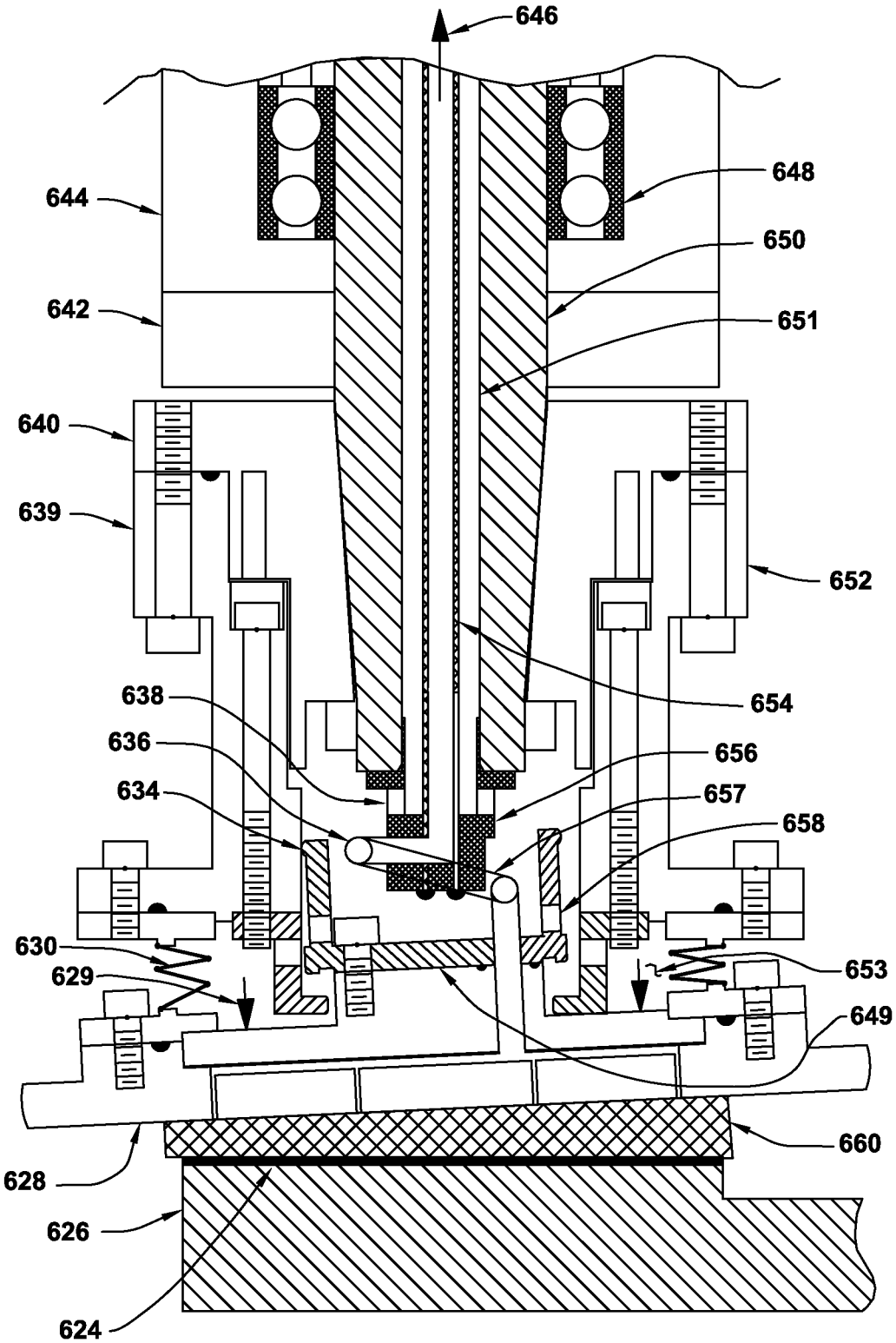
FIG. 22 is a cross section view of a bellows workpiece carrier that is tilted by a workpiece.

FIG. 22 is a cross section view of a bellows-type floating workpiece carrier that is tilted by a workpiece having non-parallel surfaces.

The cylindrical spindle 644 spindle shaft 650 is supported by bearings 648 where the spindle 644 has a rotatable end plate 642 and a spindle flange hub 640 is attached to the spindle 644 spindle shaft 650. A rigid vacuum tube 654 is attached to a pneumatic adapter device 656 to provide vacuum 646 to a flexible polymer tube 657 that is attached to a tube fitting 636 that is attached to the pneumatic adapter device 656. The flexible vacuum tube 657 is also attached to the floating workpiece rotor 628 to attach the workpiece 660 having non-parallel surfaces to the workpiece rotor 628. The pneumatic adapter device 656 has a port-hole opening 638 to provide pressure or vacuum to the sealed bellows chamber 653.

Controlled-pressurized air is routed through the annular passageway between the rigid metal or polymer vacuum tube 654 and the spindle shaft 650 internal through-hole 651 to the pneumatic adapter device 656 where this pressurized air enters the sealed bellows chamber 653 to provide abrading pressure 629 which forces the non-parallel surfaced workpiece 660 against an abrasive surface 624 on a rotary platen 626. When air pressure is applied to the bellows chamber 653, the flexible bellows device 630 is flexed downward to move the workpiece 660 downward in a vertical direction along the rotation axis of the rotary spindle 644 rotary spindle shaft 650 until and as the workpiece 660 contacts the abrasive 624. Here the non-parallel surfaced workpiece 660 that is held in flat-faced contact with the flat abrasive surface 624 causes the workpiece rotor 628 to tilt.

A tilting control device 649 annular wall 634 shown here acts in conjunction with the rotary workpiece carrier housing 652 to limit the tilting of the workpiece rotor 628 relative to the rotary workpiece carrier housing 652 during the rotational abrading operation of the workpiece carrier head 639 to a specified amount when a workpiece 660 having non-parallel surfaces is abraded. When the workpiece rotor 628 tilts, the annular tilting control device 649 annular wall 634 contacts the rotary workpiece carrier housing 652 at the contact point 634. Here, additional tilting of the workpiece rotor 628 is fully prevented and the specified and allowable tilt angle of the workpiece rotor 628 is not exceeded.

All of the component parts of the floating workpiece carrier head 639 are designed and manufactured to be robust and structurally strong so that they easily resist the abrading forces that are applied to the floating workpiece carrier head 639 during abrading operations. These components are all manufactured from materials that resist the coolant water, CMP fluids and the abrading debris that is present in these abrading and polishing operations. The floating workpiece carrier head 639 devices are particularly well suited for polishing semiconductor wafers and for back-grinding these wafers at very high abrading speeds compared to the very low speeds of convention abrading systems presently being used for these applications. Often, the abrading speeds and piece part productivity are increased by a factor of 10 with this floating workpiece carrier head 639 abrading system.

Figure 23:
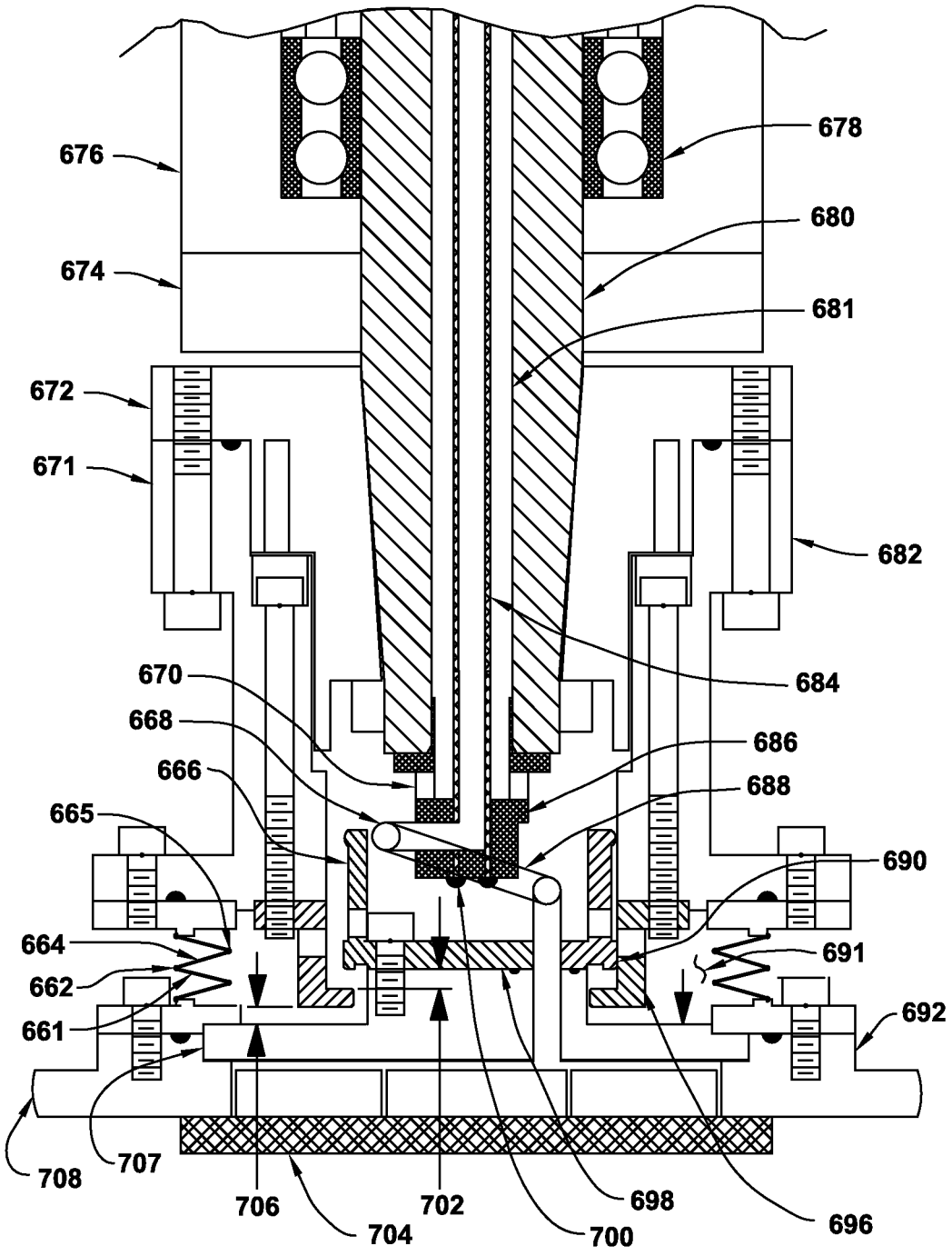
FIG. 23 is a cross section view of a bellows workpiece carrier free-floating in a location.

FIG. 23 is a cross section view of a bellows-type floating workpiece carrier that is positioned in a neutral free-floating location.

The cylindrical spindle 676 spindle shaft 680 is supported by bearings 678 where the spindle 676 has a rotatable end plate 674 and a spindle flange hub 672 is attached to the spindle 676 spindle shaft 680. A rigid vacuum tube 684 is attached to a pneumatic adapter device 686 to provide vacuum to a flexible circular-segment polymer tube 688 that is attached to a tube fitting 668 that is attached to the pneumatic adapter device 686. The flexible vacuum tube 688 is also attached to the floating workpiece rotor 692 to provide vacuum to attach the workpiece 704 to the workpiece rotor 692. The pneumatic adapter device 686 has a port-hole opening 670 to provide pressure or vacuum to the sealed bellows chamber 691.

Controlled-pressurized air is routed through the annular passageway between the rigid metal or polymer vacuum tube 684 and the spindle shaft 680 internal through-hole 681 to the pneumatic adapter device 686 where this pressurized air enters the sealed bellows chamber 691 to provide abrading pressure which forces the workpiece 704 against an abrasive surface (not shown) that is coated on a flat-surfaced rotary platen (not shown). When air pressure is applied to the bellows chamber 691, the flexible bellows device 664 is flexed downward to move the workpiece 704 downward in a vertical direction along the rotation axis of the rotary spindle 676 rotary spindle shaft 680 until, and as, the workpiece 704 contacts the flat abrasive surface.

A preferred method to annular-edge join the thin and flexible metal bellows 664 annular metal leaves 661 is to weld them together at the inner 665 and outer annular edges 662 of the bellows 664. The workpiece rotor 692 has a spherical-shaped outer diameter 708 that is contacted by stationary rotary idlers (not shown) that hold the rotating workpiece rotor 692 in place as the workpiece rotor 692 rotates.

There is a vertical upward excursion distance 706 where the workpiece rotor 692 and the workpiece 704 are free to travel or float up and down vertically before the workpiece rotor 692 and the adhesively attached rotor top-plate 707 is forced against the annular excursion control device 696. There is also a vertical downward excursion distance 702 where the workpiece rotor 692 and the workpiece 704 are free to travel or float vertically before the workpiece rotor 692, the adhesively attached rotor top-plate 707 and the attached combination translate and the vertical excursion control device 698 is forced vertically downward against the annular excursion control device 696. The vertical upward excursion distance 706 and the vertical downward excursion distance 702 together provide a total workpiece rotor 692 and the workpiece 704 vertical excursion travel distance that can range from 0.005 inches to a maximum of 0.750 inches where the preferred total vertical excursion distance ranges from 0.125 inches to a maximum of 0.375 inches.

A floating workpiece rotor 692 excursion control device 698 acts in conjunction with the rotary workpiece carrier housing 682 to limit the lateral or horizontal excursion of the workpiece rotor 692 and the workpiece 704 relative to the rotary workpiece carrier housing 682 during the rotational abrading operation of the workpiece carrier head 671. Here, the lateral, sideways or horizontal motion of the workpiece rotor 692 and the workpiece 704 is confined and restrained when the excursion control device 698 is forced horizontally against the annular excursion control device 696 at the contact point 690.

Figure 24:
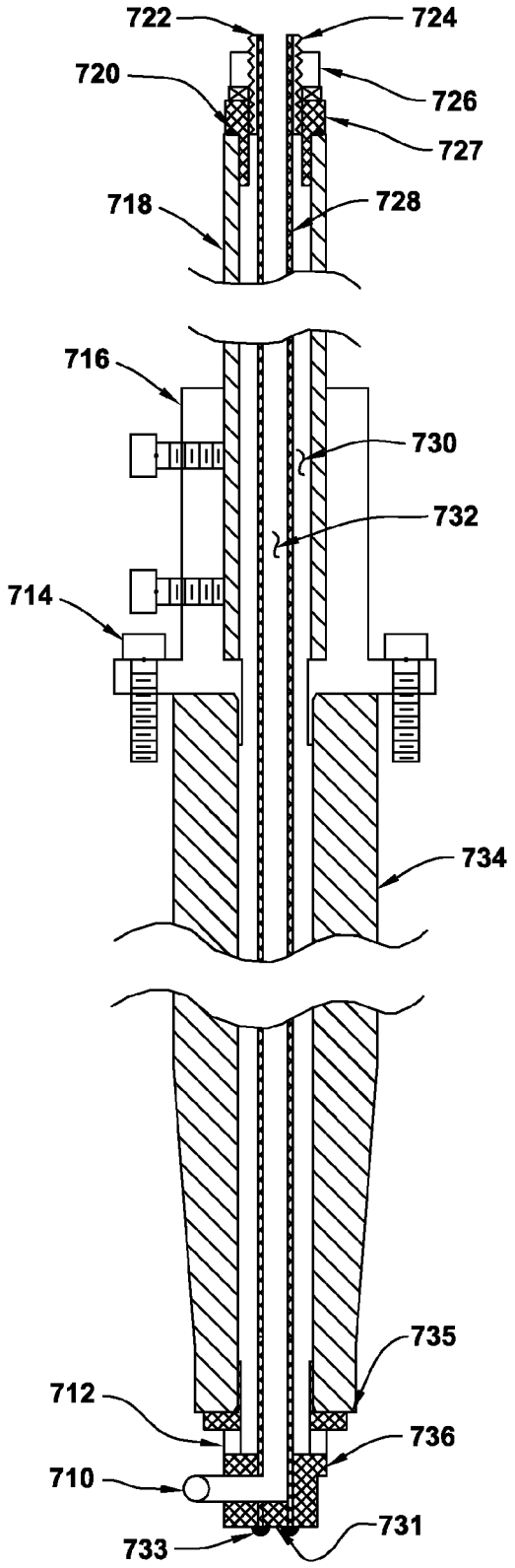
FIG. 24 is a cross section view of a spindle shaft and a high speed air bearing rotary union.

FIG. 24 is a cross section view of a spindle shaft and a high speed air bearing rotary union.

A cylindrical spindle shaft 734 has a pneumatic adapter device 736 that has a port-hole opening 712 that provides pressure or vacuum to a sealed floating workholder bellows chamber (not shown). The pneumatic adapter device 736 also is supplied vacuum through a rigid hollow metal tube 728 that is attached by welds 733 to the pneumatic adapter device 736 and where a plug 731 is used to seal the end of the metal tube 728.

The upper end of the vacuum tube 728 extends through the end of an end-cap device 727 that is centered in an air bearing hollow metal tube 718 that is supported by a circular bracket mount 716 which is attached to a spindle V-belt drive pulley (not shown) that is attached to a rotary spindle shaft (not shown) by fasteners 714. The end of the stiff metal vacuum tube 727 has a threaded hollow fastener 724 that is attached to the vacuum tube 728 with structural adhesives, by brazing or by silver-soldering the tube 728 and threaded hollow fastener 724 to be concentric with each other. A threaded nut 726 engages the threaded end of the hollow fastener 724 that is nominally flush with the upper free end of the vacuum tube 728. Here, the fastener nut 726 is tightened to create tension along the length of the vacuum tube 728 as the attached pneumatic adapter device 736 is butted against the spindle shaft end 734. An O-ring 720 is used to seal the joint between the end cap device 727 and the hollow air bearing tube 718.

Figure 25:
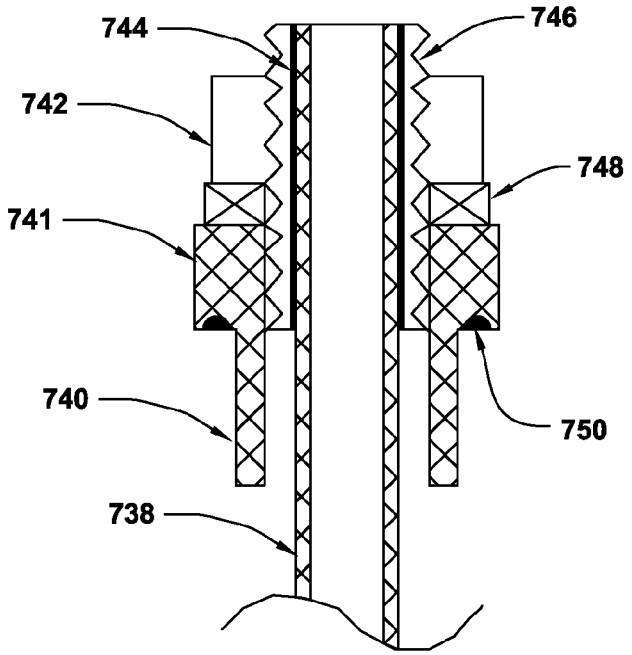
FIG. 25 is a cross section view of a spindle shaft vacuum tube end-cap device.

FIG. 25 is a cross section view of a spindle shaft vacuum tube end-cap device. The upper end of a metal vacuum tube 738 extends through the end of an end cap device 741. The end of the stiff metal vacuum tube 738 has a threaded hollow fastener 746 that is attached to the tube 738 with structural adhesives, by brazing or by silver-soldering 744 the tube 738 and threaded hollow fastener 746 together to be concentric with each other. A threaded nut 742 engages the threaded end of the hollow fastener 746 that is nominally flush with the upper free end of the vacuum tube 738. An O-ring 750 is used to seal the joint between the end cap device 741 and a hollow air bearing tube (not shown). A flexible Belleville spring washer or a convention metal or non-metal washer 748 can be positioned between the nut 742 and the end cap device 741.

Figure 26:
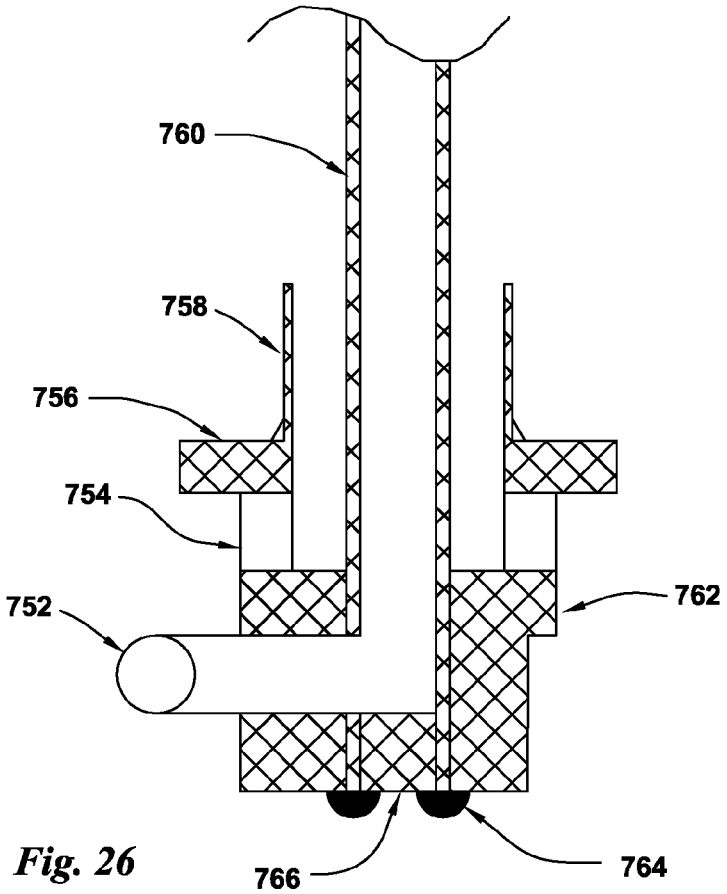
FIG. 26 is a cross section view of a spindle shaft vacuum tube pneumatic adapter device.

FIG. 26 is a cross section view of a spindle shaft vacuum tube pneumatic adapter device. A cylindrical spindle shaft (not shown) has a pneumatic adapter device 762 that has a port-hole opening 754 that provides pressure or vacuum to a sealed floating workholder bellows chamber (not shown) and a flat-surfaced annular edge 756. The pneumatic adapter device 762 also is supplied vacuum through a rigid hollow metal tube 760 that is attached by welds 764 to the pneumatic adapter device 762 and where a plug 766 is used to seal the end of the metal tube 760.

Figure 27:
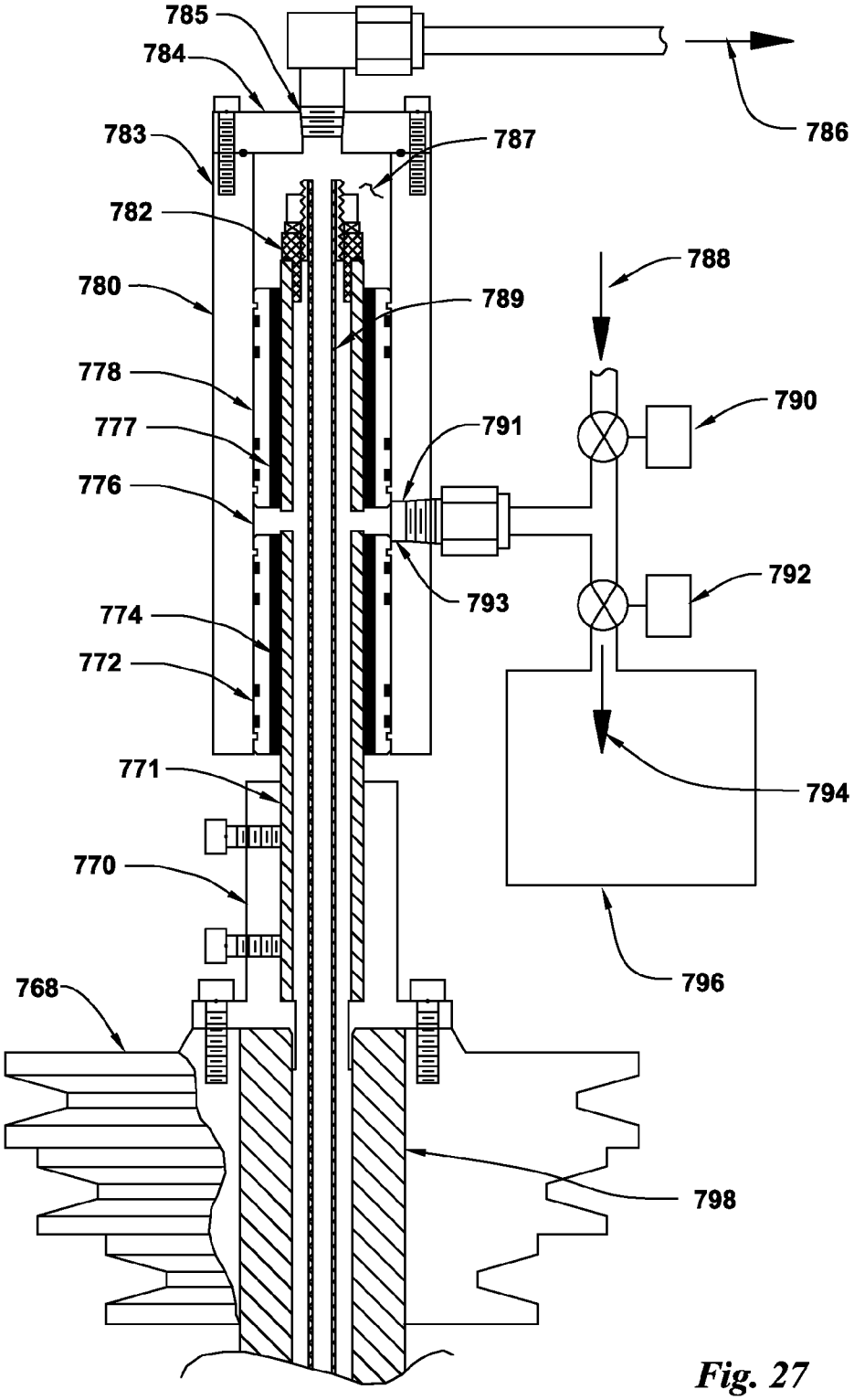
FIG. 27 is a cross section view of an air bearing fluid high speed rotary union device.

FIG. 27 is a cross section view of an air bearing fluid high speed rotary union device. A stationary vacuum and fluid rotary union device 783 is attached to a hollow rotatable carrier drive shaft 798 is a friction-free air-bearing rotary union that can be operated of very high rotational speeds that exceed 3,000 rpm for long periods of time. At least two cylindrical air bearing devices 778 have opposed cylindrical air bearing device ends where the at least two cylindrical air bearing devices 778 are positioned adjacent to each other longitudinally along the outside diameter of a cylindrical rotatable hollow air bearing shaft 771 having a cylindrical rotatable hollow air bearing shaft 771 open top end and having a cylindrical rotatable hollow air bearing shaft 771 open bottom end wherein the end of one cylindrical air bearing device 778 is positioned nominally adjacent to the cylindrical rotatable hollow air bearing shaft 771 open top end.

The cylindrical rotatable hollow air bearing shaft 771 open bottom end is attached to the hollow rotatable carrier drive shaft 798 where the cylindrical rotatable hollow air bearing shaft 771 is concentric with the hollow rotatable carrier drive shaft 798. Here, pressurized air is supplied to the at least two cylindrical air bearing devices 778 wherein an air film is formed between the at least two cylindrical air bearing devices 778 and the cylindrical rotatable hollow air bearing shaft 798. The cylindrical air bearing devices 778 can be mechanical devices with air grooves to provide the air-bearing air film effect or the cylindrical air bearing devices 778 can be air bearings that have porous carbon 777 to provide the air-bearing air film effect. An advantage of the porous carbon 777 cylindrical air bearing devices 778 is that the hollow rotatable carrier drive shaft 798 and the cylindrical rotatable hollow air bearing shaft 771 can be rotated at very slow rotation speeds without air pressure being applied to the stationary cylindrical air bearing devices 778 without damage to the porous carbon 777 cylindrical air bearing devices 778 occurring.

A stationary vacuum rotary union end-cap 784 is attached to a vacuum and fluid rotary union housing 780 that surrounds the at least two cylindrical air bearing devices 778 to form a sealed vacuum and fluid rotary union 783 housing 780 internal chamber 787 located at the cylindrical rotatable hollow air bearing shaft 771 open top end and where a vacuum port hole 785 extends through the vacuum rotary union end-cap 784 into the stationary vacuum and fluid rotary union 783 housing 780 internal chamber 787. The vacuum or fluid 786 supplied to the vacuum rotary union end-cap 784 vacuum port hole 785 is routed into the stationary vacuum and fluid rotary union housing 780 internal chamber 787 and is routed to the top open end of the hollow spindle shaft tube 789 that is positioned within the vacuum and fluid rotary union housing 780 internal chamber 787.

There are gap-spaces 776 between the ends of adjacent at least two cylindrical air bearing devices 778 positioned longitudinally along the outside diameter of the cylindrical rotatable hollow air bearing shaft 771 where at least one pressure port hole 793 extends radially through the cylindrical rotatable hollow air bearing shaft 771 at the location of the respective gap-spaces between respective two adjacent cylindrical air bearing devices 778. Pressure-entry port holes 791 extend radially through the vacuum and fluid rotary union housing 780 that surrounds the at least two cylindrical air bearing devices 778 at the locations of the respective gap-spaces 776 between respective two adjacent cylindrical air bearing devices 778.

Pressurized air 788 and vacuum 794 supplied to respective pressure-entry port holes 791 that extend radially through the vacuum and fluid rotary union housing 780 is routed into the at least one pressure port hole 793 extending radially through the cylindrical rotatable hollow air bearing shaft 771 and i) is routed into the gap-spaces 776 between the ends of adjacent at least two cylindrical air bearing devices 778 and is routed into a respective annular space gap-space passageway between the hollow spindle shaft tube 789 and the cylindrical rotatable hollow air bearing shaft 771 where it is routed into the annular gap between the hollow spindle shaft tube 789 and the hollow rotatable carrier drive shaft 798 hollow opening and into the sealed enclosed bellows pressure chambers (not shown) or ii) is routed into respective tubes or passageways (not shown) that are connected with multiple respective sealed enclosed bellows (not shown) pressure chambers (not shown) that are located in the abrading machine workpiece substrate carrier apparatus (not shown).

Vacuum 794 can be supplied through the annular gap between the hollow spindle shaft tube 789 and the carrier drive shaft 798 hollow opening to contract the rotatable bellows spring device in a vertical direction from a substantial-volume vacuum surge tank 796 that is located nominally near the abrading machine workpiece substrate carrier apparatus. Here, a substantial amount of controlled vacuum 794 is quickly applied to the sealed enclosed bellows pressure chamber wherein the controlled vacuum negative pressure acts on the rotatable workpiece carrier plate top surface and compresses the rotatable bellows spring device which is flexed upward in a vertical direction. The rotatable workpiece carrier plate and the workpiece attached to the rotatable workpiece carrier plate can be quickly raised away from the rotatable abrading platen abrading surface. The selection of vacuum 794 or pressurized air 788 being directed into the pressure port hole 793 is controlled respectively by the solenoid vales 792 and 790.

If desired, leaks in the bellows chamber or cracks in the bellows device can be detected by monitoring the flow of pressurized air into the bellows chamber. If a bellows leak occurs, there will be a steady-state increase flow of air into the chamber that is required to make up for the air that escapes from the localized leak that exists in the defective, fractured or damaged bellows device. Use of an air or fluid flow-rate monitoring sensor device that senses unusual increased pressurized air flow rates that exceed normal air leakage rates that exist in the sealed bellows chamber can be used as an indicator of impending failure of the flexible pleated bellows device.

During the typical operation of the floating bellows workpiece carrier device, the air flow of the pressurized air into the sealed bellows chamber will change during the abrading procedure. The air flow rate will change as the bellows expands or contracts in a vertical direction along the rotary axis of the workpiece carrier spindle drive shaft. However, during an abrading procedure, after the initial abrading contact of the workpiece with the platen abrasive, there is very little air flow into the sealed bellows chamber. The amount of air flow rate that typically exists is to provide make-up air for the leakage of air thought the bellows chamber sealed joints can be determined and used as a set-point reference by an air flow-rate monitoring and control system. When the air flow rates into the sealed bellows chamber exceeds this established-reference normalized air flow rates, the air flow rate monitoring system can be used to provide warning that new or larger leaks exist. Here, the abrading procedure operator can then investigate these excessive leaks and determine if corrective maintenance action is required.

Fatigue cracks in the flexed individual bellows leaves or in the weld joints of the flexible bellows typically will become larger over some failure-mode period of time. During the first portion of this failure-mode period of time, the somewhat weakened bellows device would still retain its ability to provide the required motor drive torque to the rotating workpiece. Also, the selected abrading air pressure that is applied to the near-sealed bellows chamber will be maintained at the desired selected pressure level by the make-up air that is supplied by the air pressure regulator device that supplies the pressurized air to the near-sealed bellows pressure chamber. Abrasive lapping or polishing of workpieces would be performed as desired during the abrading procedure even though there is a small air leak in the bellows pressure chamber during this period of time.

If the existence of a fatigue crack or damage to a bellows device is not detected by periodic maintenance visual examinations of the bellows device or by indications from a pressurized air flow rate sensor system, the bellows fatigue crack or damage to the bellows could proceed to where the bellows would fracture. Damage to the bellows device could also occur if it were struck by a foreign object. This type of event is not likely to occur because these bellows devices are typically designed to be very robust for each application even though they provide great flexibility as a torque or position rotary drive mechanism. Also, these types of bellows drive devices are in common use in many industries as devices that have zero rotational back-lash characteristics for critical applications. They have widespread use in the machine-tool industry as rotary drive couplers.

Figure 28:
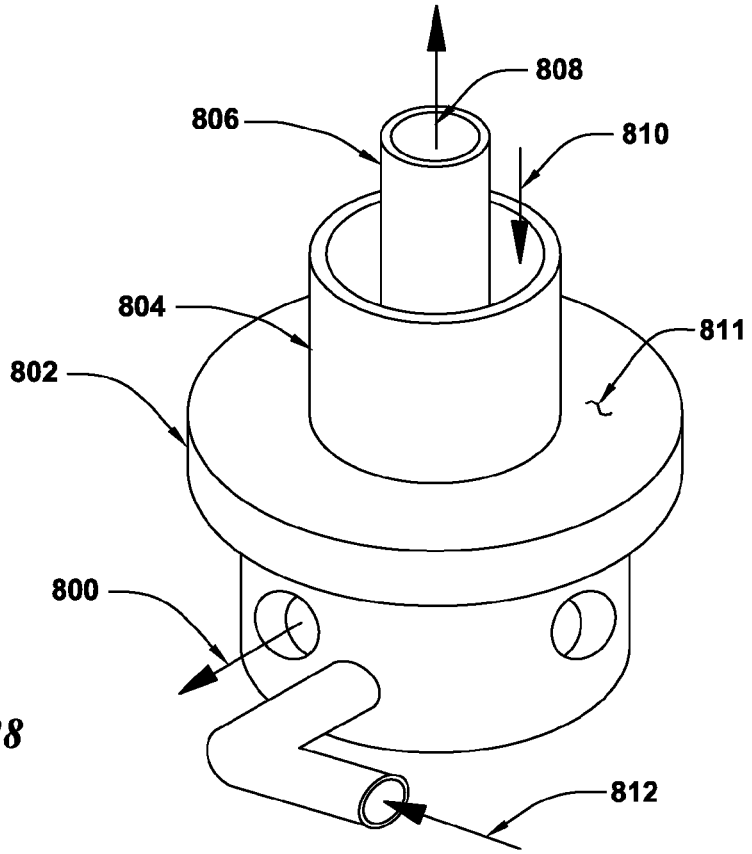
FIG. 28 is an isometric view of a spindle shaft vacuum tube pneumatic adapter device.

FIG. 28 is an isometric view of a spindle shaft vacuum tube pneumatic adapter device. A cylindrical spindle shaft (not shown) has a pneumatic adapter device 802 that has a port-hole opening 800 that provides supplied pressurized air 810 or vacuum to a sealed floating workholder bellows chamber (not shown) and a flat-surfaced annular edge 811. The pneumatic adapter device 802 also is supplied vacuum 808 through a rigid hollow metal tube 806 that is attached by welds or adhesives to the pneumatic adapter device 802 and where a plug (not shown) is used to seal the end of the metal tube 806. The pneumatic adapter device 802 has a thin-walled shoulder 804 that allows the pneumatic adapter device 802 to be concentrically centered with the hollow rotatable carrier drive shaft (not shown).

Figure 29:
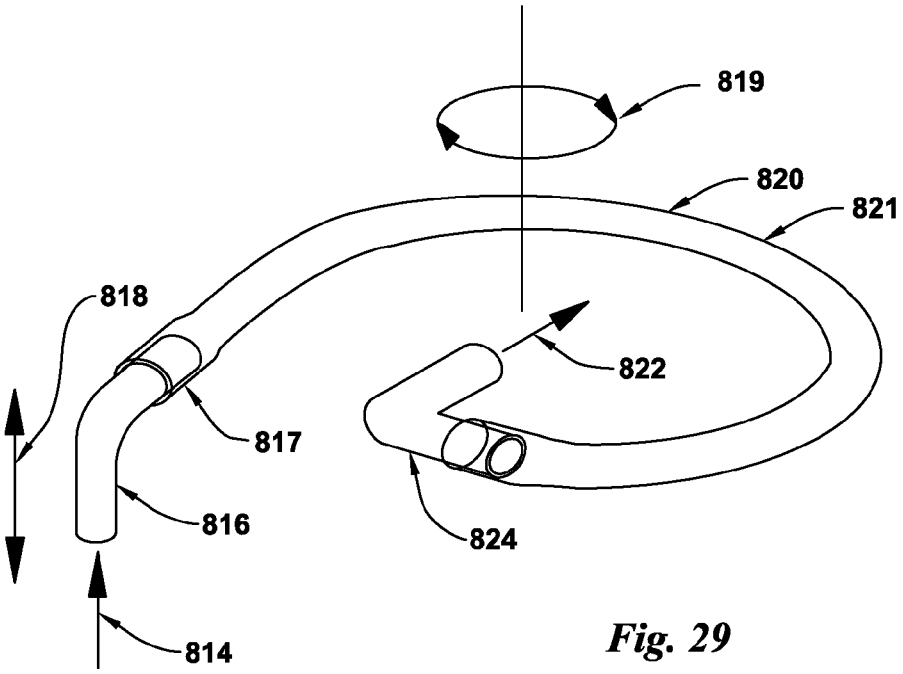
FIG. 29 is an isometric view of a hollow flexible fluid tube routed to a carrier rotor plate.

FIG. 29 is an isometric view of a hollow flexible fluid tube that is routed to fluid passageways that are connected to fluid port holes in the rotatable workpiece carrier plate. A hollow flexible fluid tube 820 that is routed to fluid passageways (not shown) that are connected to fluid port holes (not shown) in the rotatable workpiece carrier plate (not shown) flat bottom surface (not shown). The hollow flexible fluid tube 820 has a circular arc-segment shape 821 wherein the circular arc-segment 821 arc length ranges from 30 degrees to 720 degrees where the preferred circular arc-segment 821 arc length is approximately 270 degrees.

The hollow flexible fluid tube circular arc-segment 821 is located within the circumference and perimeter-envelope of the nominally-annular structural member (not shown) that is attached to the circular rotatable drive plate (not shown). Vacuum 822 is applied to the open end of a pneumatic-type fitting 824 that is attached to a pneumatic adapter device (not shown). The hollow flexible fluid tube circular arc-segment 821 has a connection joint 817 where it is attached to a pneumatic-type fitting 816 that is attached to the workpiece carrier head (not shown) where end of the hollow flexible fluid tube circular arc-segment 821 has an excursion travel 818 as the pneumatic-type fitting 816 moves with the free-floating workpiece carrier head.

The hollow flexible fluid tube 821 can be constructed from elastomeric materials including rubber or from polymer materials including nylon and polyurethane and can be constructed from metal or polymer bellows devices (not shown). The metal or polymer bellows device-type hollow flexible fluid tube 821 can have an internal elastomer material tube liner having a smooth internal tube-wall surface to avoid abrasive debris build-up within the bellows device annular-leaf crevices.

Also, the hollow flexible fluid tube circular arc-segment 821 can have different orientations including near-vertical orientations and the hollow flexible fluid tube 821 can have near-linear shapes as an alternative to the circular arc-segment shape. The amount of flexure excursion distance 818 is substantially small as compared with the overall length of the hollow flexible fluid tube circular arc-segment 821 with the result that the hollow flexible fluid tube circular arc-segment 821 has near-infinite fatigue life as it is flexed during long-term abrading operations.

When a floating bellows workholder is draw upward by vacuum in the bellow chamber to create a rigid workholder head, the floating head components can be supported by three rigid points that are evenly positioned in a circle to provide uniform solid support of the floating head. The large surface area that the vacuum is applied to provides a very large retaining force that is imposed upward to hold the workpiece holder head against the rigid three-point support. Often this vacuum lifting force exceeds 100 lbs, or much more. The vacuum-raised head is also held rigidly in a lateral (horizontal) direction by the rigid rotating idlers that are in running contact with the outer periphery of the workpiece holder rotor. In addition, the abrading forces that are applied by lowering the whole bellows workpiece carrier head where the workpiece is in abrading contact with the platen abrasive also increase the force that urges the workpiece rotor against the three-point vertical stops.

The three-point supports can be localized small-sized flat-surfaced supports or the three-point supports can be spherical-shaped ball-type contacts that are in contact with a annular flat supporting surface. The rounded spherical shapes of the ball-supports tend to be self cleaning in the presence of unwanted debris that may reside in the bellows chamber. Here, the spherical shape tends to push aside debris where intimate contact between the spherical balls and the supporting surface is not affected and the workpiece rotor does not experience unwanted tilting action due to debris being position between the vertical-stop supports.

The vertical-stop supports can be manufactured where the workpiece rotor workpiece mounting surface is precisely perpendicular to the rotational axis of the bellows spindle shaft. One configuration option is to align the rotational axis of the bellows spindle shaft to be precisely perpendicular to the top flat surface of an air-bearing abrasive spindle that has a floating spherical-action spindle mount. Then, the workpiece rotor is drawn against the vertical stops with vacuum and then the whole bellows workpiece head is lowered where the workpiece mounting surface of the workpiece rotor is held in abrading contact with that abrasive covered platen. This abrading action on the workpiece rotor will establish a flat workpiece mounting surface that is perpendicular to the bellows spindle axis of rotation. This set-up will allow the rigid spindle to grind or lap both surfaces of a workpiece to be precisely parallel to each other.

When a bellows workholder is used, the workpiece carrier rotor floats freely to provide uniform conformal contact of the workpiece flat surface with the flat-surface platen abrasive. This uniform conformal workpiece contact occurs even when there is a nominal perpendicular misalignment of the bellows workholder device rotation spindle shaft with the flat surface of the platen abrasive.

During an abrading operation, both the workpiece and the platen are rotating, often at the very high speeds of 3,000 rpm or more. Abrasive lapping and polishing at these speeds provide workpiece material removal rates that can exceed, by a factor of ten, the removal rates that are provided by conventional wafer polishing machines that often only rotate at speeds of approximately 30 rpm. However, to provide assurance that the floating bellows workholder workpiece carrier rotor has stable and smooth abrading operation, the individual and sub-assembly components of the bellows workholder are dynamically balanced. In addition, whenever the bellows workholder device is operated, the moving workpiece carrier rotor is constantly held in full flat-faced abrading contact with the moving platen abrasive surface during the abrading operation.

Typically at the start of an abrading procedure, the workpiece is placed in low abrading pressure flat-surfaced contact with the platen abrasive where both the workpiece and the platen are not rotating. Then the rotational speeds of both the workpiece and the platen are progressively increased, where they remain approximately equal to each other, as the abrading pressure is increased with the speed increase. The abrading speed-pressure operation is reversed at the last phase of the abrading procedure where the rotational speeds of both the workpiece and the platen are progressively decreased, where they remain approximately equal to each other, as the abrading pressure is also decreased as the rotational speeds are brought to zero. Low abrading speeds and low abrading pressures at the end-phase of an abrading procedure assures that the developed flatness of the workpiece is maintained as the lapping or polishing action on the workpiece is completed.

During the abrading process, a dynamic stabilizing factor for the "floating" wafer and wafer carrier rotor is the presence of the abrading pressures and forces that are applied to the abraded workpieces. Even though the abrading pressures used with the high speed flat lapping raised-island abrasive disks are only a small fraction of the abrading pressures commonly used in CMP pad wafer polishing, the total applied force on the wafer is still very large. Often, CMP pad abrading pressures range from 4 to 8 psi. The abrading pressures that are typically used with a raised-island abrasive disk are only about 1 psi.

However, because of the large surface area of a typical wafer, the total net downward force on that wafer is very large. For example, a 300 mm (12 inch) diameter wafer has a surface area of approximately 100 square inches. A 1 psi abrading pressure results in a net abrading force of about 100 lbs. This abrading force is applied uniformly across the full flat surface of the wafer. Here, the 100 lb force is used to force the wafer into abrading contact with the moving platen abrasive surface. This large applied abrading force prevents any separation of the wafer from intimate contact with the platen abrasive as the wafer is rotated. The wafer is held in abrading contact with the platen abrasive surface at all times and at all abrading speeds.

Lateral movement of the wafer and the wafer carrier rotor is prevented by the stationary-positioned carrier rotor idlers. These idlers maintain the lateral position of the carrier rotor even when the wafer and the carrier rotor are subjected to very large abrading forces that act laterally along the flat surface of the moving abrasive.

The dynamic balance of the rotating wafer carrier rotor is not affected when a new wafer is attached to the rotor when the wafer is concentrically centered on the rotor. Centering the wafer on the rotor is a simple attachment procedure because both the rotor and the wafer have circular shapes. Also, the weight of the thin wafer substrate is quite small compared to the weight of the wafer carrier rotor. Further, a slight off-center placement of a wafer on a carrier rotor will not have a significant impact on the dynamic action of the rotor. Any out-of-balance vibrations of the rotor that are caused a non-concentric placement of the wafer on the rotor will be immediately damped-out by the liquid damping action of the water film that is present between the wafer and the platen abrasive. The carrier rotor stationary idlers that surround the rotor and contact the rotor outer periphery also prevent out-of-balance vibrations from exciting the motion of the rotor as it rotates.

The bellows carrier can be operated at very high speeds with great stability even though the wafer and wafer rotor are supported by the very flexible bellows. Here, the coolant water film between the wafer and the flat moving abrasive provides dynamic stability to the rotating wafer. The coolant wafer film acts as a vibration-type damping agent when it is cohesively bonding the wafer to the abrasive. Cohesive bonding of the water film prevents the wafer from developing dynamic instabilities even when the wafer is rotated at very high speeds that can exceed 3,000 rpm. This cohesive bonding effect of water films is even a commonly used technique for the attachment of wafers to the wafer carrier heads that are used for CMP polishing of semiconductor wafers.

Because the wafer is attached to the carrier rotor with very large attachment forces that are created by the vacuum wafer attachment system, the wafer carrier rotor is also dynamically stabilized by the water film adhesive bonding forces. Typically, these water or liquid slurry bonding forces are so great between the wafer and a continuous-flat abrasive surface that large forces are required to separate a polished wafer substrate from the rotary platen precision-flat abrasive surface.

The bellows device must have sufficient rotational strength to successfully rotate the wafer when the wafer is subjected to these coolant water film cohesive bonding forces. Here, this very thin film of coolant water must be sheared when the wafer is rotated. As the abraded wafer becomes flatter, it assumes the precision-flatness of the platen abrasive surface and the water film becomes thinner. As the water film becomes thinner, the water cohesive bonding forces become larger and more torque is required to rotate the wafer and shear this film of water (or liquid slurry). Also, more torque is required to rotate the abrasive coated platen.

This effect is well known in the abrasives industry. The more perfect the flatness of a workpiece, the more torque is required to rotate both the wafer and the abrasive coated platen. And, more force is required to separate the finished workpiece substrate from the liquid coated platen. Because of the water or liquid abrasive slurry cohesion effect during the abrading process, the wafer remains in stable flat-surfaced contact with the rigid abrasive-coated platen throughout the abrading process.

One example of this type of sliding "stiction" can be seen by observing the "adhesive bonding" action that takes place when the water wetted flat surfaces of two glass plates are mutually positioned together with a very thin film of water in the small interface gap between the plates. After the plates are in full-faced flat contact, the plates become "adhesively bonded" to each other. Here it is very difficult to pull the two plates apart from each other in a direction that is perpendicular to the plate flat surfaces. Also, it is very difficult to slide one plate along the surface of the other plate.

Many different techniques can be used in the construction of a flexible bellows device. The bellows convolutions can be formed from thin-walled metal tubes that are hydraulically or mechanical-roller formed. These techniques produce omega-shaped annular curvatures of each convolution of the bellows. Here, the nominally-flat plate-like portions of the formed annular bellows convolutions provide most of the axial and lateral flexing of the bellows device.

When a bellows is flexed, large structural stresses can be concentrated in the small-radius curved omega-shaped joints that connect the bellows nominally-flat plates. Here, the omega-shaped bellows annular edges and the nominally-flat plate-sections located between the edges are an integral part of the bellows device. The stresses in the bellows plate-sections are typically much lower than the stresses that occur in the omega-shaped annular bellows edges when the bellows is flexed axially along the length of the bellows.

Bellows are typically constructed from thin high-strength metals that range in thickness from 0.002 to 0.030 inches. The thinnest materials are used for small-diameter bellows and the thicker materials are used for larger diameter bellows. Sometimes metals are electro-deposited in very thin layers to form small-diameter bellows.

Bellows are subjected to repeated flexing actions which often result in repeated high stresses in localized portions of the bellows device, particularly at the reversed-curvature of the bellows inside and outside annular convolution edges. All metals have a stress-fatigue limit where the total allowable number of flexure extension cycles during the lifetime use of the bellows is limited by the stress in the bellows caused by the flexing action. If the flexing stresses are low enough, the bellows can have infinite flexing life without the occurrence of fatigue cracks in the bellows.

When bellows are formed by hydraulic pressure or by the use of sharp-edged disk-type mechanical rotating rollers, which act against thin-walled metal tubes, the metal tube material is greatly deformed in the reverse-curvature bellows annular convolution edges. Stretching and thinning of the deformed bellows tube material occurs in these distorted areas. Selected high-strength materials such as stainless steel or high-carbon steel are work-hardened in these bellows edges by this localized metal-stretching action. Work hardening of the metal in these localized high-stress areas provides a substantial increase in the metal allowable stress characteristics which increases the fatigue strength and fatigue life of the bellows device.

If stresses are too high for the intended flexed excursions, more convolutions can be added to the bellows to reduce the amplitude of axial excursions that an individual convolution has to withstand. Here, the total excursion of the bellows is equally shared by all the individual convolutions which nominally have the same localized flexural spring constants. However, adding convolutions to a bellows increases its length and adds to its susceptibility to bellows column instability.

Also, bellows can be fabricated from sandwiched layers of thinner material. These thin-material multi-layer bellows can provide a huge increase in flexibility because the stiffness of the metal is typically a function of the third power of the metal thickness. Thin metal bellows members that are flexed are much less stiff than thick bellows members. Because the individual layers of bellows material is thin, the resultant bending or flexing stresses are substantially reduced. This stress reduction provides a large increase in the fatigue life of the bellows. The multi-layer thin-material bellows often have the same nominal strengths as the thick-material counterparts as the total composite thickness of the multi-layer material is typically the same as the thickness of the single-layer thick-material bellows.

Bellows can be formed by hydraulic forces to produce a single continuous device that has no convolution weld joints. The shapes of the convolution annular-edge joints can have an "omega-symbol" shape or a sinusoidal shape. Other pressure formed shapes include one where the annular bellows edges and the bellows annular plates are curved locally to provide increased flexibility with lower concentrated flexural stresses. Bellows are also commonly formed from flat or curved annular disks rings that are welded together at the respective alternating inner and outer diameters of the annular rings. Multi-layer welded bellows provide flexible and long-life bellows devices.

Determination of the material stresses present in the bellows when it is flexed is done by a number of different calculation techniques. Conventional analytical models of the bellows geometry configurations have been updated to provide useful calculated estimates of the bellows material stresses that occur when the bellows is flexed. Finite element analysis is often used to model these complex-shaped bellows devices. Also, extensive bellows fatigue-life data has been collected from various empirical sources including: laboratory bellows tests; fatigue analysis destructive testing where bellows were subjected to defined procedures of controlled vibration; the metallurgical examination of fatigue-failed installed bellows; and, performance data results from many field-study application-installed bellows. This collective data provides the basis for adjusting and improving the analytical models and the finite element models that are used to calculate the expected bellows material stresses and the expected fatigue lives of bellows designed for defined bellows applications.

When a bellows device is rotated, the rotation of the bellows drive motor can excite natural frequency vibrations of the bellows. These natural frequency vibrations are caused by the spring-mass characteristics of the bellows device. The overall bellows device has a spring constant and the overall bellows device has a weight-mass. The natural frequency of the bellows is proportional to the square root of the spring constant divided by the mass. Individual portions of the bellows device, such as an annular convolution of the bellows, can have its own natural frequency due to its localized mass and spring constant. The amount of the amplitude excursion of the bellows or the individual bellows components when excited at their natural frequencies by an excitation source such as a bellows rotary drive motor depends on the amount of bellows vibration damping that exists.

A bellows with little damping can have large amplitude excursions which can cause substantial structural stresses within the bellows material. These stresses can cause premature fatigue failure of the bellows device. In high speed lapping, the lapping abrading speeds are often in excess of 10,000 surface feet per minute which requires a 12 inch diameter abrasive coated platen to rotate at speeds of 3,000 rpm. The workpieces attached to the bellows workholder often rotate at the same rotational speed as the platen to provide uniform abrasive removal rates across the full abraded surface of the rotating workpiece. A workpiece rotating at 3,000 rpm, which is 50 revolutions per second, can excite a bellows device having a natural frequency of 50 cycles per second which is referred to as 50 HZ. Each bellows has a discrete number of natural frequencies but the lowest one typically is of most concern.

There are a number of damping techniques that can be applied to a bellows to attenuate the excursion amplitude of the bellows components. These include viscoelastic coatings on the bellows, viscoelastic damping devices attached to adjacent bellows convolution leaves and secondary-spring-mass devices that can be attached to the individual bellows leaves. The secondary-spring-mass devices are dynamically tuned to the unwanted natural frequency of the bellows and automatically oppose motion of the bellows at that selected frequency. They can be constructed from flat spring steel with an attached mass where the device is attached to the bellows convolution leaves at selected positions with adhesives.

Another technique is to apply a thin layer coating of a viscous fluid such as oil or water at the crevice roots of the individual convolution leaves of the bellows. As the bellows is flexed, relative movement of adjacent bellows convolution leaves toward or away from each other causes the viscous fluid to be pumped into or out from the root-crevices of the convolution leaves. This relative movement of the bellows causes the viscous damping fluid to be sheared by this bellows flexing action. Energy is generated by this viscous shearing action acts as with a vibration damping effect on the bellows. The more a bellows flexes, the greater the viscous damping action opposes the large bellows excursion motions which prevents large high speed, or high frequency vibrations, of the bellows. However, the bellows can still have its intended full flexural motion at lower flexure speeds as the viscous damping fluid allows slow-speed motions but opposes high-frequency high speed bellows oscillation motions.

The viscous damping fluid, such as a chemically-stable silicone oil, can be applied to those bellows root-crevices on the inside surface of the bellows that forms the sealed bellows chamber. This chamber is pressurized with air to provide abrading forces to the abraded workpieces. The bellows chamber air is typically clean or it can be filtered to prevent the introduction of debris into the abrasive chamber. The viscous oil can be applied to the internal bellows annular edges where it will be wicked around the total annular surface of each bellows convolution that it is applied to. The resultant oil film thickness will be uniform around the annular surface of the bellows which maintains the dynamic rotary balance of the bellows device. Viscous damping fluids can also be applied to the exterior convolution annular crevice edges where this exterior oil is protected from abrading debris by flexible elastomer or polymer shield devices.

When a bellows has adjacent bellows convolution-leaves that fit closely together, the air that is partially trapped by adjacent leaves that move relative to each other is also pumped into and out from the crevice formed between the adjacent leaves. This semi-contained air is also sheared when the bellows is flexed and provides vibration damping of the vibrating bellows. The added mass of a film of viscous damping oil has little effect on lowering the natural frequency of the bellows device, which occurs due to the added mass with the same nominal bellows spring constant. Also porous foam devices that have interconnected open cells can be attached between adjacent bellows leaves and can be used with any fluid, including air, which passes through the open cell passageway orifices in the foam body as the bellows is flexed due to vibration.

Bellows devices constructed from multiple flexible annular disks that are welded together at the alternating inner and outer annular circumferential edges provide substantial flexibility in the bellows axial direction that is nominally perpendicular to the planes of the weld-joined annular disks. The bellows has an uppermost flexible annular disk that is attached to a rigid upper annular flange and the bellows has an opposed lower flexible annular disk that is attached to a rigid lower annular flange. All of the other bellows central-portion flexible annular disks that are welded together at the alternating inner and outer annular circumferential edges are free to move vertically along the bellows axis without being restrained by rigid members such as the upper and lower rigid bellows flanges.

When the bellows device is flexed axially, structural stresses are relatively very high at the annular weld joint where the upper bellows flexible annular disk is attached to the rigid upper annular flange. Likewise, structural stresses are relatively very high at the annular weld joint where the lower bellows flexible annular disk is attached to the rigid lower annular flange. By comparison, the structural stresses are relatively much lower at the annular weld joints where the flexible annular disks that are positioned between the upper bellows flexible annular disk that is attached to the rigid upper annular flange and the lower bellows flexible annular disk that is attached to the rigid lower annular flange.

The stresses are relatively much higher at the disk annular weld joints where they are attached to the rigid bellows flanges than the annular weld joints where the center-position free-floating annular disks that are welded to other adjacent center-position free-floating annular disks. Allowing the individual central-portion welded annular disks to reach mutual flexed positions when the bellows is flexed axially minimizes the structural stresses in those adjacent-disk annular weld joints. Because the rigid bellows flanges do not allow this mutual annular weld-joint positioning action, the stresses are concentrated at these rigid flange annular weld joints and the resultant stresses are relatively much higher there than at the free-floating bellows central-portion disk weld joints.

Use of thicker uppermost and lower flexible annular disks that are attached to the rigid annular flanges can substantially reduce the stresses in the welded flange joints as the thicker disks will not flex as much as a thinner disk when the bellows is flexed axially. Often the stresses in the rigid flange annular weld joint can be two, five or ten times higher than the stresses in the floating annular disks that are located between the flanges. As an example, the flexible annular disks that are attached to the rigid flanges can have a thickness of 0.015 inches while the thicknesses of the other bellows free-floating bellows central-portion disks can have a thickness of 0.010 inches. The thicker flange bellows disks will flex or move less than the other disks but the relative structural stresses in the thick annular flange weld will be much lower than for a thin flange disk. Most of the bellows device flexing will be provided by the centrally-located disks but the fatigue life of the bellows device will be substantially increased because of the lowered stresses in the highest stressed regions at the flange weld joint.

If desired, more individual disks can be added to the bellows device central region to compensate for the loss of flexibility that results from the stiffer disks used at the upper and lower rigid flange locations. Additions of extra disks can provide the same overall axial and lateral flexibility of the bellows device. Here, the overall length of the bellows is increased a minimal amount because of the nominal 0.010 thickness of each disk that forms a flexible bellows-joint pair of individual disks. Also, the transition of flexibility of the individual bellows disks can be made more gradual by the use of progressively thinner disks starting from the rigid flanges to the bellows device central-location flexible disk-pairs. For example, the first disks welded to the rigid flanges could have a thickness of 0.015 inches, the second disks weld-attached to the first disks could be 0.012 inches thick and the remainder of the disks could be 0.010 inches thick. The nominal desired force, displacement and pressure loading capabilities of the bellows device would nominally provided by the thickness and size of the centrally-located thinnest disks.

Use of thicker bellows device annular disks that are weld-attached to the rigid bellows flanges also provides improved dynamic performance of the bellows device. The lowest natural frequency of the bellows device is increased substantially by use of thicker disks adjacent to the rigid bellows flanges. Instead of the first disk being thin, which makes it much more flexible, the first disk is thicker and stiff which increases its capability to resist the collective mass of the centrally-located disks that apply a dynamic force on these first disks during vibration. Here, the nominal stiffness of these thicker disks increase by the third power of the disk thickness. A 0.015 thick disk is over three times stiffer than a 0.010 thick disk. Increasing the first-layer disk thicknesses can easily provide a substantial increase in the natural frequency of the bellows device whereby it won't tend to be excited by the rotation of the motor device that rotates the bellows abrading device. If induced natural frequency vibrations of the bellows device by the bellows rotational drive motor are avoided, the bellows tend not to be subjected to internal structural bellows vibration stresses that can reduce the fatigue life of the bellows. The use of these thicker bellows disks at the flange locations can provide assurance of extended or even infinite fatigue life of the bellows without the occurrence of fatigue cracks in the rotating bellows device.

Thicker bellow annular disks have less flexibility and have higher spring constants. The progressively diminishing annular disk thicknesses from both the rigid upper and lower bellows flanges can be optimized to provide the desired bellows device excursions with minimal structural stresses and the desired low spring rates. Finite element analysis of the bellows can provide very accurate calculations of all the maximum stresses of the bellows device that occur when it is fully extended and when it is fully compressed. This type of computer modeling allows the full geometry of the bellows device to be fully optimized. Geometry design factors include: the thickness of individual annular disks, the outer diameter of the bellows, the annular width of the annular disks, the curvature-shape of the individual annular disks, the number of the annular disks that are attached to each other, the overall axial length of the bellows and the allowable excursion of the bellows.

Calculations can also be made of the stresses in the bellows due to the torque loads that are applied to the bellows device by the drive motors that rotate the workpieces during the abrading procedures. In addition, the bellows can be designed where the stresses are less than the endurance limit or fatigue limit allowable stresses for the steel bellows components. This allows the bellows to be cycled an infinite number of times for workpiece abrading procedures with no failure of the bellows components.

Figure 30:
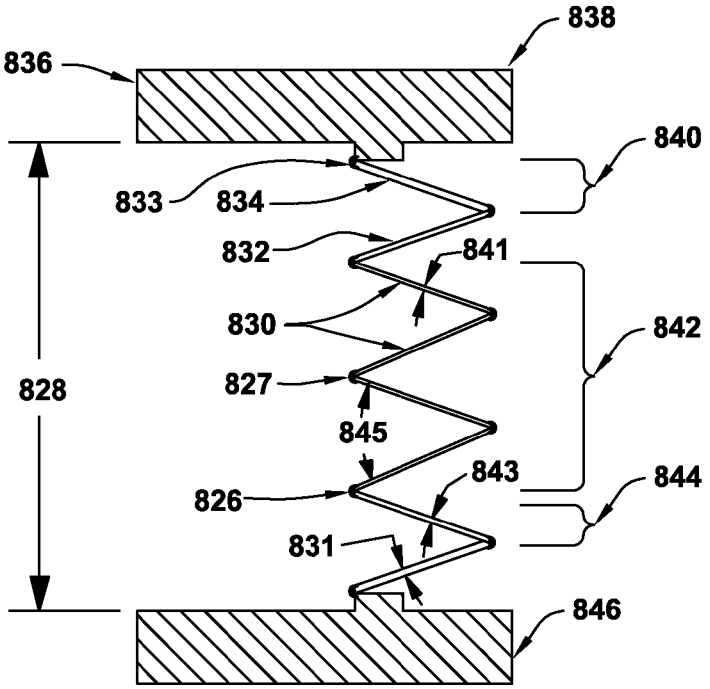
FIG. 30 is a cross section view of a bellows carrier having various thickness bellows leaves.

FIG. 30 is a cross section view of one half of a bellows driven floating workpiece carrier having various thickness bellows leaves. A stationary workpiece carrier head assembly (not shown) has an annular bellows assembly 836 that has a rigid workpiece carrier bellows upper flange 838, a flexible multi-convolution or multiple disk-leaf bellows 827, and a rigid floating workpiece carrier bellows lower flange 846. The rotatable rigid workpiece carrier bellows upper flange 838 is nominally stationary in a vertical direction along the rotation axis of the bellows 827 while the rigid floating workpiece carrier bellows lower flange 846 that is attached to the bellows 827 is free to travel in a vertical direction. Only one cross-sectional portion of the annular bellows assembly 836 is shown where the opposing portion of the annular bellows assembly 836 is not shown. The annular bellows assembly 836 is shown here in a nominally-neutral flexed position without being flexed axially outward or compressed axially inward.

The multiple disk-leaf bellows 827 is typically constructed from multiple thin and flat annular disks 834, 832, 830 which are joined together as shown by welds 826 that are on the inner radii and outer radii of the multiple thin flat annular disks 834, 832, 830. The annular bellows disks 834 have a disk thickness 831 which is thicker than the attached annular disks 832 which have a disk thickness 841 which is thicker than the multiple centrally-located attached annular disks 830 which have disk thicknesses 841. When the annular bellows assembly 836 is flexed vertically along the rotational axis of the annular bellows assembly 836 the highest structural material stresses that occur in the annular bellows assembly 836 often exist in the welds 833 where the annular bellows disks 834 are attached to the rigid bellows upper flange 838 and where the annular bellows disks 834 is attached to the rigid bellows lower flange 846. When increased-thickness annular bellows disks 834 are used, the stresses concentrated in the in the weld joints 833 at these rigid flange 838 and 846 locations can be substantially reduced, due to the increased thickness 831 and reduced flexing of these relatively stiff annular bellows disks 834.

Likewise, reduced-thickness 843 annular bellows disks 832. can be welded at weld edges 826 to the relatively stiff but flexible annular bellows disks 834 and also welded at weld edges 826 to the multiple very flexible thinnest centrally-located attached annular disks 830 which have disk thicknesses 841. The floating weld joints 826 typically have much lower stresses than the rigid weld joints 833. The thinnest centrally-located attached annular disks 830 having disk thicknesses 841 are much more flexible than the thicker annular disks 832 and 834. These thinnest centrally-located attached annular disks 830 having disk thicknesses 841 also have much lower vertical spring constants than the thicker annular disks 832 and 834.

The annular bellows assembly 836 that is constructed from the annular disks 834, 832, 830 which have these different disk thicknesses 831, 841 and 843 provide an overall low spring constant, have substantial axial flexibility and yet have substantially less stresses than a conventional-type annular bellows assemblies 836 that are constructed from the annular disks 834, 832, 830 which all have the same nominal thicknesses such as 841. In addition, an annular bellows assembly 836 can be constructed where all of the individual flexible annular disks 834, 832, 830 which are joined together with welding where the individual flexible annular disks 834, 832, 830 are positioned with nominal angles 845 between adjacent annular disks 834, 832, 830 prior to and during the disk welding procedure. This is angular joining technique is done to minimize stresses in the floating annular weld joints 826 and the rigid annular weld joints 833 when the annular bellows assembly 836 is flexed vertically along the bellows assembly 836 axis or laterally in a horizontal direction. This nominal bellows non-excursion set-angle 845 can range from 2 to 75 degrees but is preferred to range from 15 degrees to 45 degrees.

The thick and stiff annular disks 834 has an excursion flex zone 840 that allows only a small axial excursion of the multiple disk-leaf bellows 836. The medium-thickness and medium-stiffness annular disks 832 has an excursion flex zone 844 that allows a medium axial excursion of the multiple disk-leaf bellows 836. The thin and low-stiffness annular disks centrally-located annular disks 830 has an excursion flex zone 842 that allows a large axial excursion of the multiple disk-leaf bellows 836. The annular bellows assembly 836 has a nominal axial distance 828 between the rigid floating workpiece carrier bellows upper flange 838 and the rigid floating workpiece carrier bellows lower flange 846.

Figure 31:
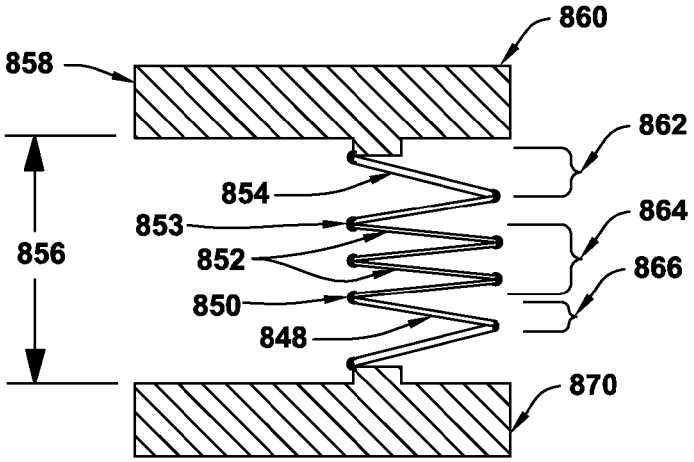
FIG. 31 is a cross section view of a compressed half of a bellows driven workpiece carrier.

FIG. 31 is a cross section view of a compressed half of a bellows driven floating workpiece carrier. A stationary workpiece carrier head assembly (not shown) has an annular bellows assembly 858 that has a rigid workpiece carrier bellows upper flange 860, a flexible multi-convolution or multiple disk-leaf bellows 853, and a rigid floating workpiece carrier bellows lower flange 870. The rotatable rigid workpiece carrier bellows upper flange 860 is nominally stationary in a vertical direction along the rotation axis of the bellows 858 while the rigid floating workpiece carrier bellows lower flange 870 that is attached to the bellows 853 is shown partially compressed and positioned upward in a vertical direction.

The annular bellows assembly 853 that is constructed from the annular disks 854, 852, and 848 that have welds 850 that extend around the annular edge of the disks. The thick and stiff annular disks 854 have an excursion flex zone 862 that allows only a small axial excursion of the multiple disk 854. The medium-thickness and medium-stiffness annular disks 848 has an excursion flex zone 866 that allows a medium vertical axial excursion of the multiple disk-leaf bellows 853. The thin and low-stiffness annular disks centrally-located annular disks 852 have an excursion flex zone 864 that allows a relatively large axial excursion of the multiple disk-leaf bellows 853. Most of the compression of the multiple disk-leaf bellows 853 occurs in the thin and low-stiffness annular disks centrally-located annular disks 852 excursion flex zone 864.

Figure 32:
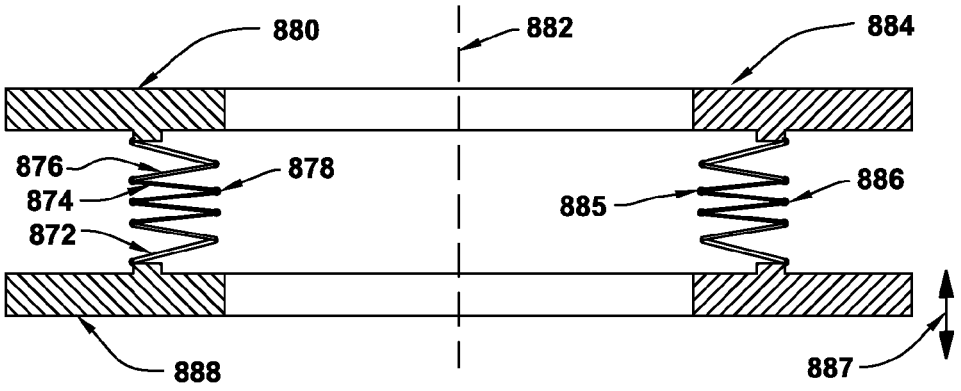
FIG. 32 is a cross section view of a portion of a bellows driven floating workpiece carrier.

FIG. 32 is a cross section view of a portion of a bellows driven floating workpiece carrier. A stationary workpiece carrier head assembly (not shown) has an annular bellows assembly 880 that has a rigid workpiece carrier bellows upper flange 884, a flexible multi-convolution or multiple disk-leaf bellows 885, and a rigid floating workpiece carrier bellows lower flange 888. The rotatable rigid workpiece carrier bellows upper flange 884 is nominally stationary in a vertical direction along the rotation axis 882 of the bellows 880 while the rigid floating workpiece carrier bellows lower flange 888 that is attached to the bellows 885 can move freely in the direction 887 is shown partially compressed and positioned upward in a vertical direction. The annular bellows assembly 885 that is constructed from the annular disks 876, 874 and 872 that have welds 878 that extend around the annular edge of the disks 876, 874 and 872.

The bellows workholder system can have one or more distance measuring sensors that can be used to provide assurance that a workpiece is in full flat-surfaced contact with the platen abrasive surface prior to rotation of the bellows workholder during an abrading procedure. It is desirable that the flexible bellows workholder is not rotated if the workpiece which is attached to the bellows workholder is not in full flat-surfaced contact with the platen abrasive surface. This is done to avoid dynamically unstable operation of the system. When the free-floating bellows rigid lower flange that the workpiece is attached to is allowed to move in a vertical direction along the rotational axis of the bellows without continual contact of the workpiece with the abrasive, undesirable oscillations of the workpiece can occur. Contact of the workpiece with the abrasive prevents these vibration-type oscillations from occurring. The workpiece can be rotated at slow speeds without contact of the workpiece with the abrasive but high speed rotation of the workpiece can cause These distance-measuring sensors can also be used to position the workpiece in flat-surfaced contact with the platen abrasive surface where the free-floating bellows workholder flange is positioned mid-span of the total allowable excursion distance of the flexible bellows device. Positioning the workholder flange at the nominal mid-span allows material to be removed from the workpiece surface during the abrading operation without contact of the bellows device vertical stops. Because the motion of the workpiece is not impeded by the vertical stop devices, the abrading pressure can be accurately controlled throughout the abrading procedure.

Use of non-contacting ultrasonic or laser distance measuring sensors that are mounted on the stationary frame of the bellows device allows the distances to the movable workholder to be accurately determined. Also, contact-type mechanical or electronic measuring devices including calipers, vernier calipers, micrometers and LVDTs (linear variable differential transformers) can be used to measure the distances between locations on the stationary bellows device frame and locations on the exposed surface of the bellows workholder device that the workpieces are attached to. The measurements are typically made between a point or spot-area on the exterior surface of the free-floating rigid flange that is attached to flexible bellows. These reference distance measurements can be made when workpieces are attached to the free-floating rigid flange that is attached to flexible bellows or when no workpiece is attached to the floating flange.

This distance is measured to selected areas on the bellows rigid lower flange when the flange is stationary or moving. One or more of these distance sensors can be used to independently measure distances at different locations around the periphery of the movable rigid lower flange. Typically the rigid flange moves downward vertically as air pressure is increased in the sealed bellows chamber. The flange can also be moved upward vertically if vacuum is applied to the sealed bellows chamber. Each of the sensors can independently measure a distance to a selected area-spot on a rotating workholder. Here, an angular-position device such as an encoder can be attached to the bellows rotary drive shaft and used to position a selected flange area-spot to be rotationally aligned with the selected stationary distance-sensor.

The distance sensors can also be used to dynamically detect the existence and location of non-parallel surfaces on workpieces as they are rotated and abraded. Here, the distances to the selected flange area-spots, as measured by the stationary sensors, will change as the workpiece is rotated which indicates the existence of non-parallel workpiece opposed surfaces. The targeted position spot-areas on the circumference of the bellows lower floating flange can be located with the use of the bellows rotary drive shaft encoder. If desired, vacuum can be applied to the bellows chamber to force the lower flange, with the attached workpiece, vertically upward against a bellows workpiece device internal-stop and the whole bellows workholder can be lowered vertically to abrade the non-parallel workpiece surface. With this process procedure, the distance sensor and the bellows device abrading control system are used to abrade the workpiece non-parallel surface until it becomes co-planar with the opposed workpiece surface that is attached to the bellows workholder.

As a part of the procedure of positioning the workpiece in flat-surfaced contact with the platen abrasive, the air pressure in the bellows chamber can be increased by a selected increment. Then a distance sensor, or multiple sensors, can be activated to determine if the rigid bellows flange moves downward from the position that existed before the bellows chamber pressure was increased. If the bellows flange distance does not increase substantially with the increase of the bellows chamber pressure, it is now established that the workpiece that is attached to the bellows rigid lower flange is in contact with the platen abrasive. This pressure-change test is done when both the bellows-attached workpiece and the platen are stationary.

Because the workpiece and the bellows lower flange are rigid, they will not be nominally compressed when the typically-small incremental pressure increase is applied to the flexible bellows sealed chamber. A small amount of movement of the bellows flange can occur if the film of coolant water that exists on the surface of the platen abrasive is reduced in water film thickness. The very thin water film could be reduced in thickness due to the incremental pressure increase that is applied to the flexible bellows sealed chamber. However, the reduction in the water film thickness is typically very small compared to the total allowable vertical excursion distance controlled by the bellows device. If desired, the workpiece contact and alignment process can be repeated where the bellows chamber pressure can be increased another increment and the distance measurements can be made. This procedure can be repeated until assurance is provided that the workpiece is in full flat-surfaced contact with the platen flat-surfaced abrasive coating.

Also, a workpiece position control system can be used with the bellows workholder device. Here, a process procedure protocol can be established to use the stationary distance sensors to establish a reference-base of information. For example, reference data can be generated to establish where the flexible bellows rigid flange is positioned relative to the allowable range of motion that controls the vertical excursion of the bellows device lower flange vertically along the axis of rotation of the bellows device. With this described system, the bellows device has built-in mechanical-stop devices that limit the total excursion of the flexible bellows to a total vertical excursion of approximately 0.25 inches.

The uppermost and lowermost reference measured distances can be established by simply applying vacuum or air pressure to the bellows sealed pressure chamber. To determine when a flexible bellows rigid flange is positioned at its uppermost position, where the bellows device upper vertical stop is contacted, sufficient vacuum can be applied to the bellows pressure chamber to move the flexible bellows rigid flange upward into this upper-stop contacting position. This uppermost raised reference dimension distance can then be measured by the distance sensor or sensors. To determine when the flexible bellows rigid flange is positioned at its lowermost position, where the bellows device lower vertical stop is contacted, sufficient air pressure can be applied to the bellows pressure chamber to move the flexible bellows rigid flange into this lower-stop contacting position. This lowermost reference dimension distance can then be measured by the distance sensor or sensors.

It is desired that the workpiece is abraded when the flexible bellows device rigid lower flange and the workpiece is positioned at the nominal-center of the total excursion range of 0.25 inches. In this nominal-center position, the rigid lower flange, with the attached workpiece, is free to travel vertically upward by a nominal 0.125 inches which is about one-half of the total 0.025 inch excursion range. The flange and the workpiece are also free to travel vertically 0.125 inches downward from this workpiece-centered position. This position provides sufficient downward excursion of the workpiece to allow for the vertical travel of the bellows flange to make up for the material that is removed from the workpiece surface by abrading action In one example, a process is described for centering the workpiece position where it is in flat-surfaced contact with the platen abrasive while the bellows rigid flange is positioned vertically at the nominal center of the total bellows flange excursion distance. Here, the distance sensor or sensors or measuring devices are used to establish the upper and lower excursion position limits of the flexible bellows workholder rigid flange that the workpiece is attached to. First, the workpiece is attached to the movable bellows rigid lower flange. Then sufficient air pressure is applied to the bellows sealed abrasive pressure chamber to force the bellows lower flange into the bellows-device internal downward vertical stop device. This downward vertical-stop distance is then established as a reference distance.

Next, the whole bellows assembly is lowered vertically until the attached workpiece just contacts the platen flat abrasive surface. The whole bellows assembly is then further lowered until the bellows rigid flange is positioned at the nominal-center of the bellows workholder total allowable vertical excursion distance. During this last assembly lowering action, the flexible bellows is collapsed somewhat in a vertical direction to allow the workpiece to maintain its flat-faced contact with the platen abrasive flat surface while the whole bellows assembly is lowered vertically. The additional non-vertical flexibility of the bellows allows the workpiece to assume its desired flat-faced contact with the platen abrasive flat surface.

After the workpiece is positioned in flat-faced contact with the platen abrasive where the bellows rigid flange is positioned at the nominal-center of the bellows workholder total allowable vertical excursion distance, the workpiece abrading procedure is begun. Here, a selected abrading air pressure is applied to the sealed bellows chamber to establish the workpiece abrading pressure that is desired for the start of the workpiece surface abrading procedure. Both the bellows workholder and the platen rotations are started after the desired abrading pressure is applied to the workpiece. During the full abrading procedure both the abrading pressures and the abrading speeds of the workpiece and the platen are changed at different process times as a function of the abrading protocol used for the selected workpiece and the type of abrading that is done. Workpiece abrading actions can include grinding, lapping and polishing.

The non-contact distance measurement sensors can also be used to dynamically monitor the amount of material that is removed from the abraded surface of the workpiece during the abrading procedure. As the material is removed from the surface of the workpiece, the workpiece becomes thinner and the bellows rigid flange that is attached to the flexible bellows moves downward toward the platen abrasive surface. As the bellows rigid flange moves downward, the measured distance between the stationary bellows device frame and the bellows rigid flange increases. Measurement sensors can easily determine these distance changes of much less than 0.0001 inches of material removal from a workpiece surface. Use of single or multiple measurement sensors that are positioned around the circumference of the bellows rigid flange workholder device can provide additional information as to the parallelism of the workpiece abraded surface and the workpiece non-abraded surface. These measurements can be made when the workholder is stationary or they can be dynamic measurements that are made when the workpiece is rotated.

Figure 33:
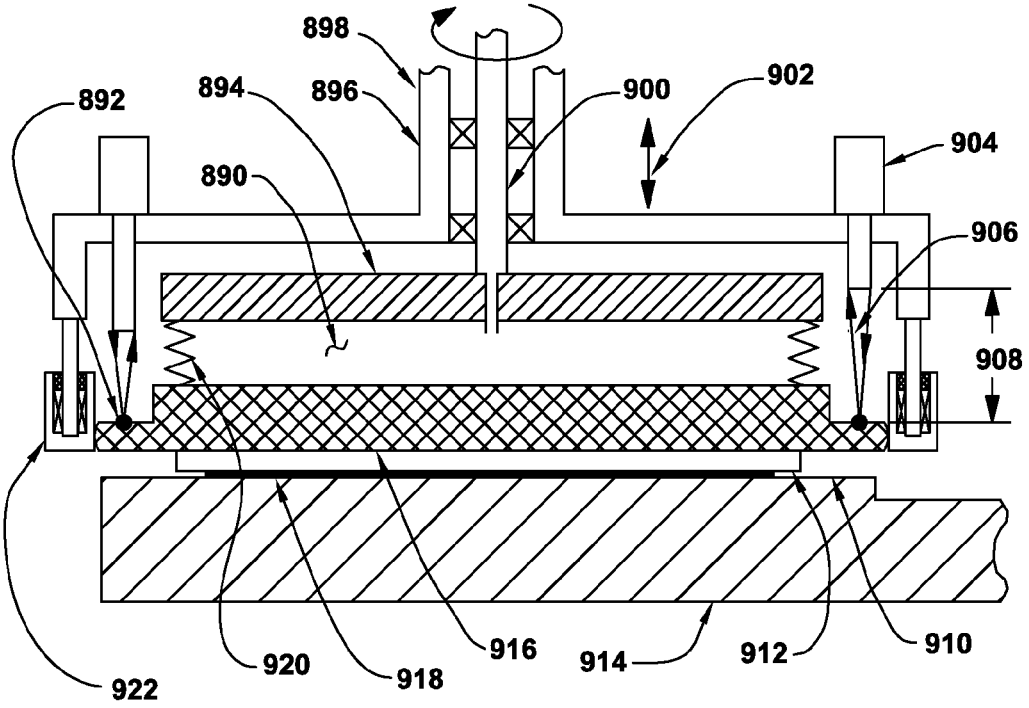
FIG. 33 is a cross section view of a bellows workpiece carrier having measurement devices.

FIG. 33 is a cross section view of a bellows driven floating workpiece carrier having workpiece rotor position measurement devices. A stationary workpiece carrier head assembly 898 has a flat-surfaced workpiece 912 that is attached to a rigid floating workpiece carrier bellows lower flange rotor 916. The bellows lower flange rotor 916 is rotationally driven by a flexible bellows device 920 that is attached to a rotational drive plate 894. The nominally-horizontal drive plate 894 is attached to a hollow drive shaft 900, having a rotation axis, which is supported by a vertically movable stationary carrier housing 896 where the carrier housing 896 can be raised and lowered in a vertical direction 902. The flexible bellows device 920 that is attached to the drive plate 894 is also attached to the workpiece carrier bellows lower flange rotor 916 that is rotationally driven by the flexible bellows device 920.

The workpiece carrier rotor 916 has an outer periphery that has a spherical shape which allows the workpiece carrier rotor 916 outer periphery to remain in contact with stationary rotational roller idlers 922 when the rotating carrier rotor 916 is tilted. The workpiece carrier rotor 916 and the flexible bellows device 920 have rotation axes that are coincident with the hollow drive shaft 900 rotation axis. The workpiece 912 that is attached to the workpiece carrier bellows lower flange rotor 916 is rotationally driven by the flexible bellows device 920. The workpiece 912 is shown in abrading contact with the abrasive 918 coating on the flat surface 910 of the rotary platen 914.

Pressurized air can be supplied through the hollow drive shaft 900 that has a fluid passage that allows the pressurized air, or vacuum, to fill the sealed chamber 890 that is formed by the sealed flexible bellows device 920 that has flexible annular-disk pleats or convolutions. The flexible bellows device 920 has a vertical spring constant which allows the force to be calculated that is required to compress or expand the bellows 920 a specified vertical distance. The flexible bellows device 920 has a vertical spring constant which allows the force to be calculated that is required to compress or expand the bellows 920 a specified distance. The flexible bellows device 920 also has a lateral or horizontal spring constant which allows the force to be calculated that is required to distort the bellows 920 a specified lateral or horizontal distance. The bellows device 920 annular-disk pleats that are joined together at their inside-diameter and outside-diameter peripheral edges allow the bellows device 920 to act as a spring device which can flex vertically.

The workpiece carrier rotor 916 and the flat-surfaced workpiece 912 such as a semiconductor wafer is allowed to be tilted from a horizontal position when they are stationary or rotated by the flexing action provided by the bellows devices 920 that can be operated at very high rotational speeds. One or more distance measurement devices 904 are attached to the stationary non-rotating stationary workpiece carrier head assembly 898 stationary carrier housing 896 where the stationary non-rotating stationary workpiece carrier head assembly 898 and the stationary carrier housing 896 can be raised and lowered vertically in the direction 902.

Multiple distance measurement devices 904 can be positioned around the outer periphery of the workpiece carrier rotor 916 and can be used to provide independent measurements of the distances 908. The measurement distances 908 are equivalently measured from the stationary carrier housing 896 to a selected area spot 892 located on a surface of the floating workpiece carrier bellows lower flange rotor 916 which the workpiece 912 is attached to. Non-contacting ultrasonic or laser distance measuring sensors devices 904 or contact-type mechanical or electronic measuring devices including calipers, vernier calipers, micrometers and LVDTs can be used to measure the distances 908. A non-contacting measuring devices 904 emits and receives rays or signals 906 that indicate the distances 908.

Figure 34:
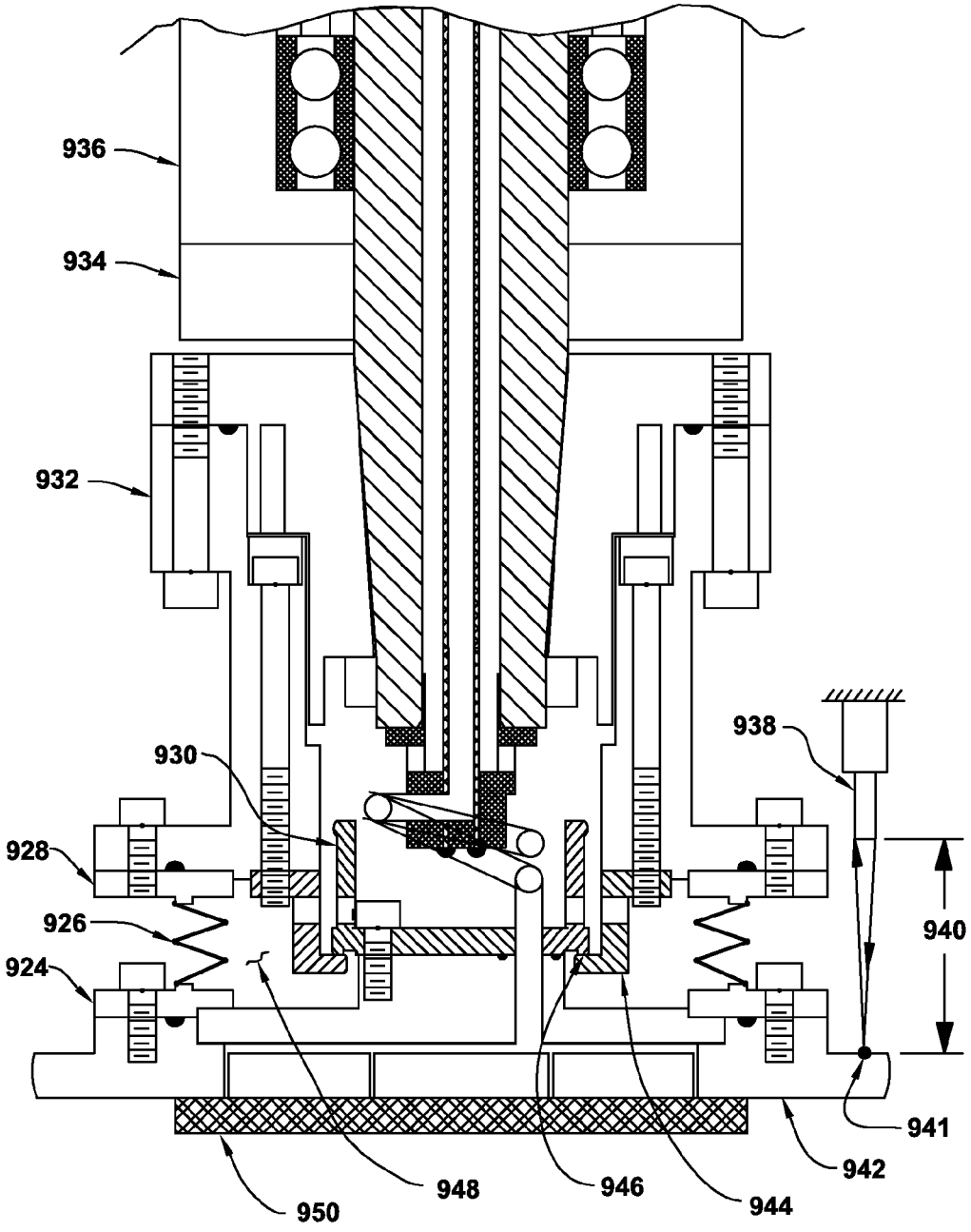
FIG. 34 is a cross section view of a bellows floating workpiece carrier with distance sensors.

FIG. 34 is a cross section view of a bellows floating workpiece carrier with distance sensors. A rotary spindle 936 has a rotary end 934 and shaft having an attached rotary spindle head 932. A flexible bellows 926 has an attached upper bellows flange 928 that rotates but is held stationary in a vertical direction along the rotational axis of the bellows 926 and the rotary spindle 936. The flexible bellows 926 also has an attached free-floating lower bellows flange 924 that rotates where a workpiece 950 is attached to a rotary workholder 942 that is attached to the bellows lower rigid flange 924.

A vertical stop device 944 is attached to the rotary spindle head 932 and acts in conjunction with the bellows stop-device 930 that is attached to the free floating rotary workholder 942. The vertical stop device 944 and the stop-device 930 act with the rotary workholder 942 to limit the excursion travel of the free-floating rotary workholder 942 in a upward or downward vertical direction along the rotational axis of the bellows 926 and the rotary spindle 936 and also acts to limit the excursion travel of the free-floating rotary workholder 942 in a lateral or horizontal direction perpendicular to the rotational axis of the bellows 926 and the rotary spindle 936. When the vertical stop device 944 contacts the bellows stop-device 930 at the contact point 946 the free-floating rotary workholder 942 and the attached workpiece 950 are restrained in a downward vertical direction.

One or more stationary non-contacting distance sensors 938 can be used to measure the distance 940 between target measuring spot-areas 941 located on the rotary workholder 942 and a stationary position on the bellows floating workpiece carrier device stationary frame (not shown) at one or more locations around the periphery of the circular rotary workholder 942. The distance sensors can also be contacting-type sensors or mechanical distance read-out devices. The sensors can be activated to independently or simultaneously measures the multiple reference distances around the periphery of the circular rotary workholder 942 to determine the position of the bellows 926 or the amount of the bellows 926 expansion relative to the center-point (not shown) of the total allowed vertical excursion.

The single or multiple sensors 938 can also be used to determine the amount of material that was removed from a workpiece during the abrading procedure or determine the rate of material removal from the workpiece 950. These single or multiple sensors can also be used to determine the state of co-planar parallelism between the two opposed surfaces of a workpiece 950 at each stage of an abrading procedure or dynamically during the abrading procedure.

Controlled-pressurized air or vacuum can be routed to the sealed bellows chamber 948 to provide abrading pressure which forces the workpiece 950 against an abrasive surface (not shown) on a rotary platen (not shown). The controlled pressure air in the bellows chamber 948 acts against the bellows 926 vertical spring constant to expand the flexible bellows 926 vertically a selected distance which moves the free-floating lower bellows flange 928 and the attached workpiece 950 a selected or calculated vertical distance. A vacuum can also be applied to the bellows chamber 948 to act against the bellows 926 vertical spring constant to contract the flexible bellows 926 vertically a selected distance which moves the free-floating lower bellows flange 928 and the attached workpiece 950 a selected or calculated upward vertical distance.

Figure 35:
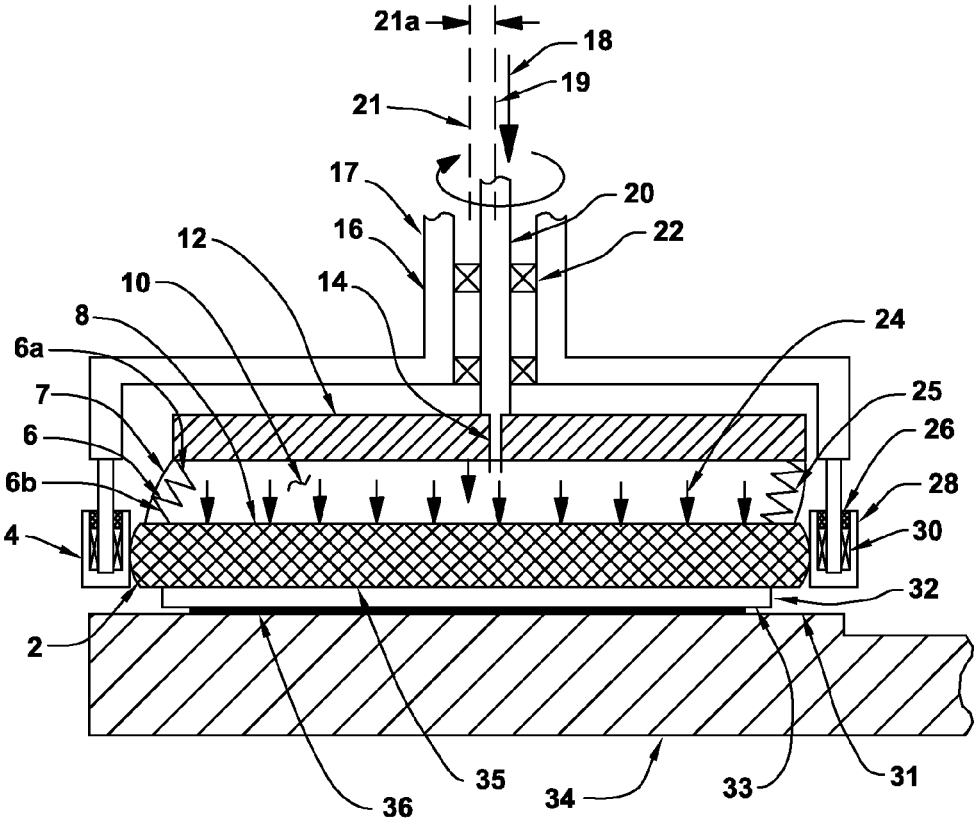
FIG. 35 is a cross section view of a bellows floating workpiece carrier.

FIG. 35 is a cross section view of a bellows floating carrier with horizontal excursion. The bellows floating workpiece carrier in FIG. 35 is a drawing representation of the bellows floating workpiece carrier in FIG. 1 where the carrier rotor 35 carrier rotor rotation axis 21 is offset a horizontal excursion distance 21*a* from the drive shaft 20 rotation axis 19 with a horizontal distortion of the flexible bellows device 6. The bellows 6 bellows top annular ring 6*a* has a corresponding horizontal excursion distance 21*a* from the bellows bottom annular ring 6*b*.

The abrading machine workpiece substrate carrier apparatus and processes to use it are described here. An abrading machine workpiece substrate carrier is described comprising:

a) a movable, nominally-horizontal, stationary-positioned carrier housing having an outer periphery and an outer periphery area that is nominally-horizontal and is adjacent to the stationary-positioned carrier housing outer periphery, the carrier housing having rotary bearings that support a vertical hollow rotatable carrier drive shaft having i) a carrier drive shaft cross-section, ii) a carrier drive shaft length and iii) a carrier drive shaft axis of rotation that is concentric to the carrier drive shaft cross-section and extends along a length of the carrier drive shaft and iiii) a carrier drive shaft hollow opening that extends along the carrier drive shaft length wherein the carrier drive shaft is fixed vertically to the stationary-positioned carrier housing and wherein the stationary-positioned carrier housing is moveable in a vertical direction;

b) a circular rotatable drive plate having a rotatable drive plate outer diameter, a rotatable drive plate top surface and an opposed rotatable drive plate bottom surface wherein both the rotatable drive plate top surface and the rotatable drive plate bottom surface are nominally horizontal and wherein the rotatable drive plate has a rotation axis that is perpendicular to the rotatable drive plate top surface and is located at the center of the rotatable drive plate top surface, wherein the rotatable drive plate top surface is attached to and is supported by the carrier drive shaft and wherein the carrier drive shaft axis of rotation is concentric with the rotatable drive plate rotation axis;

c) a rotatable bellows spring device having multiple annular rings of flat-surfaced metal or polymers having annular ring outer diameters and annular ring inside diameters where selected adjacent annular rings are joined together at their outer diameters and selected adjacent annular rings are joined together at their inner diameters to form the rotatable bellows spring device wherein the multiple individual annular rings are nominally horizontal and where the individual annular rings are flexible in a vertical direction and where the rotatable bellows spring device has a rotatable bellows spring device top annular ring and a rotatable bellows spring device bottom annular ring and where the rotatable bellows spring device has a nominally-vertical axis of rotation that is perpendicular to the rotatable bellows spring device nominally-horizontal top annular ring and the rotatable bellows spring device axis of rotation is located at the center of the rotatable bellows spring device top annular ring and wherein all of the multiple selected adjacent annular rings and the rotatable bellows spring device top annular ring and the rotatable bellows spring device bottom annular ring are all mutually joined together to form an integral rotatable bellows spring device wherein the rotatable bellows spring device bottom annular ring can be moved a selected vertical excursion distance relative to the rotatable bellows spring device top annular ring and wherein the rotatable bellows spring device bottom annular ring can be moved a selected horizontal excursion distance relative to the rotatable bellows spring device top annular ring and wherein the rotatable bellows spring device bottom annular ring can be tilted through a selected excursion angle to a horizontal plane;

d) wherein the rotatable bellows spring device individual annular ring outer diameters are approximately the same and wherein the rotatable bellows spring device individual annular ring outer diameters are approximately the same as the rotatable drive plate outer diameter wherein the rotatable bellows spring device top annular ring is attached to the rotatable drive plate bottom surface and wherein the rotatable bellows spring device axis of rotation is nominally-coincident with the rotatable drive plate rotation axis;

e) a circular rotatable workpiece carrier plate having a rotatable workpiece carrier plate top surface and an opposed rotatable workpiece carrier plate flat bottom surface wherein both the rotatable workpiece carrier plate top surface and the rotatable workpiece carrier plate bottom surface are nominally horizontal and wherein the rotatable workpiece carrier plate has a rotation axis that is perpendicular to the rotatable workpiece carrier plate top surface and is located at the center of the rotatable workpiece carrier plate top surface, wherein the rotatable workpiece carrier plate has a rotatable workpiece carrier plate outer diameter that is approximately the same as outer diameters of the rotatable bellows spring device individual annular rings wherein the rotatable workpiece carrier plate has a rotatable workpiece carrier plate thickness and a rotatable workpiece carrier plate outer periphery surface located at the rotatable workpiece carrier plate outer diameter and extends from the rotatable workpiece carrier plate top surface to the rotatable workpiece carrier plate flat bottom surface;

f) the rotatable bellows spring device bottom annular ring is attached to the rotatable workpiece carrier plate top surface and wherein the rotatable bellows spring device axis of rotation is nominally-coincident with the rotatable workpiece carrier plate rotation axis;

g) at least two roller idlers having respective stationary nominally-vertical roller idler shafts having respective stationary roller idler shaft lengths attached to the stationary-positioned carrier housing outer periphery in the stationary-positioned carrier housing outer periphery area, wherein the respective at least two stationary roller idler shafts support respective roller idler bearings that support respective rotatable roller idler shells, and wherein the respective rotatable roller idler outer shells have a roller idler outer shell periphery and a roller idler outer shell periphery surface area that is nominally-vertical and the respective rotatable roller idler outer shells rotate about a rotation axis that is concentric with the roller idler shafts and extend along the respective roller idler shafts lengths, wherein the respective rotation axes of the respective roller idler shafts are nominally-vertical;

h) the at least two multiple roller idlers are attached to the stationary-positioned carrier housing outer periphery area around the stationary-positioned carrier housing outer periphery, the at least two respective rotatable roller idler outer shells periphery surface areas are positioned in contact with the rotatable workpiece carrier plate outer diameter rotatable workpiece carrier plate outer periphery surface, and the at least two multiple roller idlers care in rolling contact with the rotatable workpiece carrier plate outer periphery surface as the rotatable workpiece carrier plate is rotated and the at least two multiple roller idlers maintain the rotatable workpiece carrier plate rotation axis to be concentric with the carrier drive shaft axis of rotation when the rotatable workpiece carrier plate is rotated;

i) wherein at least one workpiece having parallel opposed flat workpiece top surfaces and flat workpiece bottom surfaces are attached to the rotatable workpiece carrier plate flat bottom surface and wherein the at least one workpiece top surface is attached to the rotatable workpiece carrier plate flat bottom surface;

j) a rotatable abrading platen having a flat abrasive coated abrading surface that is nominally horizontal;

k) wherein the stationary-positioned carrier housing is moveable vertically to position the flat workpiece bottom surface into flat-surfaced abrading contact with the rotatable abrading platen abrading surface and the stationary-positioned carrier housing is moveable vertically to move the flat workpiece bottom surface from flat-surfaced abrading contact with the rotatable abrading platen abrading surface.

The abrading machine workpiece substrate carrier apparatus is configured where the rotatable bellows spring device top annular ring is attached to the rotatable drive plate bottom surface and the spring device bottom annular ring is attached to the rotatable workpiece carrier plate top surface, wherein a sealed enclosed bellows pressure chamber is formed in an internal volume that is contained by the rotatable bellows spring device, the rotatable drive plate bottom surface and the rotatable workpiece carrier plate top surface, wherein the rotatable bellows spring device, the rotatable drive plate bottom surface, the rotatable workpiece carrier plate top surface and the rotatable bellows spring device multiple individual annular ring joints are pressure and vacuum sealed, wherein the rotatable drive is attached to the rotatable drive plate bottom surface and the rotatable bellows plate bottom surface is pressure and vacuum sealed and where the rotatable workpiece carrier plate top surface is pressure and vacuum sealed, wherein controlled-pressure air or controlled-pressure fluid or controlled-pressure vacuum can be introduced into the sealed enclosed bellows pressure chamber through a fluid passageway connecting the hollow rotatable carrier drive shaft to the enclosed bellows pressure chamber.

In addition, the abrading machine workpiece substrate carrier apparatus is configured where the controlled-pressure air or controlled-pressure fluid in the sealed enclosed bellows pressure chamber acts on the rotatable workpiece carrier plate top surface where the controlled-pressure air or controlled-pressure fluid pressure is transmitted through the rotatable workpiece carrier plate thickness, wherein this controlled-pressure air or controlled-pressure fluid pressure is transmitted to the at least one workpiece that is attached to the rotatable workpiece carrier plate, wherein the controlled-pressure air or controlled-pressure fluid provides an abrading pressure which acts uniformly on the at least one workpiece and forces the at least one flat workpiece bottom surface into flat-surfaced abrading contact with the rotatable abrading platen abrading surface when the rotatable bellows spring device is flexed in a vertical direction by changing the pressure of the controlled-pressure air or controlled-pressure fluid in the sealed enclosed bellows pressure chamber.

Another feature is where controlled vacuum is applied to the sealed enclosed bellows pressure chamber wherein the controlled vacuum negative pressure acts on the rotatable workpiece carrier plate top surface and compresses the rotatable bellows spring device which is flexed upward in a vertical direction by applying the controlled vacuum negative pressure in the sealed enclosed bellows pressure chamber and the rotatable workpiece carrier plate is raised away from the rotatable abrading platen abrading surface.

A further feature is where a stationary vacuum or fluid rotary union is attached to the hollow rotatable carrier drive shaft supplies vacuum or fluid to a hollow spindle shaft tube that is connected to a hollow flexible fluid tube that is routed to fluid passageways that are connected to fluid port holes in the rotatable workpiece carrier plate flat bottom surface where i) vacuum can be applied through the hollow flexible fluid tube to attach the flat-surfaced at least one workpiece to the rotatable workpiece carrier plate flat bottom surface or ii) controlled-pressure air or controlled-pressure fluid can be applied through the hollow flexible fluid tube to separate the attached flat-surfaced at least one workpiece from the rotatable workpiece carrier plate flat bottom surface; and wherein the stationary vacuum or fluid rotary union supplies pressurized air or vacuum to the annular gap between the hollow spindle shaft tube and the carrier drive shaft hollow opening that is routed to the rotatable bellows spring device sealed enclosed bellows pressure chamber where i) controlled-pressure air or controlled-pressure fluid can be applied through the annular gap between the hollow spindle shaft tube and the carrier drive shaft hollow opening to expand the rotatable bellows spring device in a vertical direction or ii) vacuum can be applied through the annular gap between the hollow spindle shaft tube and the carrier drive shaft hollow opening to contract the rotatable bellows spring device in a vertical direction.

The bellows workpiece substrate carrier can also have a flexible annular debris band that is impervious to water, abrading fluids and abrading debris comprises a flexible elastomer or flexible polymer material where the flexible annular debris band is attached to the rotatable drive plate and to the rotatable workpiece carrier plate, wherein the flexible annular debris band surrounds the outer diameter of the rotatable bellows spring device individual annular ring outer diameters to prevent contamination of the rotatable bellows spring device individual annular rings by water, abrading fluids and abrading debris.

The bellows workpiece carrier can have a rotatable workpiece carrier plate is flexible in a vertical direction but is substantially rigid in a horizontal direction wherein portions of the rotatable workpiece carrier plate flat bottom surface can be distorted out-of-plane by the controlled-pressure air or controlled-pressure fluid in the sealed enclosed bellows pressure chamber which acts on the rotatable workpiece carrier plate top surface, wherein the controlled-pressure air or controlled-pressure fluid pressure is applied to the flexible rotatable workpiece carrier plate and the flexible rotatable workpiece carrier plate flat bottom surface can assume a non-flat shape.

Further, the bellows workpiece carrier can be configured where multiple rotatable bellows spring devices are positioned concentric with respect to each other to form independent annular or circular rotatable bellows spring devices' sealed enclosed bellows pressure chambers and where sealed enclosed bellows pressure chambers are formed between adjacent sealed enclosed bellows pressure chambers, wherein each independent sealed rotatable bellows spring device sealed enclosed bellows pressure chamber has an independent controlled-pressure air or controlled-pressure fluid source to provide independent controlled-pressure air or controlled-pressure fluid pressures to the respective rotatable bellows spring device's sealed enclosed bellows pressure chambers, wherein the flexible rotatable workpiece carrier plate bottom surface assumes a non-flat shapes at the location of each independent rotatable bellows spring device's sealed enclosed bellows pressure chamber and the respective rotatable bellows spring device's sealed enclosed bellows pressure chambers apply independently controlled abrading pressures to the portions of the at least one workpiece abraded surface that is positioned on the flexible rotatable workpiece carrier plate at the respective rotatable bellows spring device's sealed enclosed bellows pressure chambers. Here, the rotatable workpiece carrier plate outer diameter outer periphery surface can have a spherical shape.

Also, the bellows workpiece carrier can be configured where the rotatable workpiece carrier plate that is supported by the flexible rotatable bellows spring device can be translated over a selected vertical excursion distance that ranges from 0.005 inches to a maximum of 0.750 inches until selected structural components that are attached to the rotatable workpiece carrier plate contacts a vertical excursion-stop device attached to the circular rotatable drive plate; and wherein the rotatable workpiece carrier plate that is supported by the flexible rotatable bellows spring device can be translated over a selected horizontal excursion distance that ranges from 0.005 inches to a maximum of 0.250 inches until selected structural components that are attached to the rotatable workpiece carrier plate contacts a horizontal excursion-stop device attached to the circular rotatable drive plate; and wherein the rotatable workpiece carrier plate that is supported by the flexible rotatable bellows spring device can be tilted over a selected tilt-excursion angle that ranges from 0.1 degrees to a maximum of 30 degrees until selected structural components that are attached to the rotatable workpiece carrier plate contacts a tilt angle excursion-stop device attached to the circular rotatable drive plate.

In addition, the bellows workpiece carrier can be configured where the selected vertical excursion distance ranges from 0.125 inches to a maximum of 0.375 inches and wherein the selected horizontal excursion distance that ranges from 0.010 inches to a maximum of 0.050 inches and wherein the selected tilt-excursion angle ranges from 5 degrees to a maximum of 15 degrees.

Here also, selected abrading machine workpiece substrate carrier apparatus structural components that are attached to the rotatable workpiece carrier plate are positioned within the circumference and perimeter-envelope of a nominally-annular structural member that is attached to the circular rotatable drive plate wherein the selected structural components that are attached to the rotatable workpiece carrier plate are constrained within the circumference and perimeter-envelope of the nominally-annular structural member that is attached to the circular rotatable drive plate in the event of the fracture of or damage to the rotatable bellows spring device when the circular rotatable drive plate is rotated wherein the rotatable workpiece carrier plate remains restrained by the circular rotatable drive plate during the event of the fracture of or damage to the rotatable bellows spring device.

The bellows workpiece carrier can be configured where the hollow flexible fluid tube that is routed to fluid passageways that are connected to fluid port holes in the rotatable workpiece carrier plate flat bottom surface has a circular arc-segment shape wherein the circular arc-segment arc length ranges from 30 degrees to 720 degrees and wherein the hollow flexible fluid tube circular arc-segment is located within the circumference and perimeter-envelope of the nominally-annular structural member that is attached to the circular rotatable drive plate. Also, the stationary vacuum or fluid rotary union that is attached to the hollow rotatable carrier drive shaft supplies vacuum or fluid to the hollow spindle shaft tube that is connected to the hollow flexible fluid tube that is routed to fluid passageways that are connected to fluid port holes in the rotatable workpiece carrier plate flat bottom surface where the hollow flexible fluid tube is a flexible bellows-type tube or an elastomer material tube or a flexible bellows-type tube with an internal elastomer material tube liner.

Furthermore, the bellows workpiece carrier can have a stationary vacuum and fluid rotary union that is attached to the hollow rotatable carrier drive shaft is a friction-free air-bearing rotary union comprising:

a) at least two cylindrical air bearing devices having opposed cylindrical air bearing device ends wherein the at least two cylindrical air bearing devices are positioned adjacent to each other longitudinally along the outside diameter of a cylindrical rotatable hollow air bearing shaft having a cylindrical rotatable hollow air bearing shaft open top end and having a cylindrical rotatable hollow air bearing shaft open bottom end wherein the end of one cylindrical air bearing device is positioned nominally adjacent to the cylindrical rotatable hollow air bearing shaft open top end;

b) wherein the cylindrical rotatable hollow air bearing shaft open bottom end is attached to the hollow rotatable carrier drive shaft wherein the cylindrical rotatable hollow air bearing shaft is concentric with the hollow rotatable carrier drive shaft;

c) wherein pressurized air is supplied to the at least two cylindrical air bearing devices wherein an air film is formed between the at least two cylindrical air bearing devices and the cylindrical rotatable hollow air bearing shaft;

d) wherein a stationary vacuum rotary union end-cap is attached to a vacuum and fluid rotary union housing that surrounds the at least two cylindrical air bearing devices to form a sealed vacuum and fluid rotary union housing internal chamber located at the cylindrical rotatable hollow air bearing shaft open top end and wherein a vacuum port hole extends through the vacuum rotary union end-cap into the stationary vacuum and fluid rotary union housing internal chamber;

e) wherein vacuum or fluid supplied to the vacuum rotary union end-cap vacuum port hole is routed into the stationary vacuum and fluid rotary union housing internal chamber and is routed to the top open end of the hollow spindle shaft tube that is positioned within the vacuum and fluid rotary union housing internal chamber;

f) wherein there are gap-spaces between the ends of adjacent at least two cylindrical air bearing devices positioned longitudinally along the outside diameter of the cylindrical rotatable hollow air bearing shaft wherein at least one pressure port hole extends radially through the cylindrical rotatable hollow air bearing shaft at the location of the respective gap-spaces between respective two adjacent cylindrical air bearing devices; and g) wherein pressure-entry port holes extend radially through the vacuum and fluid rotary union housing that surrounds the at least two cylindrical air bearing devices at the locations of the respective gap-spaces between respective two adjacent cylindrical air bearing devices;

h) wherein pressurized air and vacuum supplied to respective pressure-entry port holes that extend radially through the vacuum and fluid rotary union housing is routed into the at least one pressure port hole extending radially through the cylindrical rotatable hollow air bearing shaft and i) is routed into the gap-spaces between the ends of adjacent at least two cylindrical air bearing devices and is routed into a respective annular space gap-space passageway between the hollow spindle shaft tube and the cylindrical rotatable hollow air bearing shaft wherein it is routed into the annular gap between the hollow spindle shaft tube and the hollow rotatable carrier drive shaft hollow opening and into the sealed enclosed bellows pressure chambers or ii) is routed into respective tubes or passageways that are connected with multiple respective sealed enclosed bellows pressure chambers that are located in the abrading machine workpiece substrate carrier apparatus.

Furthermore, the bellows workpiece carrier can have cylinder-shaped air bearing devices are porous carbon air bearing devices. Also, the rotatable workpiece carrier plate and the selected structural components that are attached to the rotatable workpiece carrier plate can be rigidly held in position against rigid stop devices that are attached to the circular rotatable drive plate by applying vacuum to the sealed enclosed bellows pressure chamber wherein the controlled vacuum negative pressure acts on the rotatable workpiece carrier plate top surface and compresses the rotatable bellows spring device wherein the abrading machine workpiece substrate carrier apparatus can provide rigid abrading of workpieces when the stationary-positioned carrier housing is moveable vertically to position the flat workpiece bottom surface into flat-surfaced abrading contact with the rotatable abrading platen abrading surface.

The bellows workpiece carrier can be configured where the vacuum supplied through the annular gap between the hollow spindle shaft tube and the carrier drive shaft hollow opening to contract the rotatable bellows spring device in a vertical direction is provided with a substantial-volume vacuum surge tank that is located nominally near the abrading machine workpiece substrate carrier apparatus wherein a substantial amount of controlled vacuum is quickly applied to the sealed enclosed bellows pressure chamber wherein the controlled vacuum negative pressure acts on the rotatable workpiece carrier plate top surface and compresses the rotatable bellows spring device which is flexed upward in a vertical direction by applying the controlled vacuum negative pressure in the sealed enclosed bellows pressure chamber where i) the rotatable workpiece carrier plate is quickly raised away from the rotatable abrading platen abrading surface or ii) the rotatable workpiece carrier plate and the workpiece attached to the rotatable workpiece carrier plate is quickly raised away from the rotatable abrading platen abrading surface.

A process of providing abrading workpieces is described of using an abrading machine workpiece substrate carrier apparatus comprising:

a) providing a movable, nominally-horizontal, stationary-positioned carrier housing having an outer periphery and an outer periphery area that is nominally-horizontal and is adjacent to the stationary-positioned carrier housing outer periphery, the carrier housing having rotary bearings that support a vertical hollow rotatable carrier drive shaft having i) a carrier drive shaft cross-section, ii) a carrier drive shaft length and iii) a carrier drive shaft axis of rotation that is concentric to the carrier drive shaft cross-section and extends along a length of the carrier drive shaft and iiii) a carrier drive shaft hollow opening that extends along the carrier drive shaft length wherein the carrier drive shaft is fixed vertically to the stationary-positioned carrier housing and wherein the stationary-positioned carrier housing is moveable in a vertical direction;

b) providing a circular rotatable drive plate having a rotatable drive plate outer diameter, a rotatable drive plate top surface and an opposed rotatable drive plate bottom surface wherein both the rotatable drive plate top surface and the rotatable drive plate bottom surface are nominally horizontal and wherein the rotatable drive plate has a rotation axis that is perpendicular to the rotatable drive plate top surface and is located at the center of the rotatable drive plate top surface, wherein the rotatable drive plate top surface is attached to and is supported by the carrier drive shaft and wherein the carrier drive shaft axis of rotation is concentric with the rotatable drive plate rotation axis;

c) providing a rotatable bellows spring device having multiple annular rings of flat-surfaced metal or polymers having annular ring outer diameters and annular ring inside diameters where selected adjacent annular rings are joined together at their outer diameters and selected adjacent annular rings are joined together at their inner diameters to form the rotatable bellows spring device wherein the multiple individual annular rings are nominally horizontal and where the individual annular rings are flexible in a vertical direction and where the rotatable bellows spring device has a rotatable bellows spring device top annular ring and a rotatable bellows spring device bottom annular ring and where the rotatable bellows spring device has a nominally-vertical axis of rotation that is perpendicular to the rotatable bellows spring device nominally-horizontal top annular ring and the rotatable bellows spring device axis of rotation is located at the center of the rotatable bellows spring device top annular ring and wherein all of the multiple selected adjacent annular rings and the rotatable bellows spring device top annular ring and the rotatable bellows spring device bottom annular ring are all mutually joined together to form an integral rotatable bellows spring device wherein the rotatable bellows spring device bottom annular ring can be moved a selected vertical excursion distance relative to the rotatable bellows spring device top annular ring and wherein the rotatable bellows spring device bottom annular ring can be moved a selected horizontal excursion distance relative to the rotatable bellows spring device top annular ring and wherein the rotatable bellows spring device bottom annular ring can be tilted through a selected excursion angle to a horizontal plane;

d) providing that the rotatable bellows spring device individual annular ring outer diameters are approximately the same and wherein the rotatable bellows spring device individual annular ring outer diameters are approximately the same as the rotatable drive plate outer diameter wherein the rotatable bellows spring device top annular ring is attached to the rotatable drive plate bottom surface and wherein the rotatable bellows spring device axis of rotation is nominally-coincident with the rotatable drive plate rotation axis;

e) providing a circular rotatable workpiece carrier plate having a rotatable workpiece carrier plate top surface and an opposed rotatable workpiece carrier plate flat bottom surface wherein both the rotatable workpiece carrier plate top surface and the rotatable workpiece carrier plate bottom surface are nominally horizontal and wherein the rotatable workpiece carrier plate has a rotation axis that is perpendicular to the rotatable workpiece carrier plate top surface and is located at the center of the rotatable workpiece carrier plate top surface, wherein the rotatable workpiece carrier plate has a rotatable workpiece carrier plate outer diameter that is approximately the same as outer diameters of the rotatable bellows spring device individual annular rings wherein the rotatable workpiece carrier plate has a rotatable workpiece carrier plate thickness and a rotatable workpiece carrier plate outer periphery surface located at the rotatable workpiece carrier plate outer diameter and extends from the rotatable workpiece carrier plate top surface to the rotatable workpiece carrier plate flat bottom surface;

f) attaching the rotatable bellows spring device bottom annular ring to the rotatable workpiece carrier plate top surface and wherein the rotatable bellows spring device axis of rotation is nominally-coincident with the rotatable workpiece carrier plate rotation axis;

g) providing at least two roller idlers having respective stationary nominally-vertical roller idler shafts having respective stationary roller idler shaft lengths attached to the stationary-positioned carrier housing outer periphery in the stationary-positioned carrier housing outer periphery area, wherein the respective at least two stationary roller idler shafts support respective roller idler bearings that support respective rotatable roller idler shells, and wherein the respective rotatable roller idler outer shells have a roller idler outer shell periphery and a roller idler outer shell periphery surface area that is nominally-vertical and the respective rotatable roller idler outer shells rotate about a rotation axis that is concentric with the roller idler shafts and extend along the respective roller idler shafts lengths, wherein the respective rotation axes of the respective roller idler shafts are nominally-vertical;

h) attaching the at least two multiple roller idlers to the stationary-positioned carrier housing outer periphery area around the stationary-positioned carrier housing outer periphery, the at least two respective rotatable roller idler outer shells periphery surface areas are positioned in contact with the rotatable workpiece carrier plate outer diameter rotatable workpiece carrier plate outer periphery surface, and the at least two multiple roller idlers care in rolling contact with the rotatable workpiece carrier plate outer periphery surface as the rotatable workpiece carrier plate is rotated and the at least two multiple roller idlers maintain the rotatable workpiece carrier plate rotation axis to be concentric with the carrier drive shaft axis of rotation when the rotatable workpiece carrier plate is rotated;

i) attaching at least one workpiece having parallel opposed flat workpiece top surfaces and flat workpiece bottom surfaces to the rotatable workpiece carrier plate flat bottom surface and wherein the at least one workpiece top surface is attached to the rotatable workpiece carrier plate flat bottom surface;

j) providing a rotatable abrading platen having a flat abrasive coated abrading surface that is nominally horizontal;

k) moving the stationary-positioned carrier housing is moveable vertically to position the flat workpiece bottom surface into flat-surfaced abrading contact with the rotatable abrading platen abrading surface and the stationary-positioned carrier housing is moveable vertically to move the flat workpiece bottom surface from flat-surfaced abrading contact with the rotatable abrading platen abrading surface; and l) abrading the at least one workpiece.

The process of providing abrading workpieces is also described where the rotatable bellows spring device top annular ring is attached to the rotatable drive plate bottom surface and the spring device bottom annular ring is attached to the rotatable workpiece carrier plate top surface, wherein a sealed enclosed bellows pressure chamber is formed in an internal volume that is contained by the rotatable bellows spring device, the rotatable drive plate bottom surface and the rotatable workpiece carrier plate top surface, wherein the rotatable bellows spring device, the rotatable drive plate bottom surface, the rotatable workpiece carrier plate top surface and the rotatable bellows spring device multiple individual annular ring joints are pressure and vacuum sealed, wherein the rotatable drive is attached to the rotatable drive plate bottom surface and the rotatable bellows plate bottom surface is pressure and vacuum sealed and where the rotatable workpiece carrier plate top surface is pressure and vacuum sealed, wherein controlled-pressure air or controlled-pressure fluid or controlled-pressure vacuum can be introduced into the sealed enclosed bellows pressure chamber through a fluid passageway connecting the hollow rotatable carrier drive shaft to the enclosed bellows pressure chamber.

What is claimed:

1. An abrading machine workpiece substrate carrier apparatus comprising:

a) a movable, nominally-horizontal, stationary-positioned carrier housing having an outer periphery and an outer periphery area that is nominally-horizontal and is adjacent to outer periphery of the stationary-positioned carrier housing, the carrier housing having rotary bearings that support a vertical hollow rotatable carrier drive shaft having:

i) a carrier drive shaft cross-section, ii) a carrier drive shaft length iii) a carrier drive shaft axis of rotation that is concentric to the carrier drive shaft cross-section and extends along a length of the carrier drive shaft and iv) a carrier drive shaft hollow opening that extends along the carrier drive shaft length with the carrier drive shaft is fixed vertically to the stationary-positioned carrier housing and the stationary-positioned carrier housing is moveable in a nominally vertical direction;

b) a circular rotatable drive plate having a rotatable drive plate outer diameter, a rotatable drive plate top surface and an opposed rotatable drive plate bottom surface wherein both the rotatable drive plate top surface and the rotatable drive plate bottom surface are nominally horizontal and the rotatable drive plate has a rotation axis that is perpendicular to the rotatable drive plate top surface and is located at the center of the rotatable drive plate top surface, wherein the rotatable drive plate top surface is attached to and is supported by the carrier drive shaft and the carrier drive shaft axis of rotation is concentric with the rotatable drive plate rotation axis;

c) a rotatable bellows spring device having multiple annular rings of flat-surfaced metal or polymers having annular ring outer diameters and annular ring inside diameters where a first portion of adjacent annular rings are joined together at their outer diameters and a second portion of adjacent annular rings are joined together at their inner diameters to form the rotatable bellows spring device, wherein the multiple individual annular rings are nominally horizontal and the individual annular rings are flexible in a vertical direction, and the rotatable bellows spring device has a rotatable bellows spring device top annular ring and a rotatable bellows spring device bottom annular ring, and the rotatable bellows spring device has a nominally-vertical axis of rotation perpendicular to the rotatable bellows spring device nominally-horizontal top annular ring and the rotatable bellows spring device axis of rotation is at the center of the rotatable bellows spring device top annular ring, and all multiple selected adjacent annular rings and the rotatable bellows spring device top annular ring and the rotatable bellows spring device bottom annular ring are joined together to form an integral rotatable bellows spring device, wherein the rotatable bellows spring device bottom annular ring are moveable over a vertical excursion distance relative to the rotatable bellows spring device top annular ring and wherein the rotatable bellows spring device bottom annular ring is moveable over a horizontal excursion distance relative to the rotatable bellows spring device top annular ring and wherein the rotatable bellows spring device bottom annular ring is tiltable through an excursion angle to a horizontal plane;

d) wherein the rotatable bellows spring device individual annular ring outer diameters are similar and wherein the rotatable bellows spring device individual annular ring outer diameters are similar to the rotatable drive plate outer diameter, wherein the rotatable bellows spring device top annular ring is attached to the rotatable drive plate bottom surface and the rotatable bellows spring device axis of rotation is nominally-coincident with the rotatable drive plate rotation axis;

e) a circular rotatable workpiece carrier plate having a rotatable workpiece carrier plate top surface and an opposed rotatable workpiece carrier plate flat bottom surface, wherein both the rotatable workpiece carrier plate top surface and the rotatable workpiece carrier plate bottom surface are nominally horizontal and the rotatable workpiece carrier plate has a rotation axis perpendicular to the rotatable workpiece carrier plate top surface and is located at the center of the rotatable workpiece carrier plate top surface, wherein the rotatable workpiece carrier plate has a rotatable workpiece carrier plate outer diameter similar to outer diameters of the rotatable bellows spring device individual annular rings and the rotatable workpiece carrier plate has a rotatable workpiece carrier plate thickness and a rotatable workpiece carrier plate outer periphery surface located at the rotatable workpiece carrier plate outer diameter and extends from the rotatable workpiece carrier plate top surface to the rotatable workpiece carrier plate flat bottom surface;

f) the rotatable bellows spring device bottom annular ring is attached to the rotatable workpiece carrier plate top surface and the rotatable bellows spring device axis of rotation is nominally-coincident with the rotatable workpiece carrier plate rotation axis;

g) at least two roller idlers having respective stationary nominally-vertical roller idler shafts having respective stationary roller idler shaft lengths are attached to the stationary-positioned carrier housing outer periphery in the stationary-positioned carrier housing outer periphery area, wherein the respective at least two stationary roller idler shafts support respective roller idler bearings that in turn support respective rotatable roller idler shells, and the respective rotatable roller idler outer shells have a roller idler outer shell periphery and a roller idler outer shell periphery surface area that is nominally-vertical, and the respective rotatable roller idler outer shells are rotatable about a rotation axis that is concentric with the roller idler shafts and extends along the respective roller idler shafts lengths, wherein respective rotation axes of the respective roller idler shafts are nominally-vertical;

h) the at least two multiple roller idlers are attached to the stationary-positioned carrier housing outer periphery area around the stationary-positioned carrier housing outer periphery, the at least two respective rotatable roller idler outer shells periphery surface areas are positioned in contact with the rotatable workpiece carrier plate outer diameter rotatable workpiece carrier plate outer periphery surface, and the at least two multiple roller idlers are in rolling contact with the rotatable workpiece carrier plate outer periphery surface as the rotatable workpiece carrier plate is rotated and the at least two multiple roller idlers maintain the rotatable workpiece carrier plate rotation axis as concentric with the carrier drive shaft axis of rotation when the rotatable workpiece carrier plate is rotated;

i) wherein at least one workpiece having parallel opposed flat workpiece top surfaces and flat workpiece bottom surfaces are attached to the rotatable workpiece carrier plate flat bottom surface and wherein the at least one workpiece top surface is attached to the rotatable workpiece carrier plate flat bottom surface;

j) a rotatable abrading platen having a flat abrasive coated abrading surface that is nominally horizontal;

k) wherein the stationary-positioned carrier housing is moveable vertically to position the flat workpiece bottom surface into flat-surfaced abrading contact with the rotatable abrading platen abrading surface and the stationary-positioned carrier housing is moveable vertically to move the flat workpiece bottom surface from flat-surfaced abrading contact with the rotatable abrading platen abrading surface.

2. The apparatus of claim 1 where a top annular ring of the rotatable bellows spring device is attached to the rotatable drive plate bottom surface and the spring device bottom annular ring is attached to the rotatable workpiece carrier plate top surface, wherein a sealed enclosed bellows pressure chamber is formed in an internal volume contained by the rotatable bellows spring device, the rotatable drive plate bottom surface and the rotatable workpiece carrier plate top surface, wherein the rotatable bellows spring device, the rotatable drive plate bottom surface, the rotatable workpiece carrier plate top surface and the rotatable bellows spring device multiple individual annular ring joints are pressure and vacuum sealed, wherein the rotatable drive is attached to the rotatable drive plate bottom surface and the rotatable bellows plate bottom surface is pressure and vacuum sealed and the rotatable workpiece carrier plate top surface is pressure and vacuum sealed, wherein controlled-pressure air or controlled-pressure fluid or controlled-pressure vacuum is provideable into the sealed enclosed bellows pressure chamber through a fluid passageway connecting the hollow rotatable carrier drive shaft to the enclosed bellows pressure chamber.

3. The apparatus of claim 2 where the controlled-pressure air or controlled-pressure fluid in the sealed enclosed bellows pressure chamber enables the controlled-pressure air or controlled-pressure fluid pressure to be transmitted through the rotatable workpiece carrier plate thickness, wherein this controlled-pressure air or controlled-pressure fluid pressure is transmitted to the at least one workpiece that is attached to the rotatable workpiece carrier plate, and the controlled-pressure air or controlled-pressure fluid provides an abrading pressure which acts uniformly on the at least one workpiece and forces the at least one flat workpiece bottom surface into flat-surfaced abrading contact with the rotatable abrading platen abrading surface when the rotatable bellows spring device is flexed in a vertical direction by changing the pressure of the controlled-pressure air or controlled-pressure fluid in the sealed enclosed bellows pressure chamber.

4. The apparatus of claim 2 where controlled vacuum applied to the sealed enclosed bellows pressure chamber acts on the rotatable workpiece carrier plate top surface and compresses the rotatable bellows spring device which is flexible upward in a vertical direction by application of the controlled vacuum negative pressure in the sealed enclosed bellows pressure chamber and the rotatable workpiece carrier plate is thus raised away from the rotatable abrading platen abrading surface.

5. The apparatus of claim 1 where a stationary vacuum or fluid rotary union is attached to the hollow rotatable carrier drive shaft which supplies vacuum or fluid to a hollow spindle shaft tube that is connected to a hollow flexible fluid tube routed to fluid passageways connected to fluid port holes in the rotatable workpiece carrier plate flat bottom surface where:

i) vacuum can be applied through the hollow flexible fluid tube to attach the flat-surfaced at least one workpiece to the rotatable workpiece carrier plate flat bottom surface or ii) controlled-pressure air or controlled-pressure fluid can be applied through the hollow flexible fluid tube to separate the attached flat-surfaced at least one workpiece from the rotatable workpiece carrier plate flat bottom surface;

and wherein the stationary vacuum or fluid rotary union supplies pressurized air or vacuum to the annular gap between the hollow spindle shaft tube and the carrier drive shaft hollow opening that is routed to the rotatable bellows spring device sealed enclosed bellows pressure chamber where:

iii) controlled-pressure air or controlled-pressure fluid can be applied through the annular gap between the hollow spindle shaft tube and the carrier drive shaft hollow opening to expand the rotatable bellows spring device in a vertical direction or iv) vacuum can be applied through the annular gap between the hollow spindle shaft tube and the carrier drive shaft hollow opening to contract the rotatable bellows spring device in a vertical direction.

6. The apparatus of claim 1 where a flexible annular debris band impervious to a) water, b) abrading fluids and c) abrading debris comprises a flexible elastomer or flexible polymer material, wherein the flexible annular debris band is attached to the rotatable drive plate and to the rotatable workpiece carrier plate, and the flexible annular debris band surrounds the outer diameter of the rotatable bellows spring device individual annular ring outer diameters to prevent contamination of the rotatable bellows spring device individual annular rings by water, abrading fluids and abrading debris.

7. The apparatus of claim 3 where the rotatable workpiece carrier plate is flexible in a vertical direction but is substantially rigid in a horizontal direction, wherein portions of the rotatable workpiece carrier plate flat bottom surface can be distorted out-of-plane by the controlled-pressure air or controlled-pressure fluid in the sealed enclosed bellows pressure chamber which acts on the rotatable workpiece carrier plate top surface, wherein the controlled-pressure air or controlled-pressure fluid pressure is applicable to the flexible rotatable workpiece carrier plate, and the flexible rotatable workpiece carrier plate flat bottom surface can assume a non-flat shape.

8. The apparatus of claim 7 where multiple rotatable bellows spring devices are positioned concentric with respect to each other to form independent annular or circular rotatable bellows spring devices' sealed enclosed bellows pressure chambers and where sealed enclosed bellows pressure chambers are formed between adjacent sealed enclosed bellows pressure chambers, wherein each independent sealed rotatable bellows spring device sealed enclosed bellows pressure chamber has an independent controlled-pressure air or controlled-pressure fluid source to provide independent controlled-pressure air or controlled-pressure fluid pressures to the respective rotatable bellows spring device's sealed enclosed bellows pressure chambers, wherein the flexible rotatable workpiece carrier plate bottom surface assumes a non-flat shapes at the location of each independent rotatable bellows spring device's sealed enclosed bellows pressure chamber and the respective rotatable bellows spring device's sealed enclosed bellows pressure chambers apply independently controlled abrading pressures to the portions of the at least one workpiece abraded surface that is positioned on the flexible rotatable workpiece carrier plate at the respective rotatable bellows spring device's sealed enclosed bellows pressure chambers.

9. The apparatus of claim 1 where the rotatable workpiece carrier plate outer diameter outer periphery surface has a spherical shape.

10. The apparatus of claim 1 where the rotatable workpiece carrier plate that is supported by the flexible rotatable bellows spring device can be translated over a selected vertical excursion distance that ranges from 0.005 inches to a maximum of 0.750 inches until selected structural components that are attached to the rotatable workpiece carrier plate contacts a vertical excursion-stop device attached to the circular rotatable drive plate, and wherein the rotatable workpiece carrier plate supported by the flexible rotatable bellows spring device can be translated over a selected horizontal excursion distance that ranges from 0.005 inches to a maximum of 0.250 inches until selected structural components that are attached to the rotatable workpiece carrier plate contacts a horizontal excursion-stop device attached to the circular rotatable drive plate; and wherein the rotatable workpiece carrier plate supported by the flexible rotatable bellows spring device is tiltable over a selected tilt-excursion angle that ranges from 0.1 degrees to a maximum of 30 degrees until selected structural components that are attached to the rotatable workpiece carrier plate contacts a tilt angle excursion-stop device attached to the circular rotatable drive plate.

11. The apparatus of claim 10 wherein the vertical excursion distance ranges from 0.125 inches to a maximum of 0.375 inches and wherein the horizontal excursion distance that ranges from 0.010 inches to a maximum of 0.050 inches and wherein the selected tilt-excursion angle ranges from 5 degrees to a maximum of 15 degrees.

12. The apparatus of claim 10 wherein at least some abrading machine workpiece substrate carrier apparatus structural components are attached to the rotatable workpiece carrier plate and are positioned within the circumference and perimeter-envelope of a nominally-annular structural member attached to the circular rotatable drive plate, wherein the selected structural components that are attached to the rotatable workpiece carrier plate are constrained within the circumference and perimeter-envelope of the nominally-annular structural member attached to the circular rotatable drive plate in the event of the fracture of or damage to the rotatable bellows spring device when the circular rotatable drive plate is rotated wherein the rotatable workpiece carrier plate remains restrained by the circular rotatable drive plate during the event of the fracture of or damage to the rotatable bellows spring device.

13. The apparatus of claim 5 where the hollow flexible fluid tube that is routed to fluid passageways that are connected to fluid port holes in the rotatable workpiece carrier plate flat bottom surface has a circular arc-segment shape wherein the circular arc-segment arc length ranges from 30 degrees to 720 degrees and wherein the hollow flexible fluid tube circular arc-segment is located within the circumference and perimeter-envelope of the nominally-annular structural member that is attached to the circular rotatable drive plate.

14. The apparatus of claim 5 where the stationary vacuum or fluid rotary union that is attached to the hollow rotatable carrier drive shaft supplies vacuum or fluid to the hollow spindle shaft tube that is connected to the hollow flexible fluid tube that is routed to fluid passageways that are connected to fluid port holes in the rotatable workpiece carrier plate flat bottom surface where the hollow flexible fluid tube is a flexible bellows-type tube or an elastomer material tube or a flexible bellows-type tube with an internal elastomer material tube liner.

15. The apparatus of claim 5 where the stationary vacuum and fluid rotary union that is attached to the hollow rotatable carrier drive shaft is a friction-free air-bearing rotary union comprising:

a) at least two cylindrical air bearing devices having opposed cylindrical air bearing device ends, wherein the at least two cylindrical air bearing devices are positioned adjacent to each other longitudinally along the outside diameter of a cylindrical rotatable hollow air bearing shaft having a cylindrical rotatable hollow air bearing shaft open top end and having a cylindrical rotatable hollow air bearing shaft open bottom end wherein an end of one cylindrical air bearing device is positioned nominally adjacent to the cylindrical rotatable hollow air bearing shaft open top end;

b) wherein the cylindrical rotatable hollow air bearing shaft open bottom end is attached to the hollow rotatable carrier drive shaft wherein the cylindrical rotatable hollow air bearing shaft is concentric with the hollow rotatable carrier drive shaft;

c) wherein pressurized air is suppliable to the at least two cylindrical air bearing devices wherein an air film is formed between the at least two cylindrical air bearing devices and the cylindrical rotatable hollow air bearing shaft;

d) wherein a stationary vacuum rotary union end-cap is attached to a vacuum and fluid rotary union housing that surrounds the at least two cylindrical air bearing devices to form a sealed vacuum and fluid rotary union housing internal chamber located at the cylindrical rotatable hollow air bearing shaft open top end and wherein a vacuum port hole extends through the vacuum rotary union end-cap into the stationary vacuum and fluid rotary union housing internal chamber;

e) wherein vacuum or fluid supplied to the vacuum rotary union end-cap vacuum port hole is routed into the stationary vacuum and fluid rotary union housing internal chamber and is routed to the top open end of the hollow spindle shaft tube that is positioned within the vacuum and fluid rotary union housing internal chamber;

f) wherein there are gap-spaces between the ends of adjacent at least two cylindrical air bearing devices positioned longitudinally along the outside diameter of the cylindrical rotatable hollow air bearing shaft wherein at least one pressure port hole extends radially through the cylindrical rotatable hollow air bearing shaft at the location of the respective gap-spaces between respective two adjacent cylindrical air bearing devices;

g) wherein pressure-entry port holes extend radially through the vacuum and fluid rotary union housing that surrounds the at least two cylindrical air bearing devices at the locations of the respective gap-spaces between respective two adjacent cylindrical air bearing devices; and h) wherein pressurized air and vacuum supplied to respective pressure-entry port holes that extend radially through the vacuum and fluid rotary union housing is routed into the at least one pressure port hole extending radially through the cylindrical rotatable hollow air bearing shaft and i) is routed into the gap-spaces between the ends of adjacent at least two cylindrical air bearing devices and is routed into a respective annular space gap-space passageway between the hollow spindle shaft tube and the cylindrical rotatable hollow air bearing shaft wherein air or vacuum is routed into the annular gap between the hollow spindle shaft tube and the hollow rotatable carrier drive shaft hollow opening and into the sealed enclosed bellows pressure chambers or ii) is routed into respective tubes or passageways that are connected with multiple respective sealed enclosed bellows pressure chambers that are located in the abrading machine workpiece substrate carrier apparatus.

16. The apparatus of claim 13 where the cylinder-shaped air bearing devices are porous carbon air bearing devices.

17. The apparatus of claim 10 where the rotatable workpiece carrier plate and the selected structural components attached to the rotatable workpiece carrier plate can be rigidly held in position against rigid stop devices that are attached to the circular rotatable drive plate by applying vacuum to the sealed enclosed bellows pressure chamber, wherein the controlled vacuum negative pressure acts on the rotatable workpiece carrier plate top surface and compresses the rotatable bellows spring device, wherein the abrading machine workpiece substrate carrier apparatus can provide rigid abrading of workpieces when the stationary-positioned carrier housing is moveable vertically to position the flat workpiece bottom surface into flat-surfaced abrading contact with the rotatable abrading platen abrading surface.

18. The apparatus of claim 4 wherein vacuum supplied through the annular gap between the hollow spindle shaft tube and the carrier drive shaft hollow opening to contract the rotatable bellows spring device in a vertical direction is provided with a substantial-volume vacuum surge tank located nominally near the abrading machine workpiece substrate carrier apparatus, wherein a substantial amount of controlled vacuum is quickly applicable to the sealed enclosed bellows pressure chamber, wherein the controlled vacuum negative pressure acts on the rotatable workpiece carrier plate top surface and compresses the rotatable bellows spring device which is flexed upward in a vertical direction by application of the controlled vacuum negative pressure in the sealed enclosed bellows pressure chamber where i) the rotatable workpiece carrier plate is raised away from the rotatable abrading platen abrading surface or ii) the rotatable workpiece carrier plate and the workpiece attached to the rotatable workpiece carrier plate is raised away from the rotatable abrading platen abrading surface.

19. A process of providing abrading workpieces using an abrading machine workpiece substrate carrier apparatus comprising:

a) providing a movable, nominally-horizontal, stationary-positioned carrier housing having an outer periphery and an outer periphery area that is nominally-horizontal and is adjacent to the stationary-positioned carrier housing outer periphery, the carrier housing having rotary bearings that support a vertical hollow rotatable carrier drive shaft having:

i) a carrier drive shaft cross-section, ii) a carrier drive shaft length iii) a carrier drive shaft axis of rotation concentric to the carrier drive shaft cross-section and extends along a length of the carrier drive shaft and iv) a carrier drive shaft hollow opening that extends along the carrier drive shaft length;

wherein the carrier drive shaft is fixed vertically to the stationary-positioned carrier housing and wherein the stationary-positioned carrier housing is moveable in a vertical direction;

b) providing a circular rotatable drive plate having a rotatable drive plate outer diameter, a rotatable drive plate top surface and an opposed rotatable drive plate bottom surface wherein both the rotatable drive plate top surface and the rotatable drive plate bottom surface are nominally horizontal and wherein the rotatable drive plate has a rotation axis that is perpendicular to the rotatable drive plate top surface and is located at the center of the rotatable drive plate top surface, wherein the rotatable drive plate top surface is attached to and is supported by the carrier drive shaft and wherein the carrier drive shaft axis of rotation is concentric with the rotatable drive plate rotation axis;

c) providing a rotatable bellows spring device having multiple annular rings of flat-surfaced metal or polymers having annular ring outer diameters and annular ring inside diameters where selected adjacent annular rings are joined together at their outer diameters and selected adjacent annular rings are joined together at their inner diameters to form the rotatable bellows spring device wherein the multiple individual annular rings are nominally horizontal and where the individual annular rings are flexible in a vertical direction and where the rotatable bellows spring device has a rotatable bellows spring device top annular ring and a rotatable bellows spring device bottom annular ring and where the rotatable bellows spring device has a nominally-vertical axis of rotation that is perpendicular to the rotatable bellows spring device nominally-horizontal top annular ring and the rotatable bellows spring device axis of rotation is located at the center of the rotatable bellows spring device top annular ring and wherein all of the multiple selected adjacent annular rings and the rotatable bellows spring device top annular ring and the rotatable bellows spring device bottom annular ring are all mutually joined together to form an integral rotatable bellows spring device wherein the rotatable bellows spring device bottom annular ring can be moved a selected vertical excursion distance relative to the rotatable bellows spring device top annular ring and wherein the rotatable bellows spring device bottom annular ring can be moved a selected horizontal excursion distance relative to the rotatable bellows spring device top annular ring and wherein the rotatable bellows spring device bottom annular ring can be tilted through a selected excursion angle to a horizontal plane;

d) providing that the rotatable bellows spring device individual annular ring outer diameters are approximately the same and wherein the rotatable bellows spring device individual annular ring outer diameters are approximately the same as the rotatable drive plate outer diameter wherein the rotatable bellows spring device top annular ring is attached to the rotatable drive plate bottom surface and wherein the rotatable bellows spring device axis of rotation is nominally-coincident with the rotatable drive plate rotation axis;

e) providing a circular rotatable workpiece carrier plate having a rotatable workpiece carrier plate top surface and an opposed rotatable workpiece carrier plate flat bottom surface wherein both the rotatable workpiece carrier plate top surface and the rotatable workpiece carrier plate bottom surface are nominally horizontal and wherein the rotatable workpiece carrier plate has a rotation axis that is perpendicular to the rotatable workpiece carrier plate top surface and is located at the center of the rotatable workpiece carrier plate top surface, wherein the rotatable workpiece carrier plate has a rotatable workpiece carrier plate outer diameter that is approximately the same as outer diameters of the rotatable bellows spring device individual annular rings wherein the rotatable workpiece carrier plate has a rotatable workpiece carrier plate thickness and a rotatable workpiece carrier plate outer periphery surface located at the rotatable workpiece carrier plate outer diameter and extends from the rotatable workpiece carrier plate top surface to the rotatable workpiece carrier plate flat bottom surface;

f) attaching the rotatable bellows spring device bottom annular ring to the rotatable workpiece carrier plate top surface and wherein the rotatable bellows spring device axis of rotation is nominally-coincident with the rotatable workpiece carrier plate rotation axis;

g) providing at least two roller idlers having respective stationary nominally-vertical roller idler shafts having respective stationary roller idler shaft lengths attached to the stationary-positioned carrier housing outer periphery in the stationary-positioned carrier housing outer periphery area, wherein the respective at least two stationary roller idler shafts support respective roller idler bearings that support respective rotatable roller idler shells, and wherein the respective rotatable roller idler outer shells have a roller idler outer shell periphery and a roller idler outer shell periphery surface area that is nominally-vertical and the respective rotatable roller idler outer shells rotate about a rotation axis that is concentric with the roller idler shafts and extend along the respective roller idler shafts lengths, wherein the respective rotation axes of the respective roller idler shafts are nominally-vertical;

h) attaching the at least two multiple roller idlers to the stationary-positioned carrier housing outer periphery area around the stationary-positioned carrier housing outer periphery, the at least two respective rotatable roller idler outer shells periphery surface areas are positioned in contact with the rotatable workpiece carrier plate outer diameter rotatable workpiece carrier plate outer periphery surface, and the at least two multiple roller idlers care in rolling contact with the rotatable workpiece carrier plate outer periphery surface as the rotatable workpiece carrier plate is rotated and the at least two multiple roller idlers maintain the rotatable workpiece carrier plate rotation axis to be concentric with the carrier drive shaft axis of rotation when the rotatable workpiece carrier plate is rotated;

i) attaching at least one workpiece having parallel opposed flat workpiece top surfaces and flat workpiece bottom surfaces to the rotatable workpiece carrier plate flat bottom surface and wherein the at least one workpiece top surface is attached to the rotatable workpiece carrier plate flat bottom surface;

j) providing a rotatable abrading platen having a flat abrasive coated abrading surface that is nominally horizontal;

k) moving the stationary-positioned carrier housing is moveable vertically to position the flat workpiece bottom surface into flat-surfaced abrading contact with the rotatable abrading platen abrading surface and the stationary-positioned carrier housing is moveable vertically to move the flat workpiece bottom surface from flat-surfaced abrading contact with the rotatable abrading platen abrading surface; and l) abrading the at least one workpiece.

20. The process of claim 19 where the rotatable bellows spring device top annular ring is attached to the rotatable drive plate bottom surface and the spring device bottom annular ring is attached to the rotatable workpiece carrier plate top surface, wherein a sealed enclosed bellows pressure chamber is formed in an internal volume that is contained by the rotatable bellows spring device, the rotatable drive plate bottom surface and the rotatable workpiece carrier plate top surface, wherein the rotatable bellows spring device, the rotatable drive plate bottom surface, the rotatable workpiece carrier plate top surface and the rotatable bellows spring device multiple individual annular ring joints are pressure and vacuum sealed, wherein the rotatable drive is attached to the rotatable drive plate bottom surface and the rotatable bellows plate bottom surface is pressure and vacuum sealed and where the rotatable workpiece carrier plate top surface is pressure and vacuum sealed, wherein controlled-pressure air or controlled-pressure fluid or controlled-pressure vacuum can be introduced into the sealed enclosed bellows pressure chamber through a fluid passageway connecting the hollow rotatable carrier drive shaft to the enclosed bellows pressure chamber.

* * * * *